US010105959B2

(12) United States Patent
Suzuki et al.

(10) Patent No.: US 10,105,959 B2
(45) **Date of Patent: *Oct. 23, 2018**

(54) LIQUID SUPPLYING APPARATUS, LIQUID EJECTING APPARATUS, AND LIQUID CONTAINER UNIT

(71) Applicant: SEIKO EPSON CORPORATION, Tokyo (JP)

(72) Inventors: Hidenao Suzuki, Nagano (JP); Munehide Kanaya, Nagano (JP); Naomi Kimura, Naganoa (JP); Koki Hayashi, Naganoa (JP); Koji Nishimaki, Nagano (JP); Shoma Kudo, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/071,371

(22) Filed: Mar. 16, 2016

(65) Prior Publication Data

US 2016/0193847 A1 Jul. 7, 2016

(30) Foreign Application Priority Data

Jan. 28, 2014 (JP) ..... 2014-013068
Oct. 20, 2014 (JP) ..... 2014-213619

(51) Int. Cl.

| | |
|---|---|
| ***B41J 2/175*** | (2006.01) |
| ***B41J 29/02*** | (2006.01) |
| ***B41J 29/13*** | (2006.01) |

(52) U.S. Cl.
CPC ..... *B41J 2/17553* (2013.01); *B41J 2/175* (2013.01); *B41J 2/1752* (2013.01); *B41J 2/17509* (2013.01); *B41J 29/02* (2013.01); *B41J 29/13* (2013.01)

(58) Field of Classification Search
CPC ..... B41J 2/17553; B41J 2/1752; B41J 29/13; B41J 29/02; B41J 2/17509; B41J 2/175
See application file for complete search history.

(56) References Cited

U.S. PATENT DOCUMENTS 7,484,838 B2 * 2/2009 Tsurui ..... B41J 2/175 347/85
2003/0007049 A1 1/2003 Hino
2008/0239028 A1 10/2008 Umeda
(Continued)

FOREIGN PATENT DOCUMENTS

CN 201099042 Y 8/2008
CN 104626746 A1 5/2015
(Continued)

OTHER PUBLICATIONS

International Search Report for International Patent Application No. PCT/JP2015/000320 dated Apr. 21, 2015.

*Primary Examiner* — Julian Huffman
*Assistant Examiner* — Michael Konczal

(57) ABSTRACT

A liquid supplying apparatus, configured to supply a liquid to a liquid ejecting section that is configured to eject the liquid, includes a tank configured to contain the liquid, the tank including a liquid containing section, and a container section connected to the tank. The container section is exposed to air through the tank, and the container section is connected to the liquid containing section of the tank.

7 Claims, 43 Drawing Sheets

(56) References Cited

U.S. PATENT DOCUMENTS

| | | | | |
|---|---|---|---|---|
| 2009/0262153 | A1* | 10/2009 | Tamaki | B41J 2/175 347/7 |
| 2011/0234713 | A1 | 9/2011 | Tamaki | |
| 2012/0038719 | A1* | 2/2012 | Shimizu | B41J 2/17523 347/86 |
| 2012/0062659 | A1 | 3/2012 | Tsubaki | |
| 2015/0130879 | A1 | 5/2015 | Kimura et al. | |
| 2015/0210081 | A1* | 7/2015 | Suzuki | B41J 2/175 347/86 |

FOREIGN PATENT DOCUMENTS

| | | | |
|---|---|---|---|
| EP | 0956958 | A2 | 11/1999 |
| EP | 2127886 | A1 | 12/2009 |
| EP | 3095604 | A1 | 11/2016 |
| JP | 08-187873 | A | 7/1996 |
| JP | 08-197743 | A | 8/1996 |
| JP | 09-220817 | A | 8/1997 |
| JP | 2003-205624 | A | 7/2003 |
| JP | 2003-211694 | A | 7/2003 |
| JP | 2004-142325 | A | 5/2004 |
| JP | 2012-051307 | A | 3/2012 |
| JP | 2012-051308 | A | 3/2012 |
| JP | 2013-000949 | A | 1/2013 |
| JP | 2014-195908 | A | 10/2014 |

* cited by examiner

LIQUID SUPPLYING APPARATUS, LIQUID EJECTING APPARATUS, AND LIQUID CONTAINER UNIT

CROSS-REFERENCE TO RELATED APPLICATIONS

This application is a divisional application of U.S. patent application Ser. No. 14/606,102, filed on Jan. 27, 2015, which claims priority to Japanese Patent Application Nos. 2014-013068 filed on Jan. 28, 2014 and 2014-213619 filed on Oct. 20, 2014. The entire disclosures of Japanese Patent Application Nos. 2014-013068 and 2014-213619 are hereby incorporated herein by reference.

BACKGROUND

Technical Field

The present invention relates to a liquid supplying apparatus, a liquid ejecting apparatus, a liquid container unit, and the like.

Related Art

In the prior art, ink jet printers are known as an example of a liquid ejecting apparatus. It is possible for an ink jet printer to perform printing on a printing medium by discharging ink, which is an example of a liquid, from an ejecting head onto a printing medium such as printing paper sheets. In an ink jet printer such as this, a configuration is known in the prior art where ink, which is stored in a tank which is an example of a liquid containing portion, is supplied to an ejecting head. An ink injection port is provided in the tank. It is possible for a user to fill ink from the ink injection port into the tank (see JP-A-2012-51307 (PTL 1), for example). Here, a configuration, where a liquid containing portion such as the tank is added to a liquid ejecting apparatus such as an ink jet printer, is used below to represent a liquid ejecting system.

SUMMARY

Since a tank body in the tank which is described in PTL 1 is semi-transparent, it is possible for a user to visually recognize the amount of ink in an inner section of the tank from the outside. In the tank, a lower limit line is provided at a portion of wall sections which configure the tank body. It is possible for a user to ascertain the amount of ink inside the tank by ink inside the tank being visually recognizable via the wall section where the lower limit line is provided. Then, it is possible for a user to inject ink from a liquid injection port into the inside of the tank when the amount of ink is low. The wall section which is provided with the lower limit line is referred to as a visual recognition section.

Here, in the liquid ejecting apparatus which is described in PTL 1, the tank is provided on a side surface of the printer where the paper sheet discharge section side of the printer is set as a front surface. Then, when viewing the printer from the front surface, the visual recognition section of the tank is a surface on the side which intersects with the front surface. For this reason, when a user ascertains the amount of ink inside the tank, it is necessary for the tank to be visually recognizable from the side of the printer. In the liquid ejecting apparatus, it is convenient if it possible to ascertain the amount of liquid inside the liquid containing portion from the front surface of the liquid ejecting apparatus. In this manner, there is a problem in the liquid ejecting apparatuses in the prior art in that there is room for improvement in terms of convenience.

The present invention is carried out in order to solve at least a portion of the problem described above and is able to be realized as the following embodiments or applied example.

Applied Example 1

A liquid supplying apparatus, configured to supply a liquid to a liquid ejecting section that is configured to eject the liquid, includes a tank configured to contain the liquid, the tank including a liquid containing section, and a container section connected to the tank. The container section is exposed to air through the tank, and the container section is connected to the liquid containing section of the tank.

BRIEF DESCRIPTION OF THE DRAWINGS

Referring now to the attached drawings which form a part of this original disclosure.

DETAILED DESCRIPTION OF EMBODIMENTS

Embodiments with a liquid ejecting system, which includes an ink jet printer (referred to below as a printer) which is an example of a liquid ejecting apparatus, as an example will be described below with reference to the drawings. Here, there are times when the scale of the configuration and members in each of the drawings are different in order for the sizes to be of an extent such that it is possible for the respective configurations to be recognized.

Figure 1:
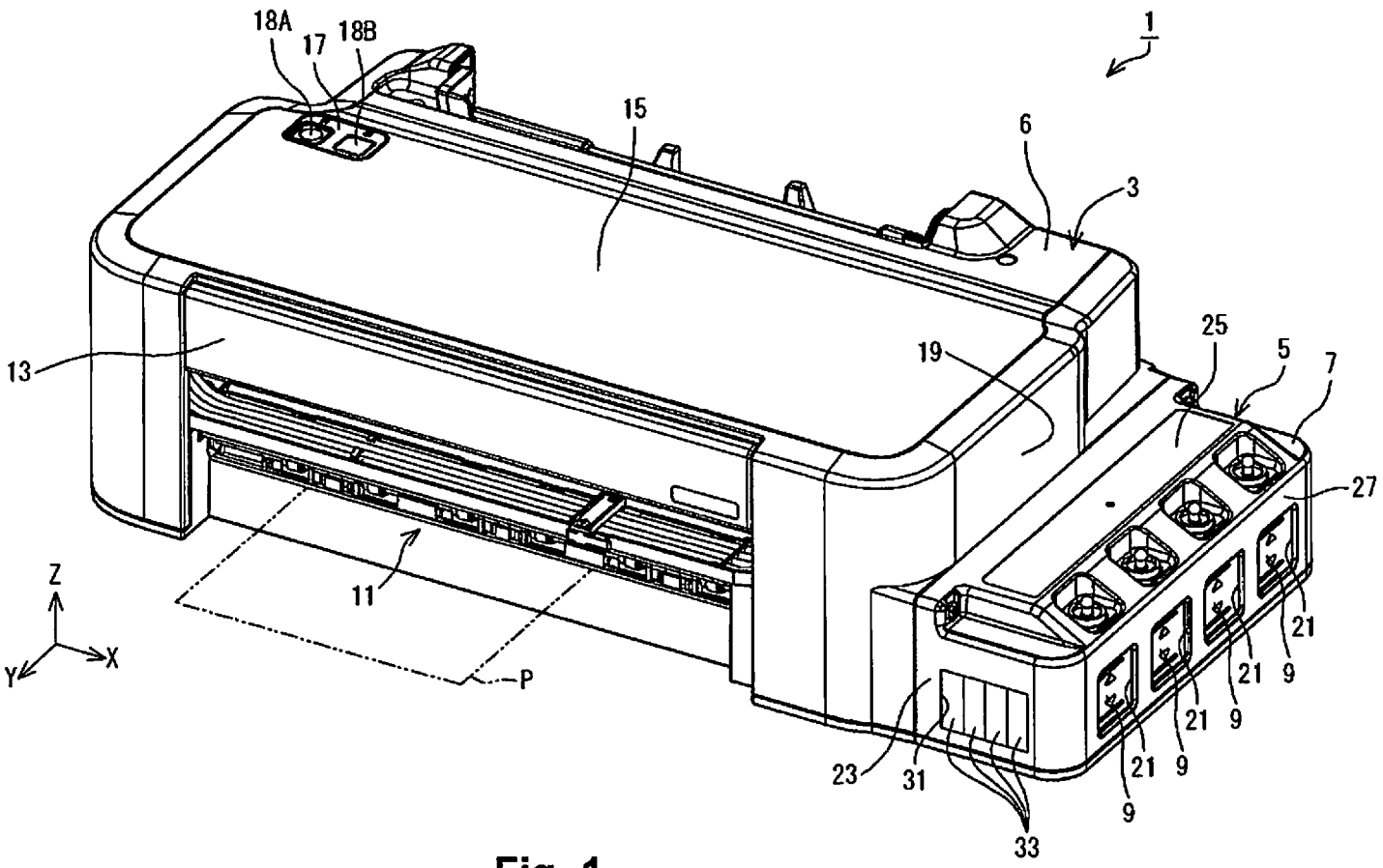
FIG. 1 is a perspective diagram illustrating a liquid ejecting system in an embodiment.

As shown in FIG. 1, a liquid ejecting system 1 in the present embodiment has a printer 3 which is an example of a liquid ejecting apparatus and a tank unit 5. The printer 3 has a first casing 6. The first casing 6 configures an outer shell of the printer 3. The tank unit 5 has a second casing 7 and a plurality (two or more) of tanks 9. The first casing 6 and the second casing 7 configure an outer shell of the liquid ejecting system 1. The tank 9 is an example of a liquid containing container. It is possible for the liquid ejecting system 1 to perform printing onto a printing medium P such as printing paper sheets using ink which is an example of a liquid.

Here, X, Y, and Z axes, which are coordinate axes which are orthogonal to each other, are applied in FIG. 1. The X, Y, and Z axes are also applied as required in the drawings shown hereafter. In the respective X, Y, and Z axes, the directions of the arrows show + directions (positive directions) and the directions of the arrows show − directions (negative directions) which are in the opposite direction to the positive directions. In a state where the liquid ejecting system 1 is being used, the liquid ejecting system 1 is arranged on a horizontal plane which is specified by the X axis and the Y axis. In a state where the liquid ejecting system 1 is being used, the Z axis is an axis which is orthogonal to the horizontal plane and the −Z axis direction is a vertically downward direction.

A mechanism unit 10 (FIG. 4) of the printer 3 is contained in the first casing 6. The mechanism unit 10 is a mechanism portion which executes printing operations in the printer 3. The mechanism unit 10 will be described later in detail. As shown in FIG. 1, a plurality of the tanks 9 are contained in the second casing 7 and each contain ink which is for printing. Four of the tanks 9 are provided in the present embodiment. In the four tanks 9, the types of ink are different for each of the tanks 9. The four types of black, yellow, magenta, and cyan are adopted as the types of ink in the present embodiment. Then, one each of the tank 9 which contains black ink, the tank 9 which contains yellow ink, the tank 9 which contains magenta ink, and the tank 9 which contains cyan ink are provided. The plurality of tanks 9 are provided on the outer side of the first casing 6 in the liquid ejecting system 1. For this reason, the plurality of tanks 9 are not built into the first casing 6 which covers the mechanism unit 10 in the liquid ejecting system 1.

In addition, a paper discharge section 11 is provided in the printer 3. The printing medium P is discharged from the paper discharge section 11 in the printer 3. A surface where the paper discharge section 11 is provided in the printer 3 is a front surface 13. In addition, the printer 3 has an operation panel 17 on an upper surface 15 which intersects with the front surface 13. A power source button 18A, other operation buttons 18B, and the like are provided in the operation panel 17. The tank unit 5 is provided in the first casing 6 at a side section 19 which intersects with the front surface 13 and the upper surface 15. Window portions 21 are provided in the second casing 7. The window portions 21 are provided in the second casing 7 at a side section 27 which intersects with a front surface 23 and an upper surface 25.

The window portions 21 are optically transmissive. Then, the four tanks 9 described above are provided at positions which overlap with the window portions 21. For this reason, it is possible for an operator who is using the liquid ejecting system 1 to visually recognize the four tanks 9 via the window portions 21. In the present embodiment, the window portions 21 are provided as openings which are formed in the second casing 7. It is possible for an operator to visually recognize the four tanks 9 via the window portions 21 which are openings. Here, the window portions 21 are not limited to being openings, and may be configured by, for example, members which are optically transmissive.

In the present embodiment, at least a portion of parts, which oppose the window portions 21, in each of the tanks 9 are optically transmissive. It is possible to visually recognize the ink in the tanks 9 from the parts, which are optically transmissive, in each of the tanks 9. Accordingly, it is possible for an operator to visually recognize the amount of ink in each of the tanks 9 by the four tanks 9 being visually recognizable via the window portions 21. That is, it is possible to utilize at least a portion of the parts which oppose the window portions 21 as a visual recognition section where it is possible to visually recognize the amount of ink in each of the tanks 9. An upper limit mark 28 which indicates an upper limit of the amount of ink and a lower limit mark 29 which indicates the lower limit of the amount of ink are provided in each of the tanks 9 at the parts which oppose the window portions 21. It is possible for an operator to ascertain the amount of ink in each of the tanks 9 with the upper limit mark 28 and the lower limit mark 29 as markings. Here, the upper limit mark 28 (an upper limit display section) indicates an estimate of an amount such that ink does not overflow from an ink introduction section 101 when ink is introduced from the ink introduction section 101. In addition, the lower limit mark 29 (a lower limit display section) indicates an estimate of an amount of ink when introduction of ink is to be prompted. It is possible to also adopt a configuration where at least one of the upper limit mark 28 and the lower limit mark 29 are provided in the second casing 7.

In addition, a window portion 31 is provided in the second casing 7. The window portion 31 is provided in the front surface 23 in the second casing 7. The window portion 31 is optically transmissive. Then, a plurality of (two or more) indicators 33 are provided at positions which overlap with the window portion 31. In the present embodiment, four of the indicators 33 are provided. The four indicators 33 are respectively connected to each of the four tanks 9. That is, one of the indicators 33 is connected to one of the tanks 9. It is possible for the indicators 33 to respectively indicate the remaining amount of ink which is contained in each of the four tanks 9. It is possible for an operator who uses the liquid ejecting system 1 to visually recognize the four indicators 33 via the window portion 31. For this reason, it is possible for an operator to visually recognize the amount of ink in each of the indicators 33 by the four indicators 33 being visually recognizable via the window portion 31.

Figure 2:
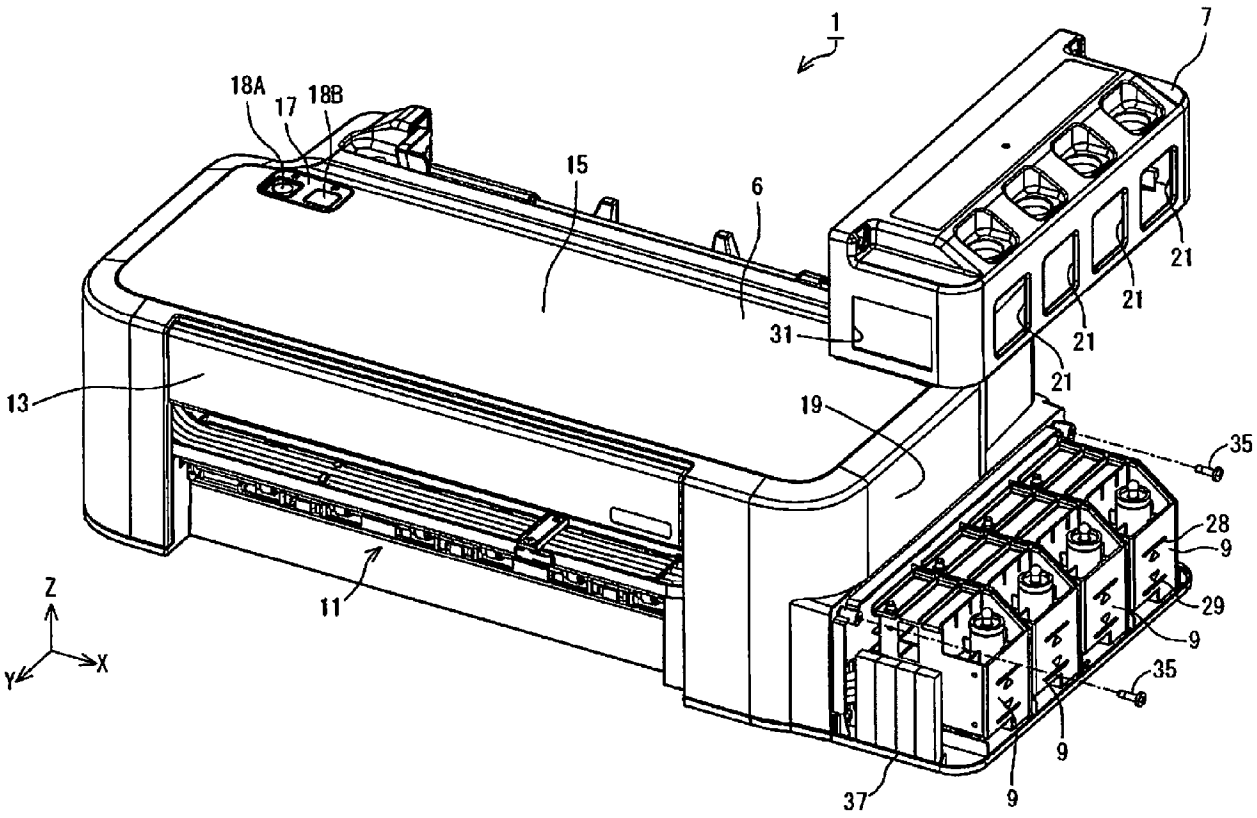
FIG. 2 is a perspective diagram illustrating a liquid ejecting system in an embodiment.

Here, the first casing 6 and the second casing 7 are configured independently from each other. For this reason, it is possible to separate the second casing 7 from the first casing 6 in the present embodiment as shown in FIG. 2. The second casing 7 is coupled with the first casing 6 using an attachment screw 35. In addition, the second casing 7 covers the four tanks 9 as shown in FIG. 2. In addition, the second casing 7 covers the four indicators 33.

Figure 3:
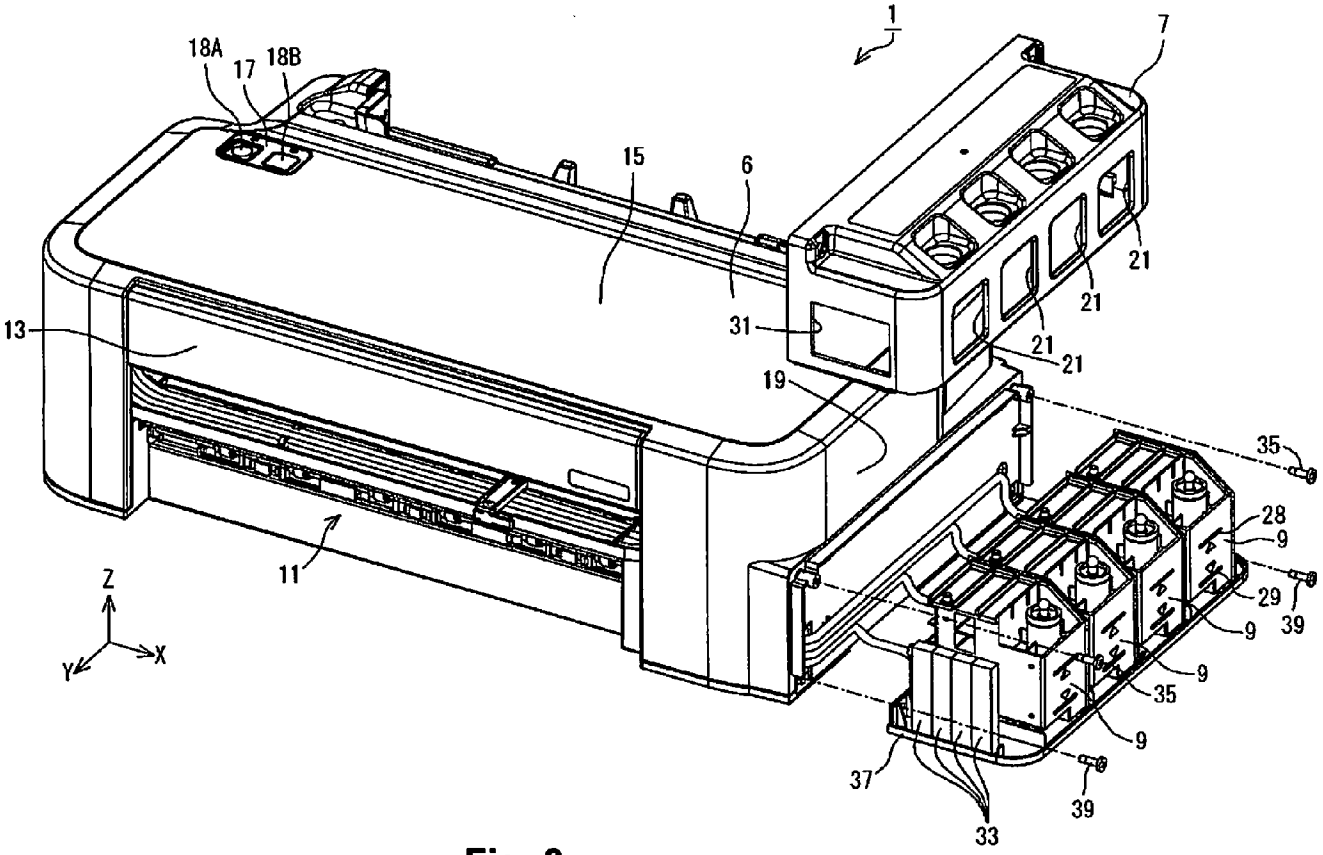
FIG. 3 is a perspective diagram illustrating a liquid ejecting system in an embodiment.

In addition, the tank unit 5 has a support frame 37. The four tanks 9 are supported by the support frame 37. In addition, the four indicators 33 are supported by the support frame 37. The support frame 37 is configured to be independent from the first casing 6. For this reason, it is possible to separate the support frame 37 from the first casing 6 in the present embodiment as shown in FIG. 3. The support frame 37 is coupled with the first casing 6 using an attachment screw 39. In this manner, the tank unit 5 (FIG. 1) is attached to the outer side of the first casing 6 in the present embodiment.

Figure 4:
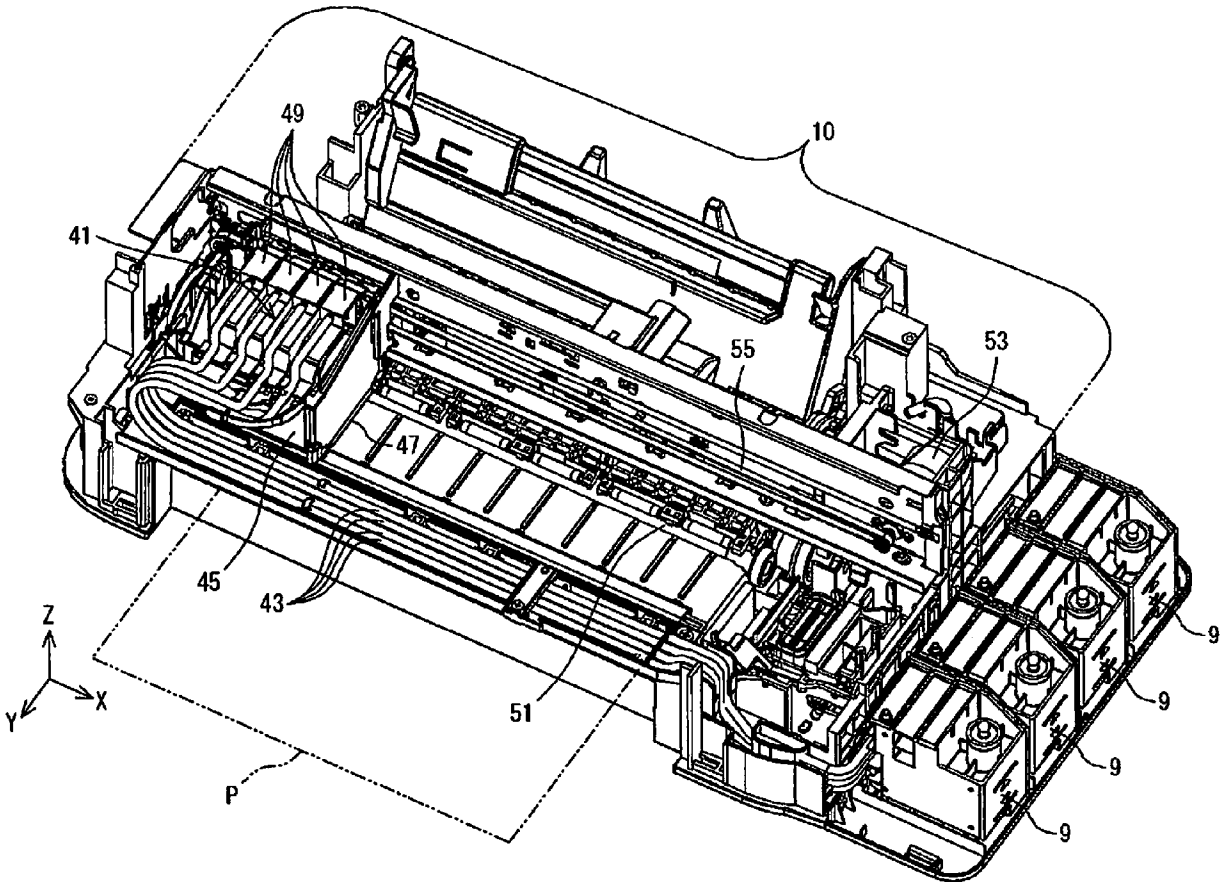
FIG. 4 is a perspective diagram illustrating a mechanism unit of a printer in an embodiment.

As shown in FIG. 4 which is a perspective diagram illustrating the mechanism unit 10, the printer 3 has a printing section 41 and supply tubes 43. The printing section 41 has a carriage 45, a printing head 47, and four relay units 49. The printing head 47 and the four relay units 49 are mounted on the carriage 45. The supply tubes 43 have flexibility and are provided between the tanks 9 and the relay units 49. The ink in the tank 9 is sent to the relay units 49 via the supply tubes 43. The relay units 49 relay the ink, which is supplied from the tanks 9 via the supply tubes 43, to the printing head 47. The printing head 47 discharges ink, which is supplied, as ink droplets.

In addition, the printer 3 has a medium transport mechanism (which is not shown in the drawings) and a head transport mechanism (which is not shown in the drawings). The medium transport mechanism transports the printing medium P along the Y axis direction by a transfer roller 51 being driven using the motive force from a motor which is not shown in the drawings. The head transport mechanism transports the carriage 45 along the X axis direction by transmitting motive force from a motor 53 to the carriage 45 via a timing belt 55. The printing head 47 is mounted on the carriage 45. For this reason, it is possible for the printing head 47 to be transported in the X axis direction via the carriage 45 using the head transport mechanism. Here, the printing head 47 is supported by the carriage 45 in a state of opposing the printing medium P. Printing is carried out on the printing medium P by ink being discharged from the printing head 47 while the relative position of the printing head 47 is changed with regard to the printing medium P using the medium transport mechanism and the head transport mechanism.

Here, the indicator 33 described above is connected to the tank 9 via a tube which will be described later. The ink in the tank 9 is sent to the indicator 33 via the tube. In the present embodiment, the indicator 33 is optically transmissive. For this reason, it is possible to visually recognize the ink, which is sent from the tank 9 to the indicator 33, via the indicator 33. The liquid level of the ink in the tank 9 is reflected by the indicator 33. For this reason, it is possible for an operator to ascertain the remaining amount of ink in the tank 9 by the liquid level of the ink in the indicator 33 being visually recognizable. Below, a combination of one of the tanks 9 and one of the indicators 33 is used to represent a tank set 57.

Various applied examples of the tank set 57 will be described. Here, in order for the tank set 57 to be identified in each of the applied examples below, different alphabetic characters have been assigned to the reference numerals of the tank set 57 for each of the applied examples.

Applied Example 1

Figure 5:
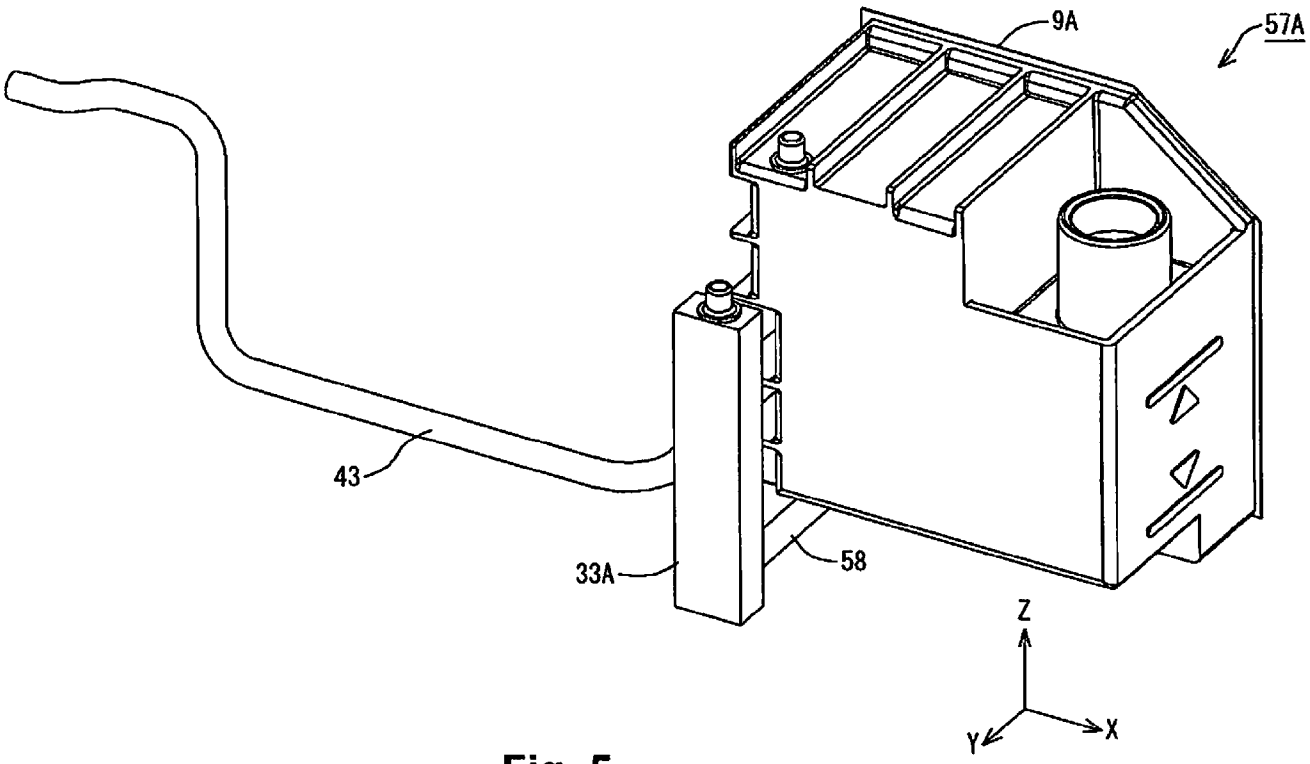
FIG. 5 is a perspective diagram illustrating a tank set in applied example 1.

A tank set 57A is described in applied example 1. As shown in FIG. 5, the tank set 57A has a tank 9A, an indicator 33A, a tube 58, and a supply tube 43. The tank 9A and the indicator 33A are connected to each other in the tank set 57A via the tube 58. Here, the tank set 57A is an example of a liquid supplying apparatus.

Figure 6:
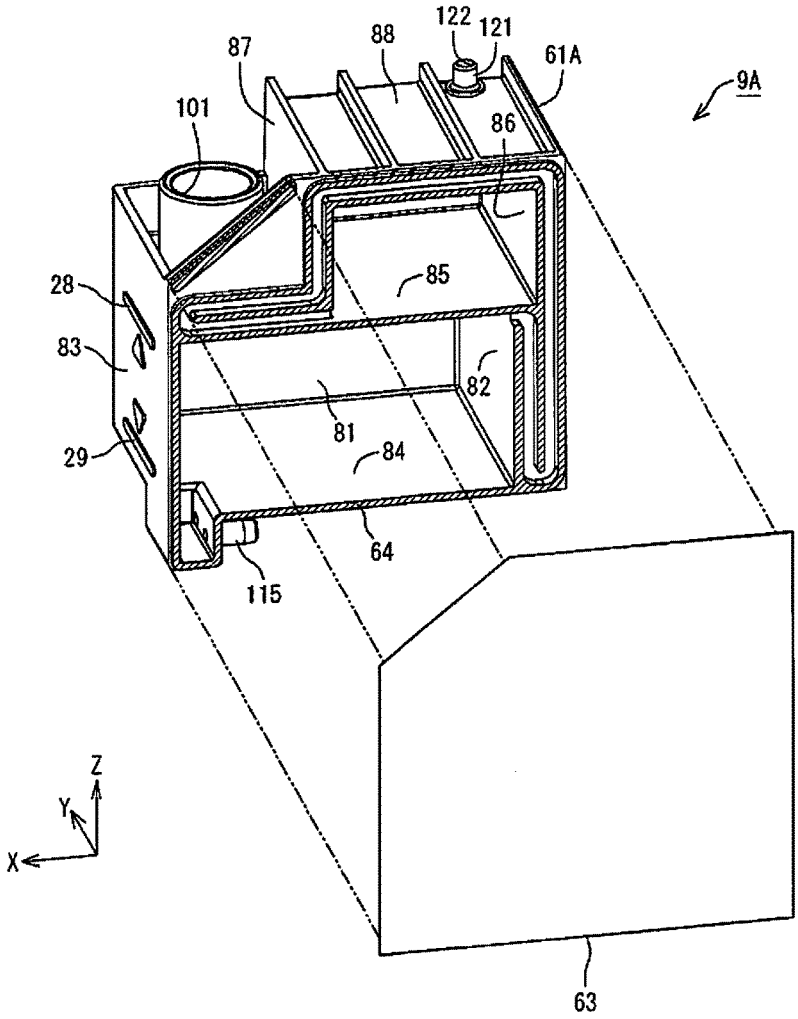
FIG. 6 is an exploded perspective diagram illustrating a tank in applied example 1.

As shown in FIG. 6, the tank 9A has a casing 61A, which is an example of a tank body, and a sheet member 63. The casing 61A is configured using, for example, a synthetic resin such as nylon or polypropylene. In addition, the sheet member 63 is formed in a film shape using synthetic resin (for example, nylon, polypropylene, or the like) and has flexibility. In the present embodiment, the sheet member 63 is optically transmissive. The tank 9A has a configuration where the casing 61A and the sheet member 63 are joined. A joining section 64 is provided in the casing 61A. The joining section 64 is hatched in FIG. 6 in order for the configuration to be easy to understand. The sheet member 63 is joined to the joining section 64 of the casing 61A. In the present embodiment, the casing 61A and the sheet member 63 are joined by fusing.

Figure 7:
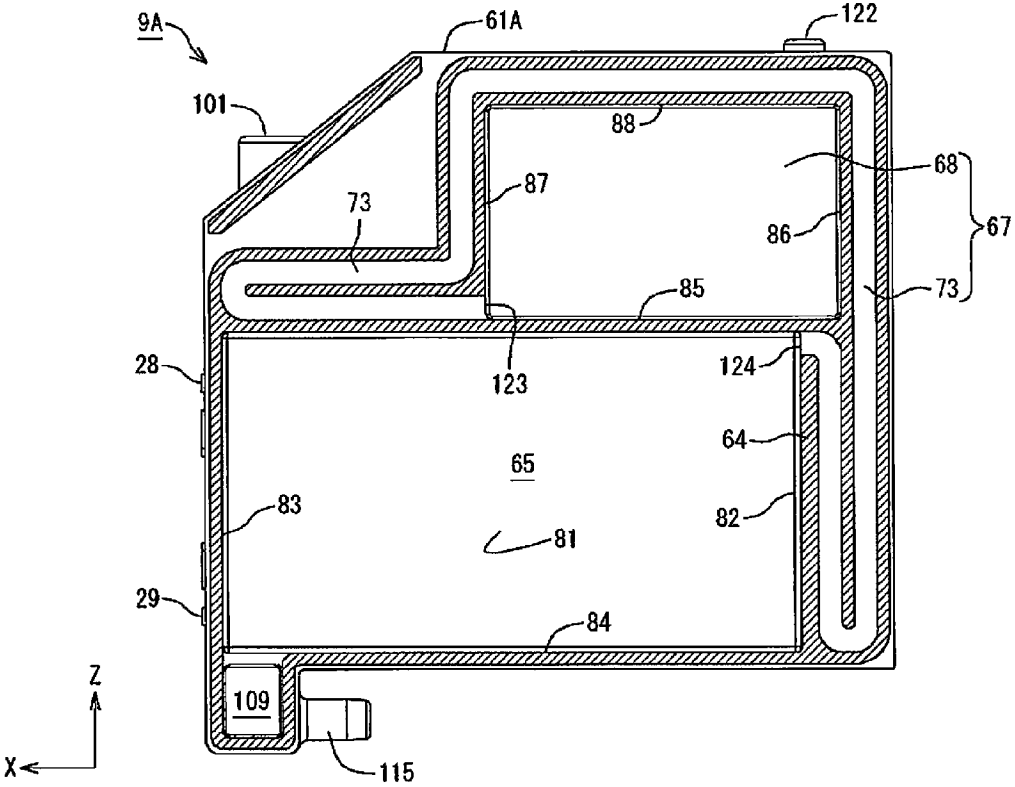
FIG. 7 is a side surface diagram of a tank in applied example 1 viewed from a sheet member side.

As shown in FIG. 7, the tank 9A has a containing section 65 and a linking section 67. The linking section 67 has an air chamber 68 and a linking path 73. In the tank 9A, ink is contained in the containing section 65. Here, FIG. 7 shows a state where the tank 9A is viewed from the sheet member 63 side and shows the casing 61A beyond the sheet member 63. The containing section 65, the air chamber 68, and the linking path 73 are partitioned from one another by the joining section 64. The casing 61A has a first wall 81, a fourth wall 84, a fifth wall 85, a second wall 82, a third wall 83, a sixth wall 86, a seventh wall 87, and an eighth wall 88. The air chamber 68 and a portion of the linking path 73 are arranged on the opposite side to the containing section 65 side of the fifth wall 85. In a planar view of the first wall 81 from the sheet member 63 side, the containing section 65 is surrounded by the fourth wall 84, the fifth wall 85, the second wall 82, and the third wall 83. Here, the third wall 83 opposes the window portions 21 in the second casing 7. That is, the tank 9A includes a part which is optically transmissive in the third wall 83.

Figure 8:
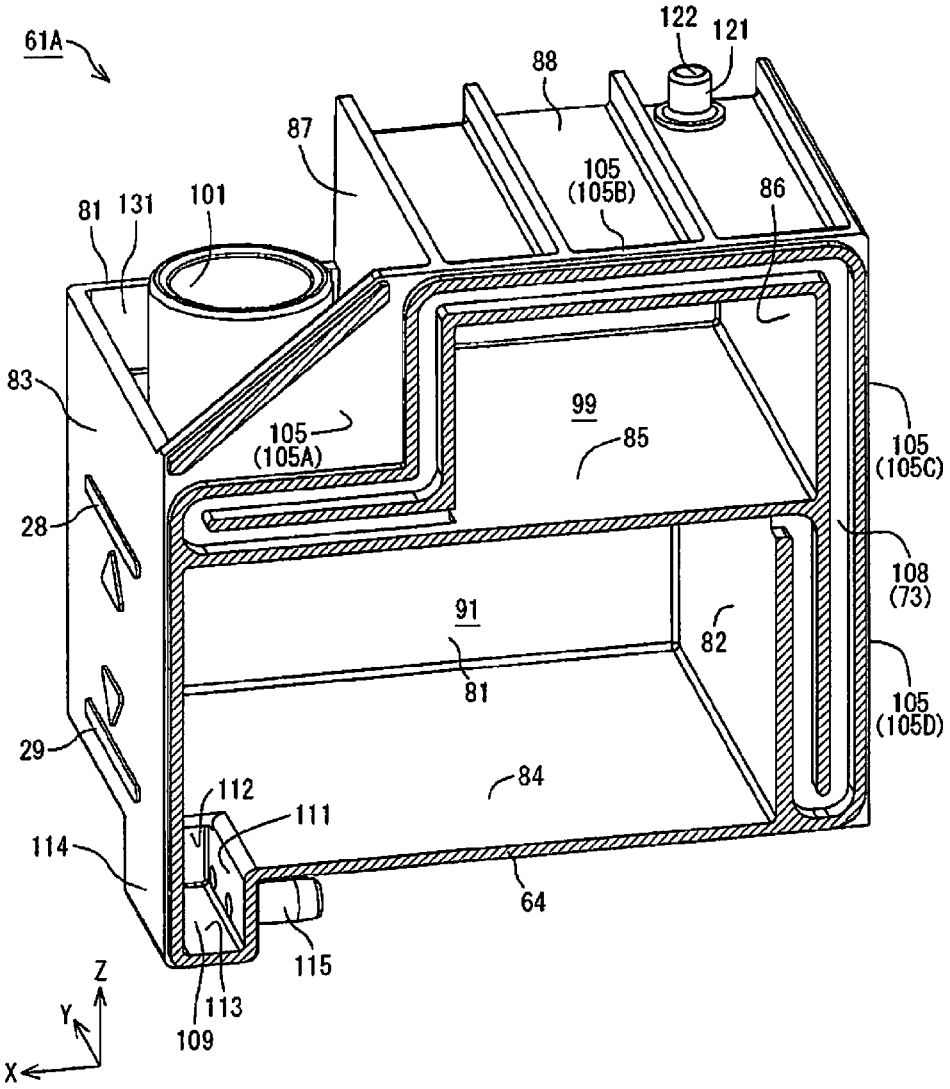
FIG. 8 is a perspective diagram illustrating a casing in applied example 1.

In addition, in a planar view of the first wall 81 from the sheet member 63 side, the air chamber 68 is surrounded by the fifth wall 85, the sixth wall 86, the seventh wall 87, and the eighth wall 88. Here, the first wall 81 of the containing section 65 and the first wall 81 of the air chamber 68 are the same wall. That is, in the present embodiment, the containing section 65 and the air chamber 68 share the first wall 81. As shown in FIG. 8, the fourth wall 84, the fifth wall 85, the second wall 82, and the third wall 83 each intersect with the first wall 81. The fifth wall 85 is positioned more to the Z axis direction side than the fourth wall 84. The fourth wall 84 and the fifth wall 85 oppose each other so as to interpose the first wall 81. The third wall 83 is positioned more to the X axis direction side than the second wall 82. The second wall 82 and the third wall 83 oppose each other so as to interpose the first wall 81. The second wall 82 intersects with each of the fourth wall 84 and the fifth wall 85. The third wall 83 also intersects with each of the fourth wall 84 and the fifth wall 85.

The fourth wall 84, the fifth wall 85, the second wall 82, and the third wall 83 protrude from the first wall 81 in the −Y axis direction. Due to this, a recessed section 91 is configured by the fourth wall 84, the fifth wall 85, the second wall 82 and the third wall 83, which extend in the −Y axis direction from the main wall, with the first wall 81 as the main wall. The recessed section 91 is configured with an orientation so to be recessed toward the Y axis direction. The recessed section 91 is open toward the −Y axis direction, that is, toward the sheet member 63 (FIG. 6) side. In other words, the recessed section 91 is provided with an orientation so to be recessed toward the Y axis direction, that is, toward the opposite side to the sheet member 63 (FIG. 6) side. Then, when the sheet member 63 is joined to the casing 61A, the containing section 65 is configured by the recessed section 91 being closed off using the sheet member 63. Here, each of the first wall 81 to the eighth wall 88 are not limited to being flat walls and may include concavities and convexities.

As shown in FIG. 7, the sixth wall 86 protrudes from the fifth wall 85 toward the opposite side to the fourth wall 84 side of the fifth wall 85, that is, toward the +Z axis direction side of the fifth wall 85. The seventh wall 87 protrudes from the fifth wall 85 toward the opposite side to the fourth wall 84 side of the fifth wall 85, that is, toward the +Z axis direction side of the fifth wall 85. The seventh wall 87 is positioned more to the X axis direction side than the sixth wall 86. The sixth wall 86 and the seventh wall 87 are provided at positions which face each other so as to interpose the air chamber 68. The eighth wall 88 is positioned more to the Z axis direction side than the fifth wall 85. The fifth wall 85 and the eighth wall 88 are provided at positions which face each other so as to interpose the air chamber 68. The sixth wall 86 intersects with each of the fifth wall 85 and the eighth wall 88. The seventh wall 87 also intersects with each of the fifth wall 85 and the eighth wall 88.

The sixth wall 86, the seventh wall 87, and the eighth wall 88 protrude from the first wall 81 in the −Y axis direction. Due to this, a recessed section 99 is configured by the fifth wall 85, the sixth wall 86, the seventh wall 87 and the eighth wall 88, which extend in the −Y axis direction from the main wall, with the first wall 81 as the main wall. The recessed section 99 is configured with an orientation so to be recessed toward the Y axis direction. The recessed section 99 is open toward the −Y axis direction, that is, the sheet member 63 (FIG. 6) side. In other words, the recessed section 99 is provided with an orientation so to be recessed toward the Y axis direction, that is, toward the opposite side to the sheet member 63 (FIG. 6) side. Then, when the sheet member 63 is joined to the casing 61A, the air chamber 68 is configured by the recessed section 99 being closed off using the sheet member 63. Here, the protruding amounts of the second wall 82 to the eighth wall 88 from the first wall 81 are set to be a protruding amount which is the same as each other.

The second wall 82 and the sixth wall 86 form a step. The second wall 82 is positioned more to the third wall 83 side than the sixth wall 86, that is, more to the X axis direction side than the sixth wall 86. In addition, the third wall 83 and the seventh wall 87 form a step. The seventh wall 87 is positioned more to the second wall 82 side than the third wall 83, that is, more to the −X axis direction side than the third wall 83. Then, in a state of a planar view of the first wall 81 from the sheet member 63 side, the ink introduction section 101 is provided between the third wall 83 and the seventh wall 87. The ink introduction section 101 is provided in the fifth wall 85.

As shown in FIG. 8, an overhanging section 105 is provided in the casing 61A. The linking path 73 is provided in the overhanging section 105. The overhanging section 105 has a part 105A which overhangs from the fifth wall 85 toward the Z axis direction side along an edge of the opening of the recessed section 91 in a region, which is more to the X axis direction side than the seventh wall 87, in the fifth wall 85. The part 105A also overhangs in the seventh wall 87 from the seventh wall 87 toward the X axis direction side along an edge of the opening of the recessed section 99. In addition, the overhanging section 105 has a part 105B which overhangs from the eighth wall 88 toward the Z axis direction side. In addition, the overhanging section 105 has a part 105C which overhangs in the sixth wall 86 from the sixth wall 86 toward the −X axis direction side along an edge of the opening of the recessed section 99. In addition, the overhanging section 105 has a part 105D which overhangs in the second wall 82 from the second wall 82 toward the −X axis direction side along the edge of the opening of the recessed section 91. The linking path 73 is configured in the overhanging section 105 as a groove 108 which is provided with an orientation so to be recessed toward the opposite side to the sheet member 63 (FIG. 6) side.

Here, as shown in FIG. 8, a recessed section 109 is provided inside the recessed section 91. The recessed section 109 is surrounded by a ninth wall 111, a tenth wall 112, an eleventh wall 113, and the third wall 83. The recessed section 109 is provided with an orientation so to be recessed from the fourth wall 84 toward the opposite side to the fifth wall 85 side in the fourth wall 84, that is, from the fourth wall 84 toward the −Z axis direction side. The ninth wall 111 and the tenth wall 112 are each provided in the fourth wall 84 and protrude from the fourth wall 84 toward the opposite side to the fifth wall 85 side in the fourth wall 84, that is, from the fourth wall 84 toward the −Z axis direction side.

The ninth wall 111 is positioned between the third wall 83 and the second wall 82 and opposes the third wall 83 so as to interpose the eleventh wall 113. The tenth wall 112 is positioned between the first wall 81 and the sheet member 63 (FIG. 6) and opposes the sheet member 63 so as to interpose the eleventh wall 113. The eleventh wall 113 is positioned more to the opposite side to the fifth wall 85 side than the fourth wall 84, that is, more to the −Z axis direction side than the fourth wall 84. The eleventh wall 113 opposes the fifth wall 85. The ninth wall 111 intersects with the fourth wall 84, the tenth wall 112, and the eleventh wall 113. The tenth wall 112 intersects with the fourth wall 84, the third wall 83, and the eleventh wall 113. The eleventh wall 113 intersects with the third wall 83.

Figure 9:
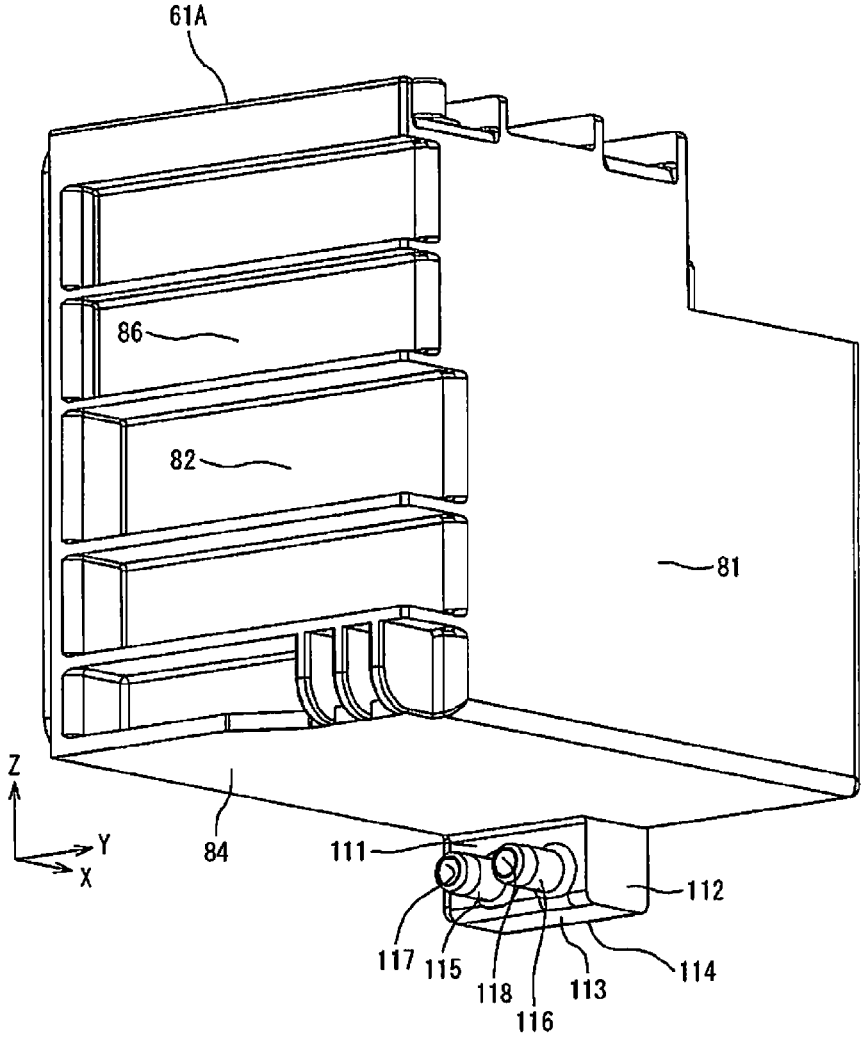
FIG. 9 is a perspective diagram illustrating a casing in applied example 1.

As shown in FIG. 8, the ninth wall 111, the tenth wall 112, the eleventh wall 113, and the third wall 83 which surround the recessed section 109 configure a supply section 114. As shown in FIG. 9, a connecting portion 115 and a connecting portion 116 are provided in the supply section 114. The connecting portion 115 and the connecting portion 116 are each provided in the ninth wall 111. The connecting portion 115 and the connecting portion 116 are each provided on the opposite side to the recessed section 109 side of the ninth wall 111. The connecting portion 115 and the connecting portion 116 each protrude from the ninth wall 111 toward the opposite side to the recessed section 109 side, that is, from the ninth wall 111 toward the second wall 82 side. The connecting portion 115 and the connecting portion 116 are each formed in a cylindrical shape. A supply opening 117 is formed in the connecting portion 115. A feeding opening 118 is formed in the connecting portion 116. The supply opening 117 is an opening which is formed in the connecting portion 115 and is an output opening for ink from the tank 9A. The feeding opening 118 is an opening which is formed in the connecting portion 116 and is an output opening for ink from the tank 9A.

The supply tube 43 (FIG. 4) is connected to the connecting portion 115. The ink which is contained in the tank 9A is fed from the connecting portion 115 to the supply tube 43 via the supply opening 117. The ink which is fed in the supply tube 43 is guided to the printing head 47 by the supply tube 43. The tube 58 (FIG. 5) is connected to the connecting portion 116. The ink which is contained in the tank 9A is fed from the connecting portion 116 to the tube 58 via the feeding opening 118. The ink which is fed in the tube 58 is guided to the indicator 33 by the tube 58.

In addition, an air linking section 121 is provided in the eighth wall 88 as shown in FIG. 8. An air communication port 122 is provided in the air linking section 121. The air communication port 122 is an opening which is formed in the air linking section 121 and is open from the air linking section 121 toward the outer side of the tank 9A. The air linking section 121 protrudes from the eighth wall 88 to the opposite side to the fifth wall 85 side of the eighth wall 88, that is, to the Z axis direction side of the eighth wall 88. The air communication port 122 is provided at a position which overlaps with the recessed section 99 in a planar view of the eighth wall 88, that is, in a planar view of the eighth wall 88 on the XY plane. The air communication port 122 links the outer side of the casing 61A and the inner side of the recessed section 99. The air communication port 122 is a path for air where it is possible for air to be led from the outer side of the casing 61A to the inner side of the recessed section 99. Here, the joining section 64 is provided in the casing 61A along the contours of each of the recessed section 91, the recessed section 99, the recessed section 109, and the linking path 73.

As shown in FIG. 6, the sheet member 63 opposes the first wall 81 so as to interpose the second wall 82 to the eighth wall 88. In planar view, the sheet member 63 has a size so as to cover the recessed section 91, the recessed section 99, the recessed section 109, and the overhanging section 105 (FIG. 8). The sheet member 63 is fused to the joining section 64. Due to this, the recessed section 91, the recessed section 99, the recessed section 109, and the linking path 73 are sealed using the sheet member 63. For this reason, it is possible for the sheet member 63 to be seen as a lid with regard to the casing 61A.

As shown in FIG. 7, the linking path 73 has a linking opening 123 and a linking opening 124. The linking opening 123 is an opening section which is open toward the inner side of the air chamber 68. The linking opening 124 is an opening section which is open toward the inner side of the containing section 65. The air chamber 68 runs through from the linking opening 123 to the containing section 65 through the linking opening 124 via the linking path 73. As described above, the containing section 65 runs through to the outside of the tank 9A via the linking path 73, the air chamber 68, and the air communication port 122. That is, the linking section 67 links between the air communication port 122 and the containing section 65. Air, which flows from the air communication port 122 into the inside of the air chamber 68, flows into the containing section 65 via the linking path 73.

The ink introduction section 101 is provided in the fifth wall 85. As shown in FIG. 8, the ink introduction section 101 is provided inside a recessed section 131 which is surrounded by the seventh wall 87, the overhanging section 105, the third wall 83, and the first wall 81. As described above, the overhanging section 105 protrudes more to the eighth wall 88 side than the fifth wall 85. In addition, the seventh wall 87 also protrudes more to the eighth wall 88 side than the fifth wall 85. In the same manner, each of the first wall 81 and the third wall 83 also protrude more to the eighth wall 88 side than the fifth wall 85 in the present embodiment. Then, the overhanging section 105 intersects with both the seventh wall 87 and the third wall 83. In addition, the first wall 81 intersects with both the third wall 83 and the seventh wall 87. For this reason, a region, which is more to the third wall 83 side than the seventh wall 87, in the fifth wall 85 configures the recessed section 131 which is surrounded by the seventh wall 87, the overhanging section 105, the third wall 83, and the first wall 81. The recessed section 131 is provided with an orientation so to be recessed from the fifth wall 85 side toward the fourth wall 84 side.

In the configuration described above, the ink introduction section 101 is surrounded by the seventh wall 87, the overhanging section 105, the third wall 83, and the first wall 81. In other words, the ink introduction section 101 is provided in a region, which is surrounded by the seventh wall 87, the overhanging section 105, the third wall 83, and the first wall 81, in the fifth wall 85. Then, the recessed section 131 has a function of an ink receiving section. It is possible for the ink receiving section to receive, for example, ink which overflows from the ink introduction section 101 and ink which drips down during introducing. In this manner, the recessed section 131 has a function of an ink receiving section which receives ink.

Figure 10:
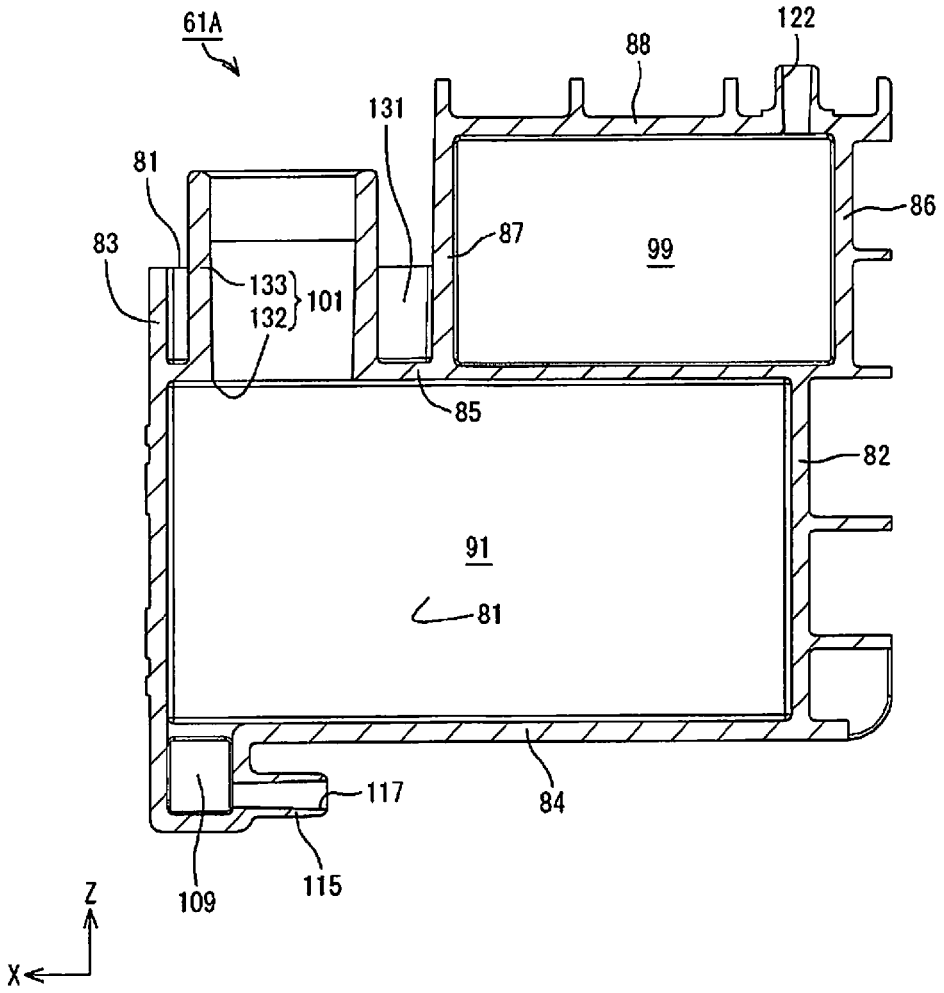
FIG. 10 is cross sectional diagram where an ink introduction section and an air communication port of a tank in applied example 1 are cut away at the XZ plane.

As shown in FIG. 10 which is a cross sectional diagram where the ink introduction section 101 and the air communication port 122 are cut away at the XZ plane, the ink injection port 101 has an opening 132 and a side wall 133. The opening 132 is a through hole which is provided in the fifth wall 85. The opening 132 is also an intersecting section which intersects with the ink introduction section 101 and the containing section 65. The opening 132 intersects with the containing section 65 in the fifth wall 85. It is possible for a configuration, where the side wall 133 protrudes to the inner side of the containing section 65, to also be adopted as the configuration of the ink introduction section 101. Even with the configuration where the side wall 133 protrudes to the inner side of the containing section 65, the intersecting section, where the ink introduction section 101 and the containing section 65 intersect, is defined as the opening 132. The recessed section 91 runs through on the outer side of the recessed section 91 via the opening 132 which is a through hole. The side wall 133 is provided in the fifth wall 85 on the opposite side to the fourth wall 84 side, surrounds the periphery of the opening 132, and forms an ink introduction path. The side wall 133 protrudes from the fifth wall 85 toward the opposite side to the fourth wall 84 side. Here, the side wall 133 protrudes more to the opposite side to the fourth wall 84 than each of the first wall 81 and the third wall 83 in the present embodiment. It is possible to for ink which is retained in the recessed section 131 from flowing into the opening 132 to be prevented using the side wall 133.

Figure 11:
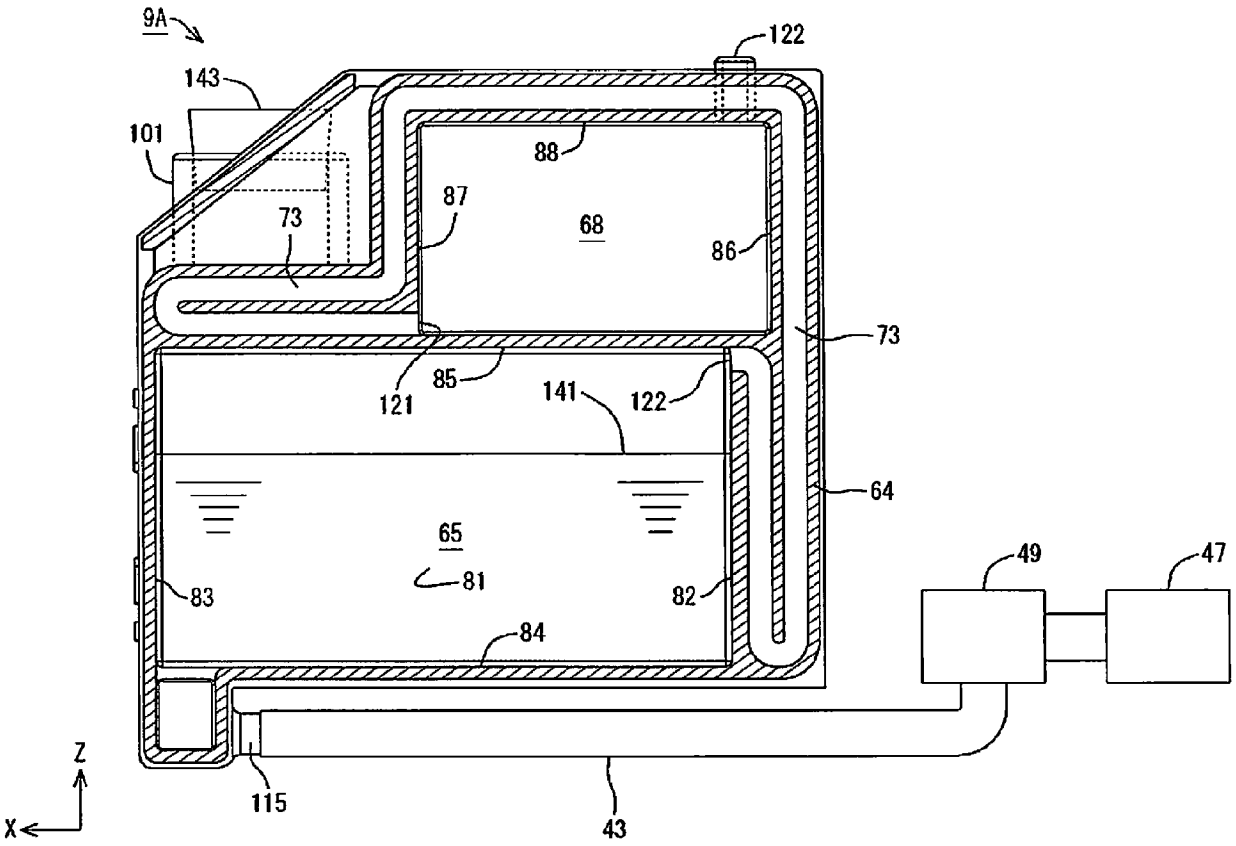
FIG. 11 is a side surface diagram of a tank in applied example 1 viewed from a sheet member side.

As shown in FIG. 11 which is side surface diagram of the tank 9A viewed from the side surface diagram 63 side, ink 141 is contained in the tank 9A in an inner section of the containing section 65. In FIG. 11, illustration of the sheet member 63 is omitted and the joining section 64 is hatched in order for the configuration to be easy to understand. The ink 141 in the containing section 65 is supplied from the supply opening 117 (FIG. 9), which is formed in the connecting portion 115, to the printing head 47. In the present embodiment, the supply tube 43 is connected to the supply opening 117 and a cap 143 caps the ink introduction section 101 in a state where the liquid ejecting system 1 is being used in printing. The ink 141 inside the containing section 65 reaches the printing head 47 from the supply opening 117 due to suction inside the supply tube 43 via the relay unit 49.

The ink 141 inside the containing section 65 is sent to the printing head 47 side along with printing using the printing head 47. For this reason, the pressure inside the containing section 65 becomes lower than air pressure along with printing using the printing head 47. When the pressure inside the containing section 65 becomes lower than air pressure, air in the air chamber 68 passes through the linking path 73 and flows into the inside of the containing section 65. Due to this, it is easy to maintain the pressure in the containing section 65 at air pressure. As described above, the ink 141 inside the tank 9 is supplied to the printing head 47. The ink 141 inside the containing section 65 in the tank 9 is consumed and it is possible for an operator to fill new ink from the ink introduction section 101 into the inside of the containing section 65 when the remaining amount of ink 141 is low.

Figure 12:
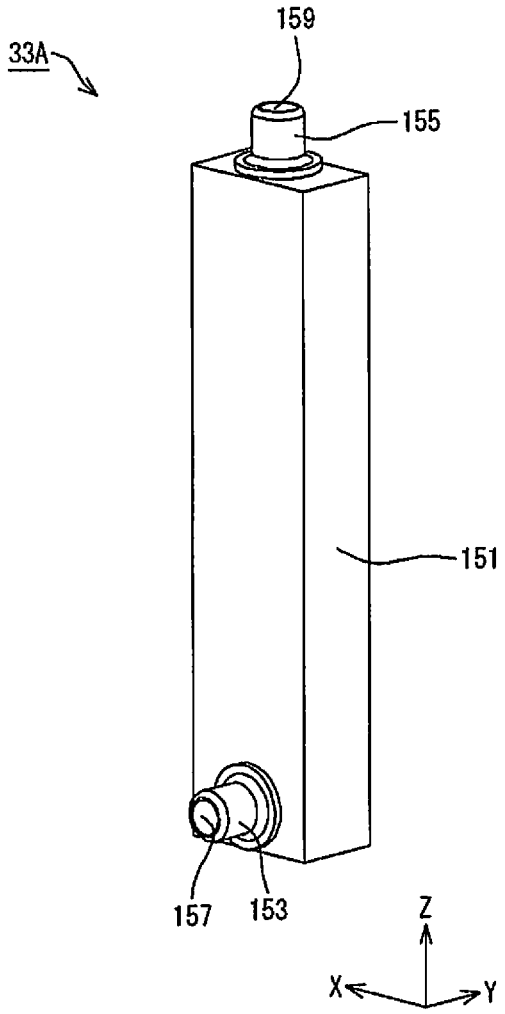
FIG. 12 is a perspective diagram illustrating an indicator in applied example 1.

As shown in FIG. 12, the indicator 33A has a container section 151, a connecting portion 153, and an air hole portion 155. The container section 151 is formed to be hollow and is optically transmissive. The connecting portion 153 and the air hole portion 155 are each provided in the container section 151. The connecting portion 153 and the air hole portion 155 are each formed in a cylindrical shape. A receiving opening 157 is formed in the connecting portion 153. An air exposing opening 159 is formed in the air hole portion 155. The receiving opening 157 is an opening which is formed in the connecting portion 153 and is an opening where it is possible to receive ink from the tank 9A in the inside of the container section 151. The air exposing opening 159 is an opening which is formed in the air hole portion 155 and is an opening from the air hole portion 155 toward the outer side of the container section 151. The air exposing opening 159 runs through to the inside of the container section 151. The air hole portion 155 is provided on the Z axis direction side of the container section 151. The connecting portion 153 is provided in the container section 151 more to the −Z axis direction side than the air hole portion 155. An end section of the tube 58 (FIG. 5), which is on the opposite side to an end section on the tank 9A side, is connected to the connecting portion 153. In this embodiment, the tube 58, the container section 151, and the air hole portion 155 mainly configure a fluid communication member, an end of the fluid communication member is exposed to air via the air exposing opening 159, and the container section 151, which is a liquid visual recognition portion where it is possible to visually recognize the liquid in the fluid communication member, is provided in the fluid communication member as a portion of the indicator 33A.

Figure 13:
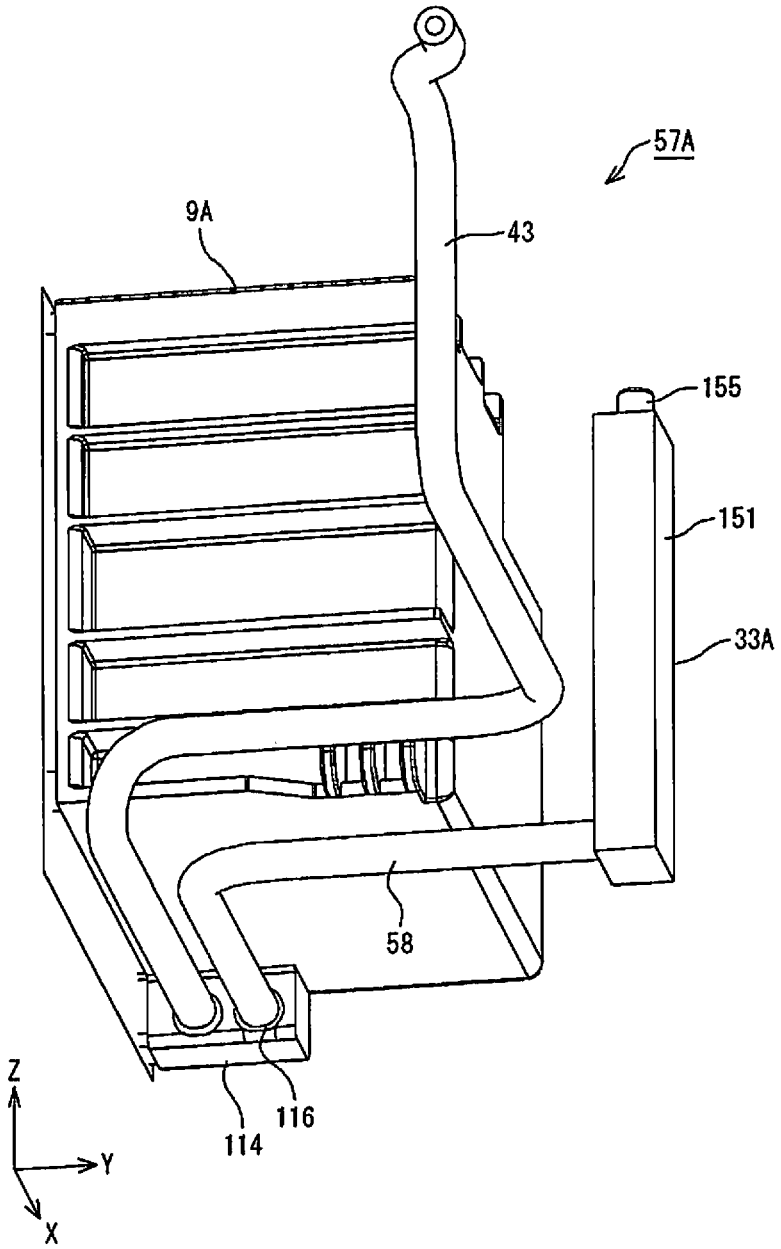
FIG. 13 is a perspective diagram illustrating a connection between a tank and an indicator in applied example 1.

Due to this, the tank 9A and the indicator 33A are connected using the tube 58 as shown in FIG. 13. The ink inside the tank 9A which configures the liquid containing portion is sent to the indicator 33A via the tube 58. The ink which is sent from the tank 9A to the indicator 33A is retained in the container section 151. Since the container section 151 is optically transmissive, it is possible to visually recognize the ink which is sent from the tank 9A to the indicator 33A via the container section 151. The inside of the container section 151 is exposed to air via the air exposing opening 159. For this reason, the liquid level of the ink, which is sent from the tank 9A to the indicator 33A via the tube 58, in the container section 151 is the same as the liquid level of the ink inside the tank 9A. Due to this, the liquid level of the ink inside the tank 9A is reflected in the container section 151. For this reason, it is possible for an operator to ascertain the remaining amount of ink inside the tank 9A by the liquid level of the ink in the indicator 33A being visually recognizable.

Due to the tank set 57A, it is easy to set the position of the indicator 33A with regard to the tank 9A to an arbitrary position. It is possible to set the length and the path of the tube 58 according to the position of the indicator 33A with regard to the tank 9A. For this reason, it is easy to arrange the indicator 33A without restricting the position or the orientation of the tank 9A in the liquid ejecting system 1. In the liquid ejecting system 1, the window portion 21 where it is possible to visually recognize the amount of ink in the tank 9A is provided in the side section 27 which intersects with the front surface 13 of the printer 3. For this reason, it is necessary for an operator to shift their line of sight from the front surface 13 side to the side section 27 side of the printer 3 in a case of visually recognizing the remaining amount of ink in the tank 9A from the third wall 83 of the tank 9A. In addition, it is difficult to ascertain the remaining amount of ink in a case where there is an object which obstructs the line of sight on the side section 27. In this case, it is necessary to move the liquid ejecting system 1.

In contrast to this, the window portion 31, where it is possible to visually recognize the indicator 33A which indicates the remaining amount of ink in the tank 9A, is provided on the front surface 13 side of the printer 3 in the present embodiment. Then, the indicator 33A is provided at a position which overlaps with the window portion 31. For this reason, it is possible for an operator to visually recognize the indicator 33A from the front surface 13 side of the printer 3. As such, it is possible for an operator to ascertain the remaining amount of ink from the front surface 13 side of the printer 3 in a case of ascertaining the remaining amount of ink in the tank 9A. That is, it is possible to reduce complexity when confirming the remaining amount of ink in the tank 9A using the liquid ejecting system 1 of the present embodiment.

Applied Example 2

Figure 14:
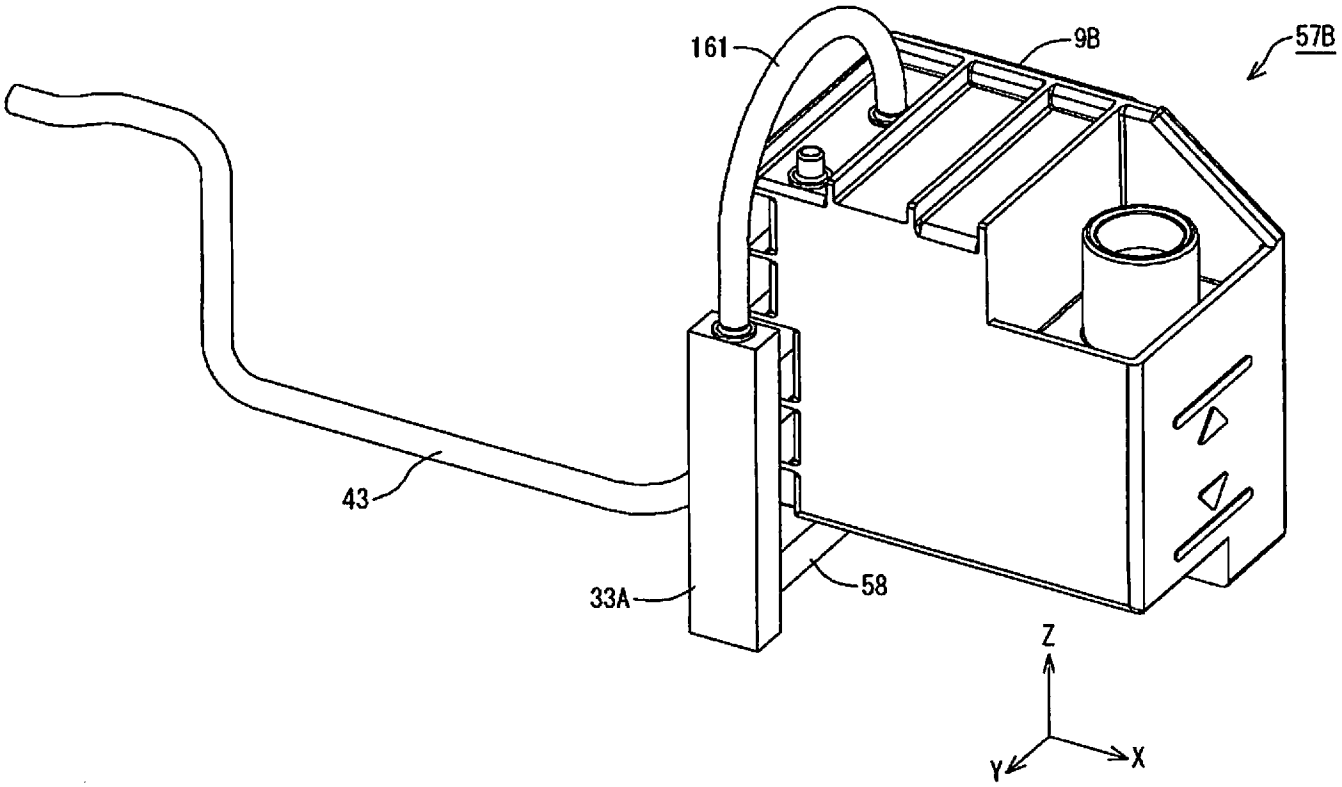
FIG. 14 is a perspective diagram illustrating a tank set in applied example 2.

A tank set 57B is described in applied example 2. As shown in FIG. 14, the tank set 57B has a tank 9B, the indicator 33A, the tube 58, a tube 161, and the supply tube 43. The tank 9B and the indicator 33A are connected to each other in the tank set 57B via the tube 58 and the tube 161. The tank set 57B has a configuration which is the same as the tank set 57A in applied example 1 except for the configuration of the tank 9B being different and the tube 161 being added. For this reason, the same reference numerals as in applied example 1 are given and detailed description is omitted below for configurations which are the same as in applied example 1. Here, the tank set 57B is an example of a liquid supplying apparatus.

Figure 15:
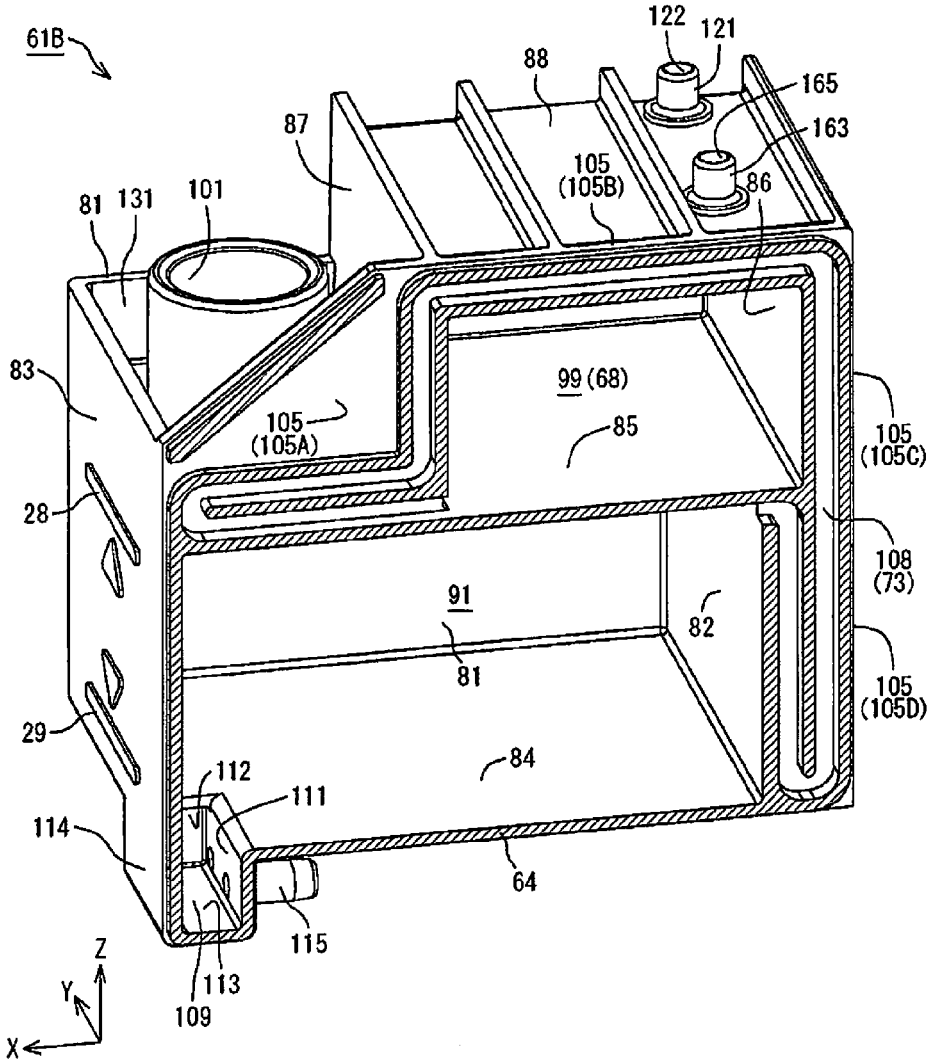
FIG. 15 is a perspective diagram illustrating a casing in applied example 2.

The tank 9B has the same configuration as the tank 9A except for the configuration being different to the casing 61A of the tank 9A in applied example 1. In the same manner as the tank 9A, the tank 9B has the sheet member 63 (FIG. 6). In addition, the tank 9B has a casing 61B shown in FIG. 15. The casing 61B is configured by, for example, a synthetic resin such as nylon or polypropylene. The tank 9B has a configuration where the casing 61B and the sheet member 63 are joined. The joining section 64 is provided in the casing 61B. In FIG. 15, the joining section 64 is hatched in order for the configuration to be easy to understand. The sheet member 63 is joined to the joining section 64 of the casing 61B. In the present embodiment, the casing 61B and the sheet member 63 are joined by fusing.

A connecting portion 163 is provided in the casing 61B. The casing 61B has the same configuration as the casing 61A in applied example 1 except for the connecting portion 163 being provided. The connecting portion 163 is provided in the eighth wall 88. The connecting portion 163 protrudes from the eighth wall 88 to the opposite side to the fifth wall 85 side of the eighth wall 88, that is, to the Z axis direction side of the eighth wall 88. The connecting portion 163 is formed in a cylindrical shape. A linking opening 165 is formed in the connecting portion 163.

Figure 16:
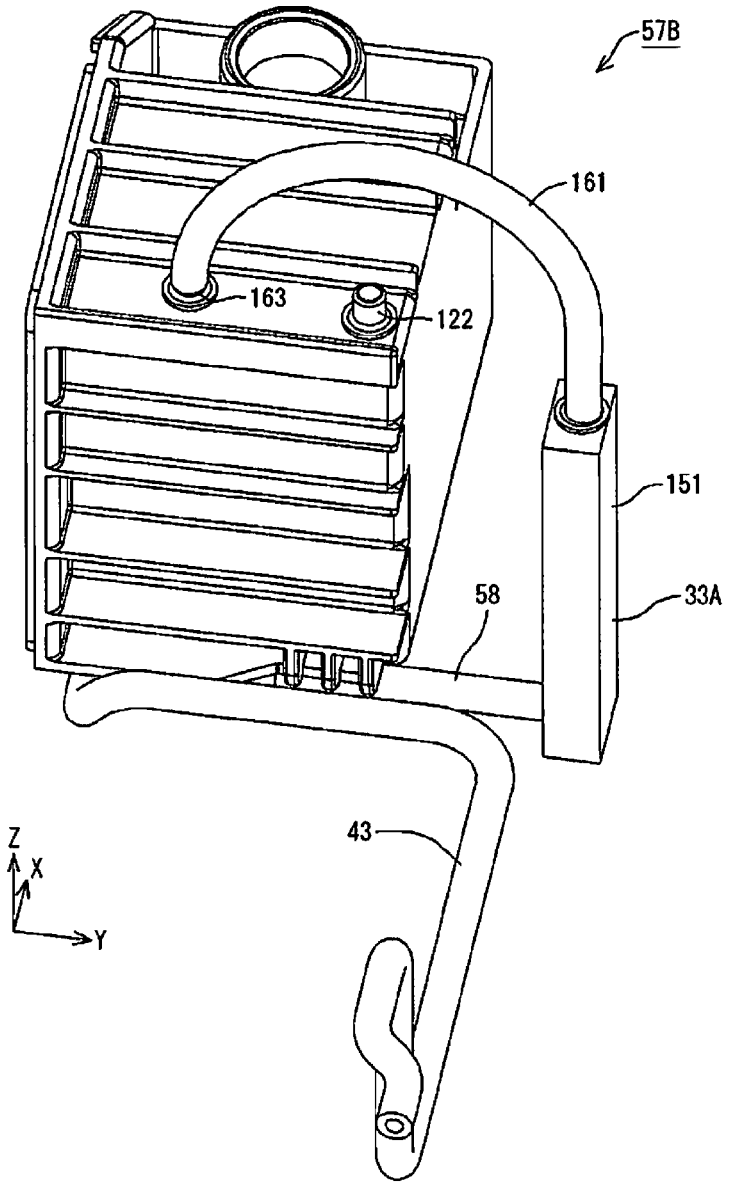
FIG. 16 is a perspective diagram illustrating a connection between a tank and an indicator in applied example 2.
Figure 17:
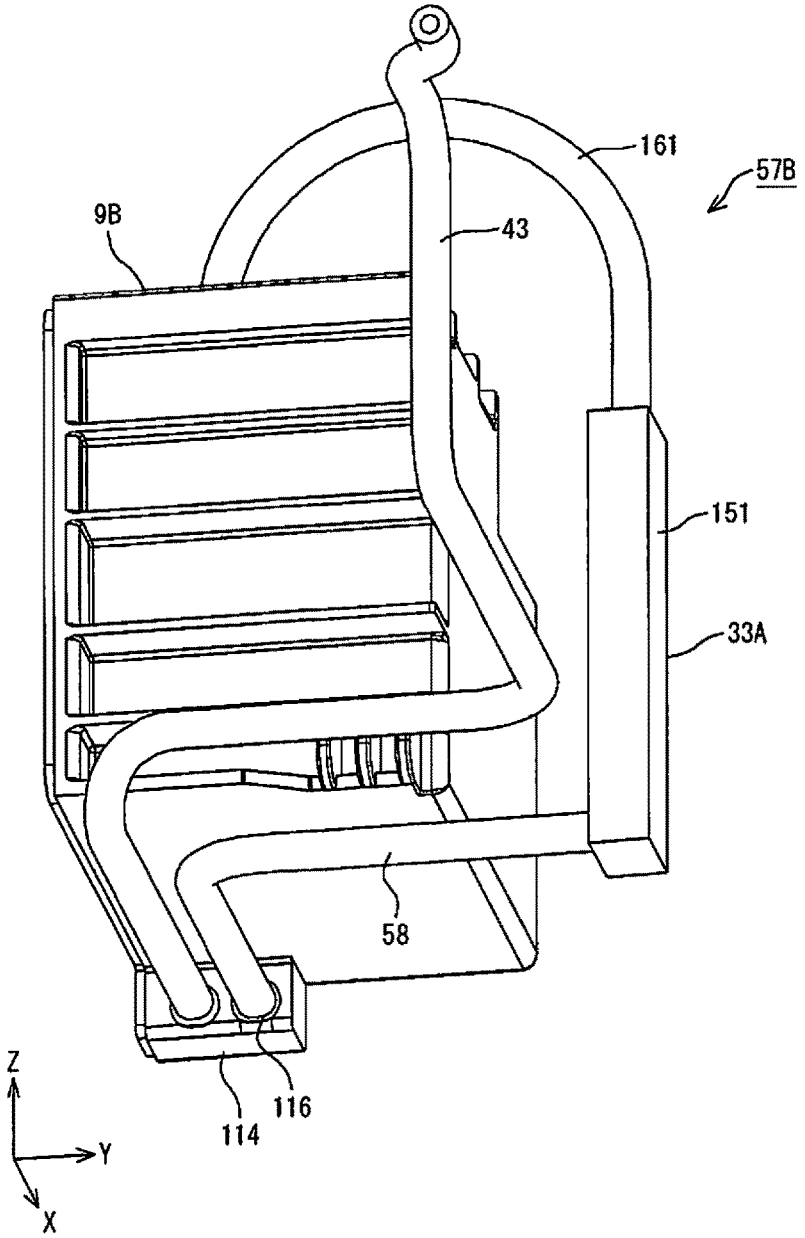
FIG. 17 is a perspective diagram illustrating a connection between a tank and an indicator in applied example 2.

The linking opening 165 is an opening which is formed in the connecting portion 163 and runs through to the recessed section 99 (the air chamber 68) of the tank 9B. The linking opening 165 is an opening from the connecting portion 163 toward the outer side of the tank 9B. As shown in FIG. 16, an end of the tube 161 is connected to the connecting portion 163. The other end, which is on the opposite side to the tank 9B side, of the tube 161 is connected to the air hole portion 155 (FIG. 12) of the indicator 33A. Due to this, the tank 9B and the indicator 33A are connected to each other via the tube 58 and the tube 161 in the tank set 57B as shown in FIG. 17.

In the tank set 57B in applied example 2, the inside of the container section 151 of the indicator 33A is exposed to air via the tube 161 and the air chamber 68 and the air communication port 122 of the tank 9B. That is, the fluid communication member is configured mainly by a flow path which includes the tube 58, the indicator 33A, the tube 161, the air chamber 68, and the air communication port 122, and one end is exposed to air. For this reason, the liquid level of the ink inside the container section 151, which is sent from the tank 9B to the indicator 33A via the tube 58, is the same as the liquid level of the ink inside the tank 9B. Due to this, the liquid level of the ink inside the tank 9B is reflected in the container section 151. For this reason, it is possible for an operator to ascertain the remaining amount of ink inside the tank 9B by the liquid level of the ink inside the indicator 33A being visually recognizable.

In addition, the inside of the container section 151 of the indicator 33A is exposed to air via the tube 161 and the air chamber 68 and the air communication port 122 of the tank 9B in the tank set 57B in applied example 2. For this reason, it is possible to lengthen the path from the inside of the container section 151 to being exposed to air compared to applied example 1. Due to this, it is possible for it to be difficult for liquid components in the ink inside the container section 151 to evaporate.

Figure 18:
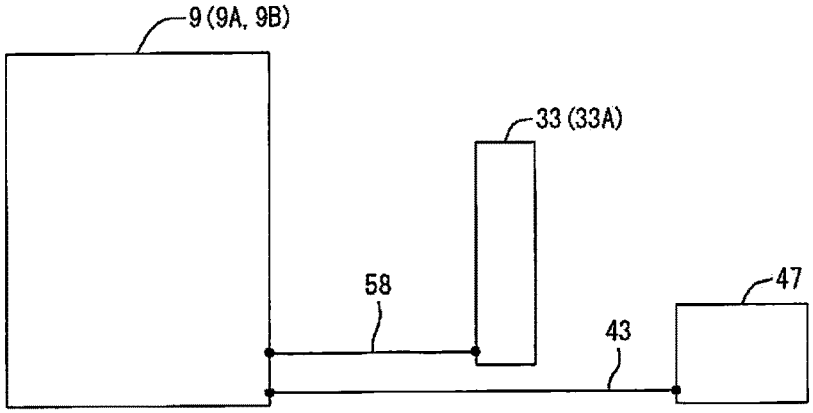
FIG. 18 is a diagram schematically illustrating a connection between a tank, an indicator, and a printing head in applied example 1 and applied example 2.

Here, as shown in FIG. 18, each of the indicator 33A and the printing head 47 are connected in parallel from the tank 9A and the tank 9B in applied example 1 and applied example 2 respectively. For this reason, it is easy to separate the tube 58 from the path of the supply tube 43. For this reason, it is easy to arrange the indicator 33A without the path of the supply tube 43 being restricted in applied example 1 and applied example 2.

Figure 19:
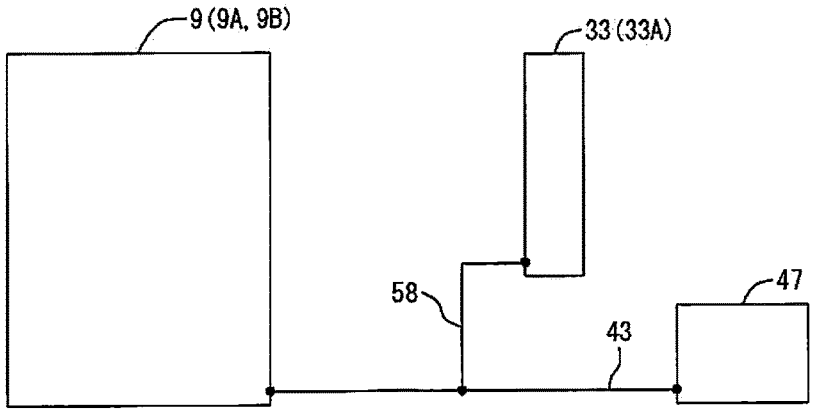
FIG. 19 is a diagram schematically illustrating another example of a connection between a tank, a supply tube, and a tube in applied example 1 and applied example 2.

In addition, the supply tube 43 and the tube 58 are connected to each of the tank 9A and the tank 9B in applied example 1 and applied example 2 respectively as well as in the example shown in FIG. 18. That is, the supply tube 43 and the tube 58 are provided independently from each other in the tank 9A and the tank 9B in applied example 1 and applied example 2 respectively as well as in the example shown in FIG. 18. However, connecting of the tank 9A and the tank 9B with the supply tube 43 and the tube 58 is not limited to this configuration. For connecting of the tank 9A and the tank 9B with the supply tube 43 and the tube 58, it is possible to adopt a configuration where, for example, the tube 58 is connected to the supply tube 43 between the tank 9A or the tank 9B and the printing head 47 as shown in FIG. 19. In this configuration, the indicator 33A is provided in the supply tube 43 between the tank 9A or the tank 9B and the printing head 47. Due to this configuration, it is easy to provide the indicator 33A in the path of the supply tube 43.

Figure 20:
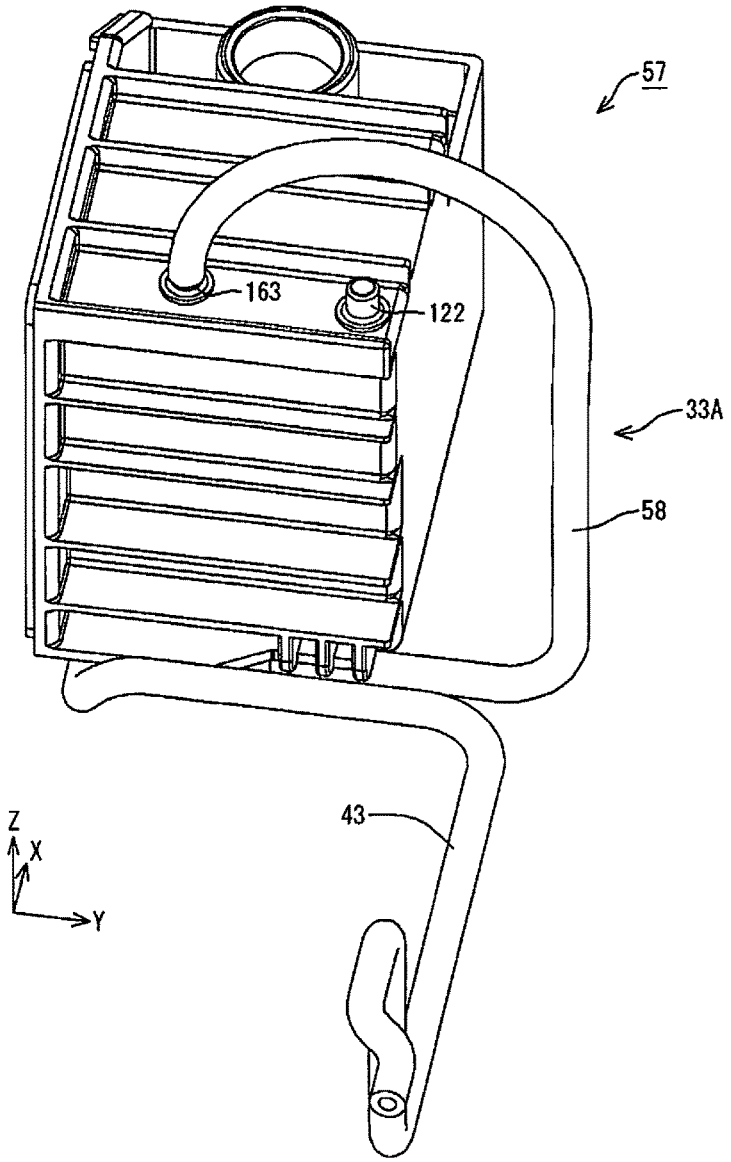
FIG. 20 is a perspective diagram illustrating another example of an indicator in applied example 1 and applied example 2.

Here, a configuration is adopted in applied example 1 and applied example 2 where the indicator 33A is provided with the container section 151. However, the configuration of the indicator 33A is not limited to this. As shown in FIG. 20, it is also possible to adopt an example as the indicator 33A where, for example, the indicator 33A is configured in the tube 58. In this example, the tube 58 is optically transmissive. Due to this, it is possible to ascertain the remaining amount of ink inside the tank 9A and the tank 9B by the liquid level of the ink inside the tube 58 being visually recognizable. Here, FIG. 20 shows an example where the tube 58 is connected to the connecting portion 163, but the connecting portion 163 is omitted in applied example 1. It is possible to obtain the same effects in the example where the indicator 33A is configured in the tube 58 as in applied example 1 and applied example 2.

Applied Example 3

Figure 21:
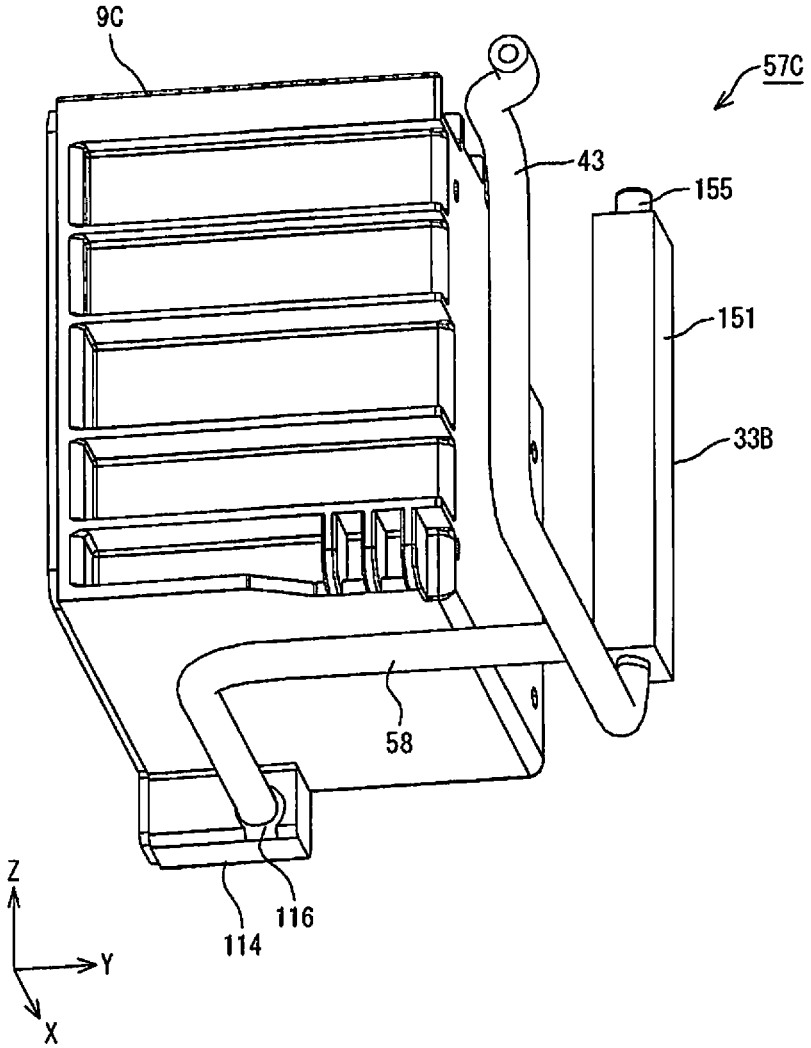
FIG. 21 is a perspective diagram illustrating a tank set in applied example 3.

A tank set 57C is described in applied example 3. As shown in FIG. 21, the tank set 57C has a tank 9C, an indicator 33B, the tube 58, and the supply tube 43. In the tank set 57C, the supply tube 43 is connected to the indicator 33B. The supply tube 43 runs through to the tank 9C via the indicator 33B. That is, the indicator 33B is arranged between the tank 9C and the supply tube 43 in the tank set 57C. The tank set 57C has the same configuration as the tank set 57A in applied example 1 except for the configuration of the tank 9C and the indicator 33B being different. For this reason, the same reference numerals as in applied example 1 are given and detailed description is omitted below for configurations which are the same as in applied example 1. Here, the tank set 57C is an example of a liquid supplying apparatus. Then, the tube 58 and the indicator 33B configure the fluid communication member, and one end of the fluid communication member is exposed to air via the air hole portion 155 of the indicator 33B.

The tank 9C has the same configuration as the tank 9A except for the configuration being different to the casing 61A of the tank 9A in applied example 1. In the same manner to the tank 9A, the tank 9C has the sheet member 63 (FIG. 6). In addition, the tank 9C has a casing 61C shown in FIG. 22. The casing 61C is configured by, for example, a synthetic resin such as nylon or polypropylene. The tank 9C has a configuration where the casing 61C and the sheet member 63 are joined.

Figure 22:
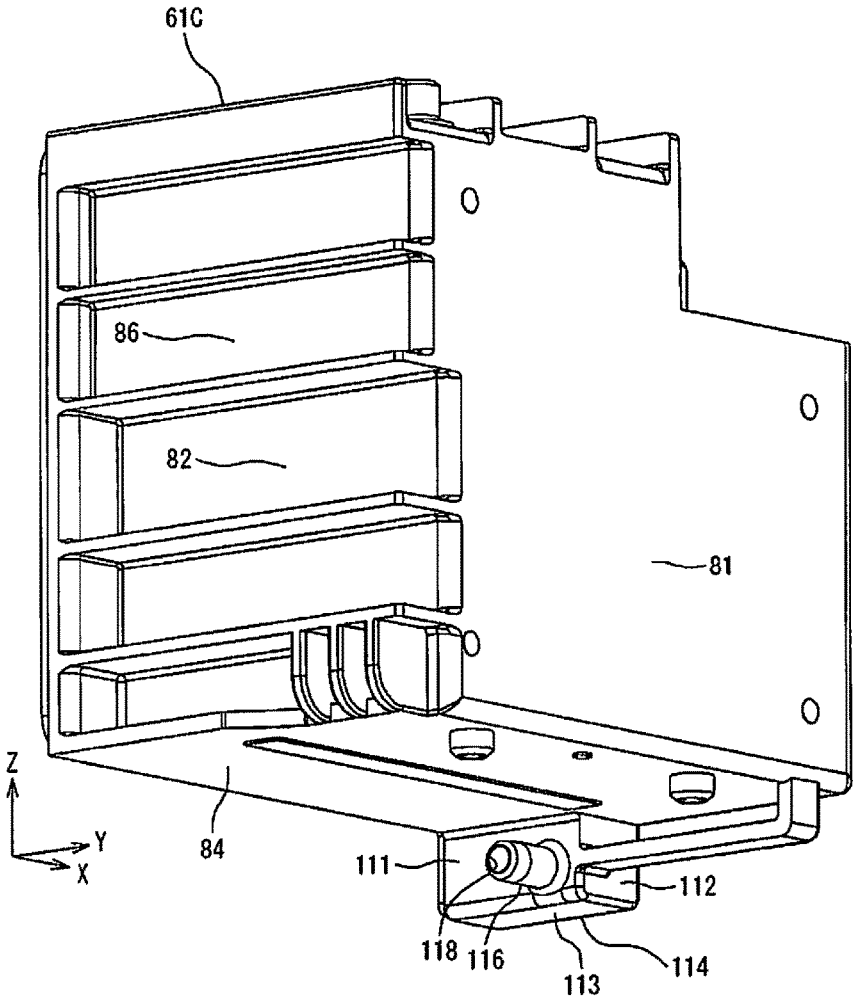
FIG. 22 is a perspective diagram illustrating a casing in applied example 3.

The casing 61C has the same configuration as the casing 61A in applied example 1 except for the connecting portion 115 of the casing 61A shown in FIG. 9 being omitted. As shown in FIG. 22, the connecting portion 116 is provided in the casing 61C. Then, the tube 58 is connected to the connecting portion 116 as shown in FIG. 21.

Figure 23:
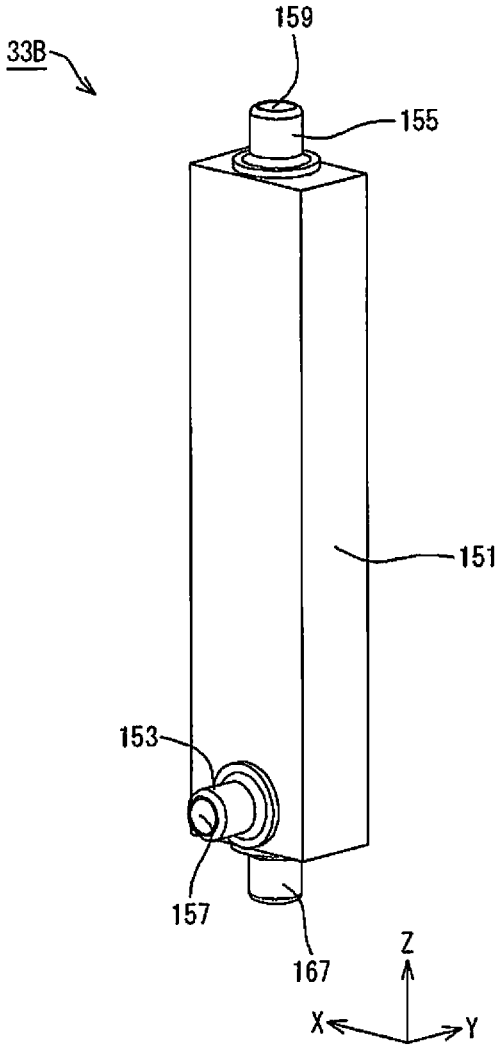
FIG. 23 is a perspective diagram illustrating an indicator in applied example 3.

As shown in FIG. 23, the indicator 33B has the container section 151, the connecting portion 153, the air hole portion 155, and a connecting portion 167. The indicator 33B has the same configuration as the indicator 33A except for the connecting portion 167 being added to the indicator 33A in applied example 1. The connecting portion 167 is provided in the container section 151 more to the −Z axis direction side than the air hole portion 155. The connecting portion 167 is formed in a cylindrical shape. An opening (which is not shown in the drawings) is formed in the connecting portion 167. The opening which is formed in the connecting portion 167 runs through to the inside of the container section 151. The supply tube 43 (FIG. 21) is connected to the connecting portion 167.

As shown in FIG. 21, the tank 9C and the indicator 33B are connected by the tube 58. The ink inside the tank 9C is sent to the indicator 33B via the tube 58. Then, the ink which is sent from the tank 9C to the indicator 33B is supplied to the printing head 47 via the supply tube 43. The ink which is sent from the tank 9C to the indicator 33B is retained in the container section 151. Since the container section 151 is optically transmissive, it is possible for the ink which is sent from the tank 9C to the indicator 33B to be visually recognizable via the container section 151. The inside of the container section 151 is exposed to air via the air exposing opening 159. For this reason, the liquid level of the ink inside the container section 151, which is sent from the tank 9C to the indicator 33B via the tube 58, is the same as the liquid level of the ink inside the tank 9C. Due to this, the liquid level of the ink inside the tank 9C is reflected in the container section 151. For this reason, it is possible for an operator to ascertain the remaining amount of ink in the tank 9C by the liquid level of the ink inside the indicator 33B being visually recognizable.

Here, even in applied example 3, it is possible to adopt a configuration where the container section 151 of the indicator 33B is exposed to air via the tank 9C in the same manner to applied example 2. In this configuration, the connecting portion 163 in applied example 2 is added and the air hole portion 155 of the indicator 33B is connected to the connecting portion 163. Due to this configuration, the same effects as applied example 2 are obtained.

In addition, a configuration is adopted where the indicator 33B is provided with the container section 151 in applied example 3. However, the configuration of the indicator 33B is not limited to this. In the same manner to applied example 1 and applied example 2, it is possible to also adopt an example as the indicator 33B where, for example, the indicator 33B is configured with the tube 58. In this example, the tube 58 is optically transmissive. Due to this, it is possible to ascertain the remaining amount of ink inside the tank 9C by the liquid level of the ink inside the tube 58 being visually recognizable.

Here, the indicator 33B and the printing head 47 are connected in series from the tank 9C in applied example 3. Due to this, it is possible to supply the ink from the tank 9C to the printing head 47 via the indicator 33B. That is, the ink which is supplied from the tank 9C to the printing head 47 passes through the indicator 33B. For this reason, it is easy to avoid ink languishing in the indicator 33B.

Figure 24:
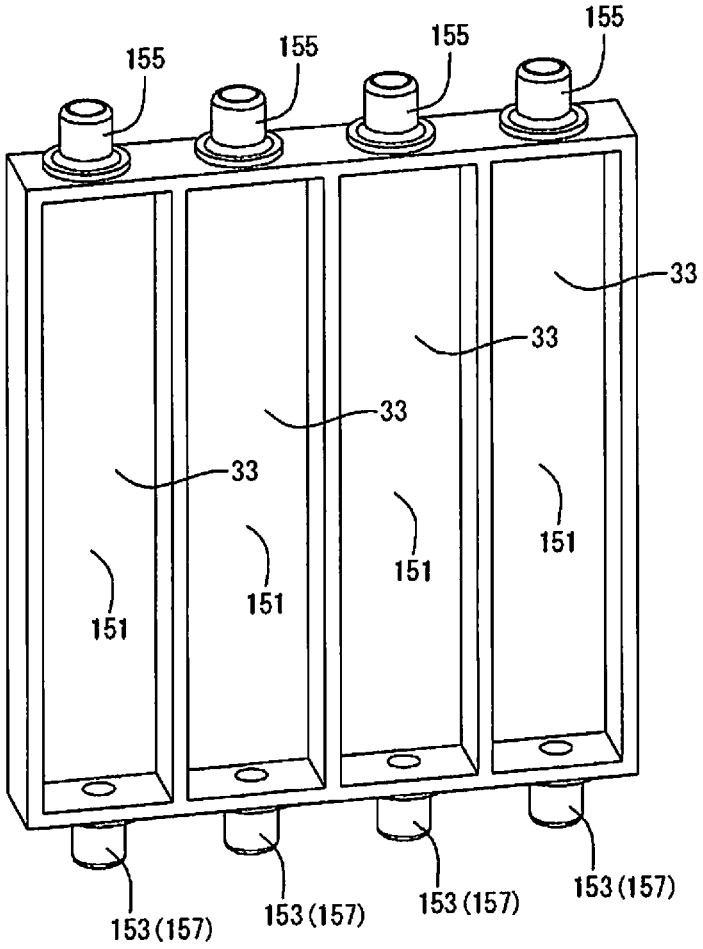
FIG. 24 is a perspective diagram illustrating another example of an indicator in an applied example.

In the embodiment described above, a plurality of the indicators 33 are configured independently from each other. However, the configuration of the plurality of indicators 33 is not limited to this. As the configuration of the plurality of indicators 33, it is also possible to adopt, for example, an integral configuration for the plurality of indicators 33 as shown in FIG. 24. In the example shown in FIG. 24, at least the plurality of indicators 33 are configured such that the container sections 151 are integral with each other. In addition, the plurality of container sections 151 are integrally configured by being integrally formed in this example. In this example, there are partitions between two of the adjacent container sections 151. Due to this, it is possible to avoid mixing of the ink between the container sections 151. Due to this configuration, it is possible to aggregate the plurality of indicators 33. Due to this, it is possible to, for example, reduce time and labor which is taken to assemble the liquid ejecting system 1 since it is possible arrange the plurality of indicators 33 collectively.

Here, the method for integrally configuring the plurality of indicators 33 is not limited to the integral forming described above. As a method for integrally configuring the plurality of indicators 33, it is possible to adopt a method for integrally configuring the plurality of container sections 151 by, for example, bundling the container sections 151 in at least the plurality of indicators 33. It is possible to realize the integral bundling of the plurality of container sections 151 by, for example, utilizing a binding member.

In the embodiment described above, the printing head 47 corresponds to the liquid ejecting section, the tank set 57 corresponds to the liquid supplying apparatus, the tank 9 (the tank 9A, the tank 9B, and the tank 9C) corresponds to the liquid containing portion, the container section 151 corresponds to the container which is the liquid visual recognition portion, and the supply tube 43 corresponds to the supply passage.

In each of the applied examples described above, a method where new ink is filled in from the ink introduction section 101 of the tank 9 is adopted as a method where ink is filled into the tank set 57. However, the method where ink is filled into the tank set 57 is not limited to this. As the method where ink is filled into the tank set 57, it is possible to also adopt a method where ink is filled into the tank set 57 by, for example, introducing ink into the indicator 33. An applied example where ink is filled into the tank set 57 by introducing ink into the indicator 33 will be described below.

Applied Example 4

The tank set 57A in applied example 4 has a configuration which is the same as the tank set 57A (FIG. 5) in applied example 1. In applied example 4, the method where ink is introduced with regard to the tank set 57A is different to applied example 1. Except for this point, applied example 4 is the same as applied example 1. For this reason, the same reference numerals as in applied example 1 are given and detailed description is omitted for configurations in applied example 4 which are the same as in applied example 1.

Figure 25:
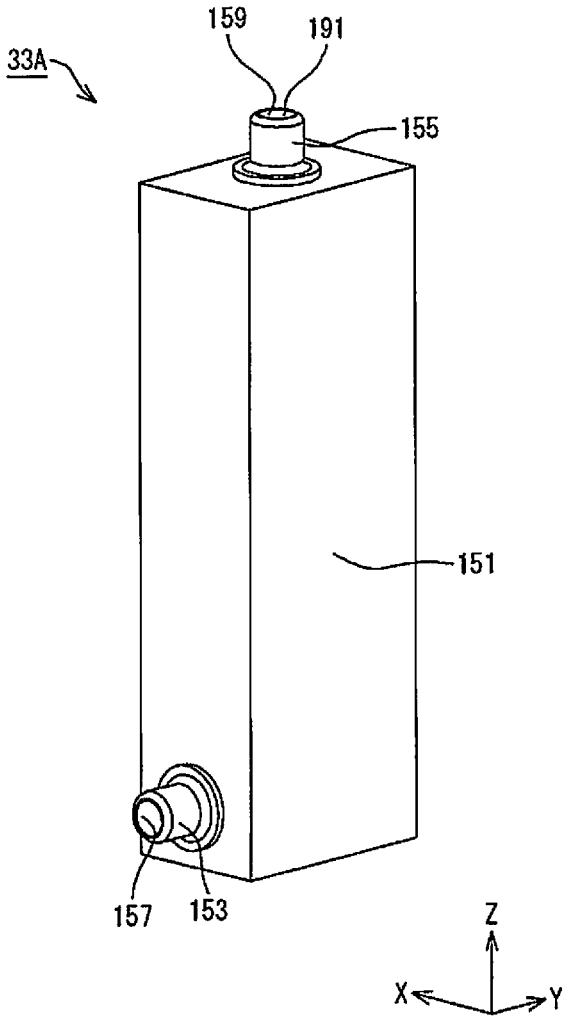
FIG. 25 is a perspective diagram illustrating an indicator in applied example 4.

In applied example 4, a method where ink is introduced from the air exposing opening 159 of the air hole portion 155 into the indicator 33A (FIG. 12) is adopted when new ink is introduced into the tank set 57A. For this reason, the air exposing opening 159 also serves as a liquid injection port when ink is introduced into the tank set 57A in applied example 4. The ink which is introduced from the air exposing opening 159 flows from the receiving opening 157 of the connecting portion 153 into the tube 58 through the container section 151 of the indicator 33A. The ink which flows from the container section 151 into the tube 58 is led into the containing section 65 (FIG. 11) via the connecting portion 116 (FIG. 9) of the tank 9A. That is, the air exposing opening 159 also serves as an liquid injection port 191 which receives ink which is injected from outside of the containing portion 65 (FIG. 11) into the containing portion 65 in applied example 4 as shown in FIG. 25. As described above, it is possible to for ink to be filled into the tank set 57 by ink being injected from the liquid injection port 191 (the air exposing opening 159) into the indicator 33A.

Figure 26:
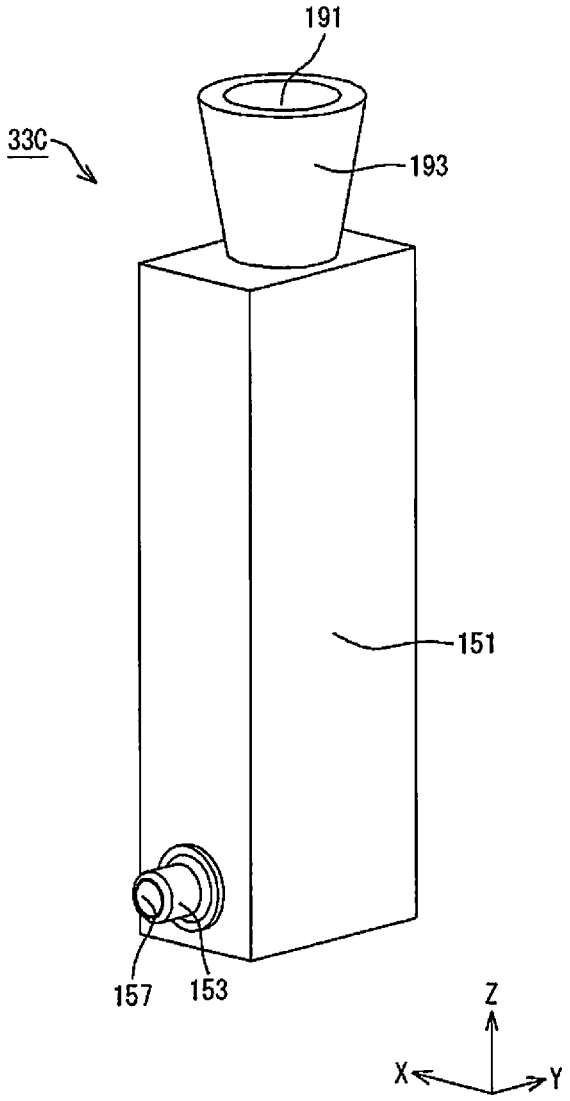
FIG. 26 is a perspective diagram illustrating another example of an indicator in applied example 4.

Here, it is possible to also adopt a configuration in applied example 4 where the liquid injection port 191 (the air exposing opening 159) is formed in a funnel shape as shown in FIG. 26. The indicator 33 which has the liquid injection port 191 with a funnel shape is given the notation of an indicator 33C. The liquid injection port 191 with the funnel shape in the indicator 33C has a funnel section 193. The funnel section 193 protrudes from the container section 151 in the Z axis direction and surrounds the liquid injection port 191. The inner diameter of the funnel section 193 becomes wider from the container section 151 toward the Z axis direction. In the configuration described above, it is possible for it to be difficult for the ink to spill out from the liquid injection port 191 when the ink is poured into the liquid injection port 191 since the liquid injection port 191 is formed in a funnel shape due to the funnel section 193.

Applied Example 5

Figure 27:
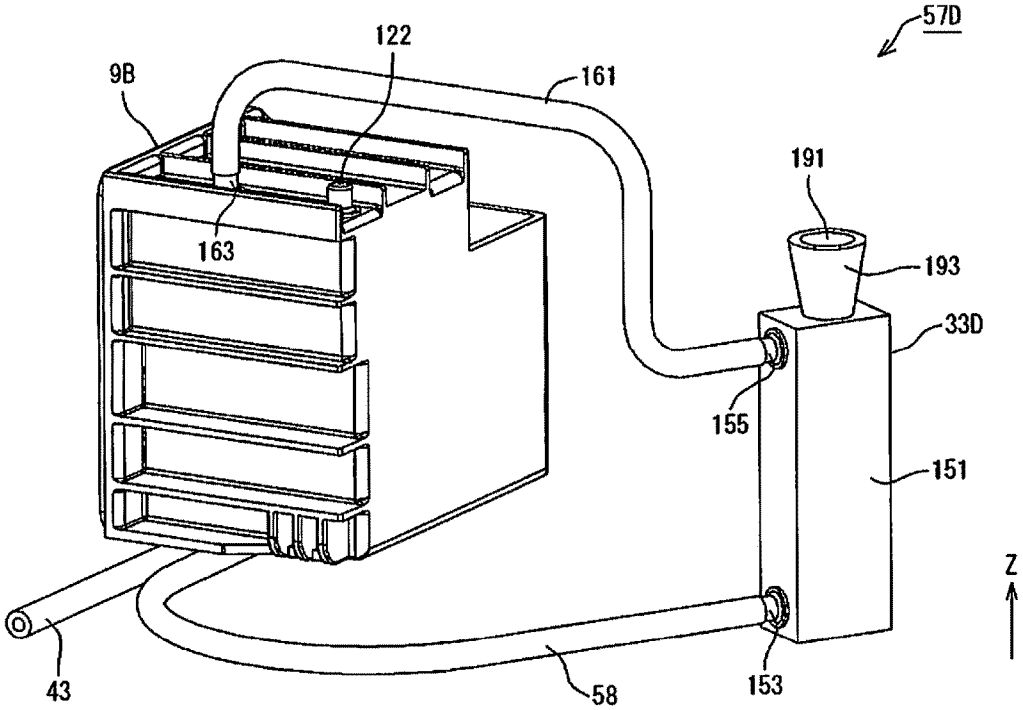
FIG. 27 is a perspective diagram illustrating a tank set in applied example 5.

As shown in FIG. 27, a tank set 57D in applied example 5 has the tank 9B, an indicator 33D, the tube 58, the tube 161, and the supply tube 43. The indicator 33A in the tank set 57B in applied example 2 is substituted in applied example 5 with the indicator 33D in the tank set 57D. Except for this, the tank set 57D in applied example 5 has a configuration which is the same as the tank set 57B in applied example 2. For this reason, the same reference numerals as in applied example 2 are given and detailed description is omitted for configurations in applied example 5 which are the same as in applied example 2.

Figure 28:
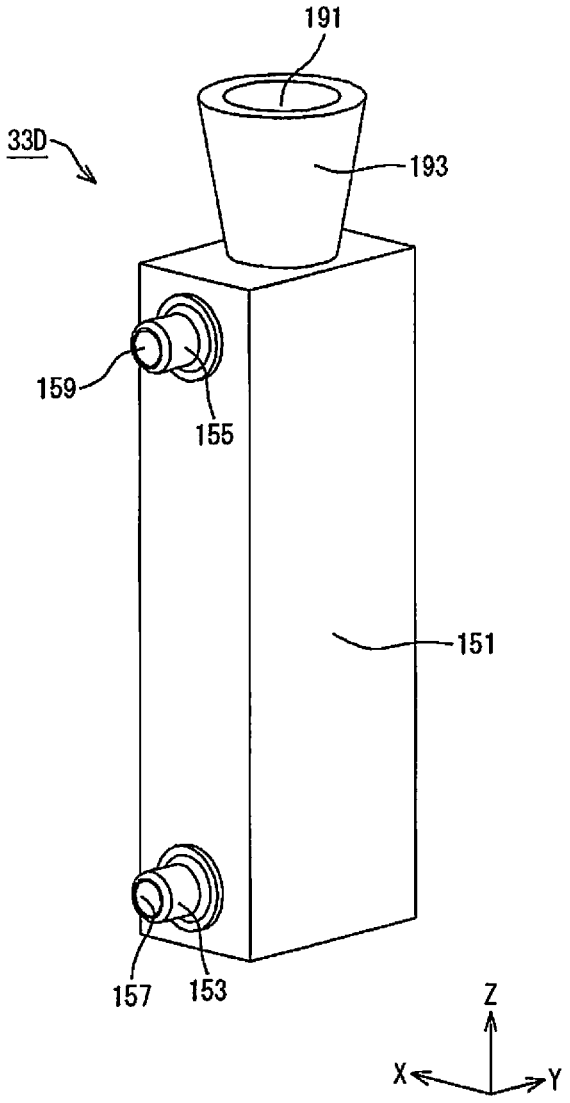
FIG. 28 is a perspective diagram illustrating an indicator in applied example 5.

As shown in FIG. 28, the indicator 33D has the container section 151, the connecting portion 153, the air hole portion 155, and the liquid injection port 191. The indicator 33D has the same configuration as the indicator 33A except for the liquid injection port 191 being formed independently from the air exposing opening 159 in the indicator 33A. For this reason, the same reference numerals as in the indicator 33A are given and detailed description is omitted for configurations in the indicator 33D which are the same as the indicator 33A.

In the indicator 33D, the air hole portion 155 and the liquid injection port 191 are formed in the container section 151 at positions which are different to each other. The liquid injection port 191 in the indicator 33D is formed on an end section of the container section 151 in the Z axis direction in the same manner as the indicator 33C (FIG. 26). In addition, the liquid injection port 191 has the funnel section 193 in the same manner as the indicator 33C (FIG. 26). The air hole portion 155 is provided in the indicator 33D on the side surface of the container section 151. The air hole portion 155 protrudes in the indicator 33D from the side surface of the container section 151 in a direction which intersects with the Z axis. The air exposing opening 159, which is open toward a direction which intersects with the Z axis, is formed in the air hole portion 155.

As shown in FIG. 27, one end of the tube 161 is connected to the connecting portion 163 of the tank 9B in the tank set 57D. The other end, which is on the opposite side to the tank 9B side, of the tube 161 is connected to the air hole portion 155 of the indicator 33D. In addition, the tube 58 is connected to the connecting portion 153 of the indicator 33D. Due to this, the tank 9B and the indicator 33D are connected to each other via the tube 58 and the tube 161 in the tank set 57D. In the tank set 57D, the inside of the container section 151 of the indicator 33D is exposed to air via the tube 161 and the air chamber 68 and the air communication port 122 of the tank 9B. That is, the fluid communication member is configured mainly by a flow path which includes the tube 58, the indicator 33D, the tube 161, the air chamber 68, and the air communication port 122, and one end is exposed to air. For this reason, it is possible to obtain the same effects in applied example 5 as in applied example 1 and applied example 2.

Applied Example 6

Figure 29:
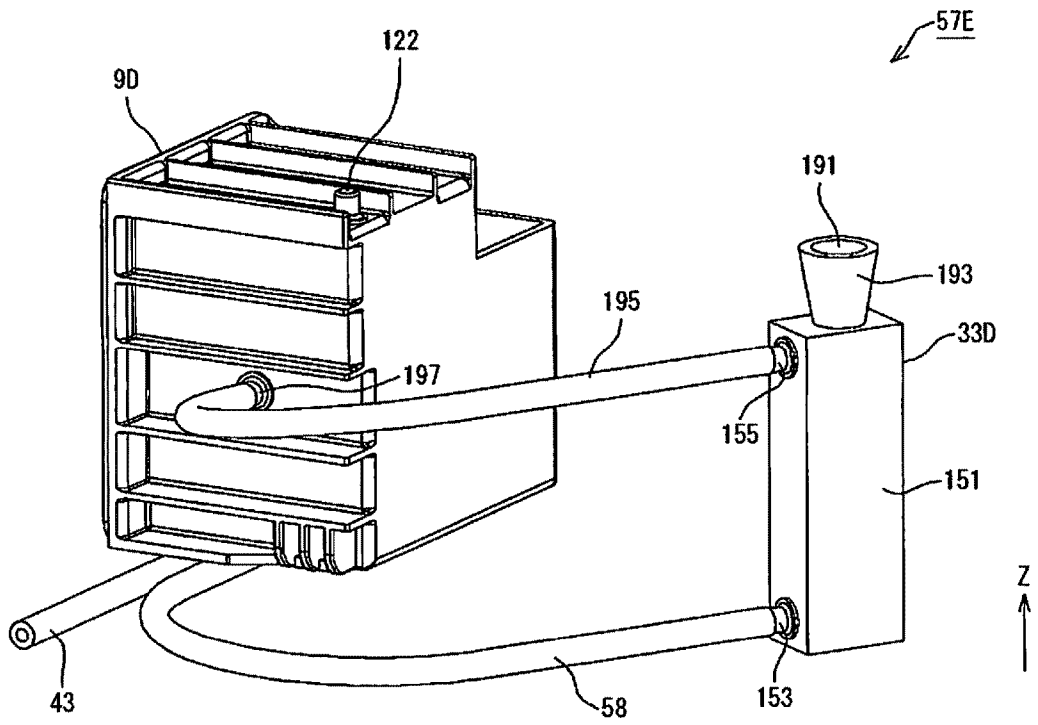
FIG. 29 is a perspective diagram illustrating a tank set in applied example 6.

As shown in FIG. 29, a tank set 57E in applied example 6 has a tank 9D, the indicator 33D, the tube 58, a tube 195, and the supply tube 43. The tank 9B in the tank set 57D in applied example 5 is substituted in applied example 6 with the tank 9D in the tank set 57E. In addition, the tube 161 in the tank set 57D in applied example 5 is substituted in applied example 6 with the tube 195 in the tank set 57E. Except for this point, the tank set 57E in applied example 6 has a configuration which is the same as the tank set 57D in applied example 5. For this reason, the same reference numerals as in applied example 5 are given and detailed description is omitted for configurations in applied example 6 which are the same as in applied example 5.

A connecting portion 197 is provided in the tank 9D. Except for this, the tank 9D has a configuration which is the same as the tank 9A. For this reason, the same reference numerals as in the tank 9A are given and detailed description is omitted for configurations in the tank 9D which are the same as the tank 9A. An opening section (which is not shown in the drawings) is formed in the connecting portion 197. The connecting portion 197 runs through to the inside of the containing section 65 via the opening section. That is, the containing section 65 of the tank 9D runs through to the outside of the tank 9D via the opening section which is formed in the connecting portion 197. One end of the tube 195 is connected to the connecting portion 197 of the tank 9D. The other end, which is on the opposite side to the tank 9D side, of the tube 195 is connected to the air hole portion 155 of the indicator 33D. Due to this, it is possible to obtain the same effects in applied example 6 as in applied example 1 and applied example 2.

In addition, the air hole portion 155 of the indicator 33D functions as a connecting portion between the containing section 65 of the tank 9D and the container section 151 in applied example 6. In addition, the inside of the container section 151 is exposed to air via the liquid injection port 191 of the indicator 33D in applied example 6. Due to this, it is possible to obtain the same effects in applied example 6 as in applied example 1 and applied example 2. The air hole portion 155 is positioned on the Z axis direction side of the connecting portion 153. That is, the air hole portion 155 is positioned vertically above the connecting portion 153. In addition, the air hole portion 155 is positioned more to the −Z axis direction side than the liquid injection port 191, that is, vertically below the liquid injection port 191. As such, the air hole portion 155 is positioned between the connecting portion 153 and the liquid injection port 191.

For this reason, when the ink from the liquid injection port 191 is introduced into the inside of the container section 151, the ink inside the container section 151 flows from the air hole portion 155 into the inside of the containing section 65 of the tank 9D via the tube 195 and the connecting portion 197 when the liquid level of the ink inside the container section 151 reaches the air hole portion 155. That is, when the ink from the liquid injection port 191 in introduced into an inner section of the container section 151, the ink inside the container section 151 flows from the air hole portion 155 into the inside of the containing section 65 of the tank 9D via the tube 195 and the connecting portion 197 before the liquid level of the ink inside the container section 151 reaches the liquid injection port 191. Due to this, it is easy to avoid the ink overflowing from the liquid injection port 191.

In this manner, a flow path, which is from the air hole portion 155 of the indicator 33D to the connecting portion 197 via the tube 195, functions as a bypass path where the ink, which is excessively introduced into the inside of the connecting portion 151, bypasses through to the tank 9D in applied example 6. In applied example 6, the flow path, which is from the air hole portion 155 to the connecting portion 197 via the tube 195, is an example of a second linking path. In addition, a flow path, which is from the connecting portion 116 (FIG. 13) of the tank 9 to the connecting portion 153 of the indicator 33 via the tube 58, is an example of a first linking path. Then, the connecting portion 153 is an example of a first connecting portion and the air hole portion 155 is an example of a second connecting portion.

Applied Example 7

Figure 30:
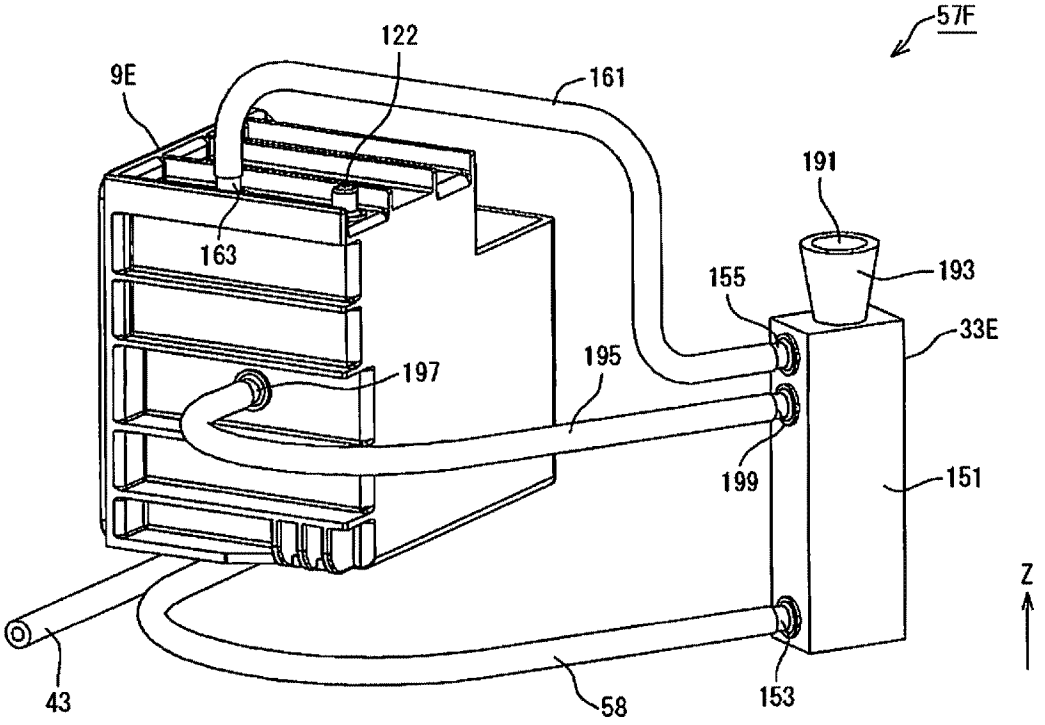
FIG. 30 is a perspective diagram illustrating a tank set in applied example 7.

As shown in FIG. 30, a tank set 57F in applied example 7 has a tank 9E, an indicator 33E, the tube 58, the tube 161, the tube 195, and the supply tube 43. The tank 9D in the tank set 57E in applied example 6 is substituted in applied example 7 with the tank 9E in the tank set 57F. In addition, the indicator 33D in the tank set 57E in applied example 6 is substituted in applied example 7 with the indicator 33E in the tank set 57F. Except for these points, the tank set 57F in applied example 7 has a configuration which is the same as the tank set 57E in applied example 6. For this reason, the same reference numerals as in applied example 6 are given and detailed description is omitted for configurations in applied example 7 which are the same as in applied example 6.

The connecting portion 163 is added to the tank 9E. Except for this point, the tank 9E has the same configuration as the tank 9D in applied example 6. For this reason, the same reference numerals as in the tank 9D are given and detailed description is omitted for configurations in the tank 9E which are the same as in the tank 9D. In addition, the connection portion 163 has the same configuration as the connection portion 163 of the tank 9B. For this reason, detailed description of the connection portion 163 is omitted.

The indicator 33E has the connecting portion 199. Except for this point, the indicator 33E has the same configuration as the indicator 33D. For this reason, the same reference numerals as in the indicator 33D are given and detailed description is omitted for configurations in the indicator 33E which are the same as the indicator 33D. The connecting portion 199 is provided at the side surface of the container section 151. The connecting portion 199 protrudes from the side surface of the container section 151 in a direction which intersects with the Z axis. An opening section (which is not shown in the drawings), which is open toward a direction which intersects with the Z axis, is formed in the connecting portion 199. The connecting portion 199 runs through to the inside of the container section 151 via the opening section. That is, an inner section of the container section 151 runs through to an outer section of the container section 151 in the indictor 33E via the opening section which is formed in the connecting portion 199.

One end of the tube 161 is connected to the connecting portion 163 of the tank 9E in the tank set 57F. The other end, which is on the opposite side to the tank 9E side, of the tube 161 is connected to the air hole portion 155 of the indicator 33E. In addition, one end of the tube 195 is connected to the connecting portion 197 of the tank 9E. The other end, which is on the opposite side to the tank 9E side, of the tube 195 is connected to the connecting portion 199 of the indicator 33E. In applied example 7, the inside of the container section 151 of the indicator 33E is exposed to air via the tube 161 and the air chamber 68 and the air communication port 122 of the tank 9E. Due to this, it is possible to obtain the same effects in applied example 7 as in applied example 1 and applied example 2.

In addition, the connecting portion 199 is positioned vertically above the connecting portion 153 in applied example 7. In addition, the connecting portion 199 is positioned more to the −Z axis direction side than the air hole portion 155, that is, vertically below the air hole portion 155. As such, the connecting portion 199 is positioned between the connecting portion 153 and the air hole portion 155. For this reason, when the ink from the liquid injection port 191 is introduced into the inside of the container section 151, the ink inside the container section 151 flows from the connecting portion 199 into the inside of the containing section 65 of the tank 9E via the tube 195 and the connecting portion 197 when the liquid level of the ink inside the container section 151 reaches the connecting portion 199. That is, when the ink from the liquid injection port 191 is introduced into an inner section of the container section 151, the ink inside the container section 151 flows from the connecting portion 199 into the inside of the containing section 65 of the tank 9E via the tube 195 and the connecting portion 197 before the liquid level of the ink inside the container section 151 reaches the liquid injection port 191. Due to this, it is easy to avoid the ink overflowing from the liquid injection port 191.

In addition, in applied example 7, when the ink from the liquid injection port 191 is introduced into an inner section of the container section 151, the ink inside the container section 151 flows from the connecting portion 199 into the inside of the containing section 65 of the tank 9E via the tube 195 and the connecting portion 197 before the liquid level of the ink inside the container section 151 reaches the air exposing opening 155. Due to this, it is easy to avoid the ink flowing from the air hole portion 155 into the air chamber 68 of the tank 9E.

In each of applied example 4 to applied example 7, the supply tube 43 and the tube 58 are connected to the tank 9. That is, the supply tube 43 and the tube 58 are each provided independently in the tank 9 in each of applied example 4 to applied example 7. However, connecting of the tank 9 with the supply tube 43 and the tube 58 is not limited to this. For connecting of the tank 9 with the supply tube 43 and the tube 58, it is possible to adopt a configuration where, for example, the tube 58 is connected to the supply tube 43 between the tank 9 and the printing head 47 as shown in FIG. 19 in the same manner as applied example 1 and applied example 2. In this configuration, the indicator 33 is provided in the supply tube 43 between the tank 9 and the printing head 47. Due to this configuration, it is easy to provide the indicator 33 in the path of the supply tube 43.

Applied Example 8

The tank set 57C in applied example 8 has a configuration which is the same as the tank set 57C (FIG. 21) in applied example 3. In applied example 8, the method where ink is introduced with regard to the tank set 57C is different to applied example 3. Except for this point, applied example 8 is the same as applied example 3. For this reason, the same reference numerals as in applied example 3 are given and detailed description is omitted for configurations which are the same as in applied example 3.

Figure 31:
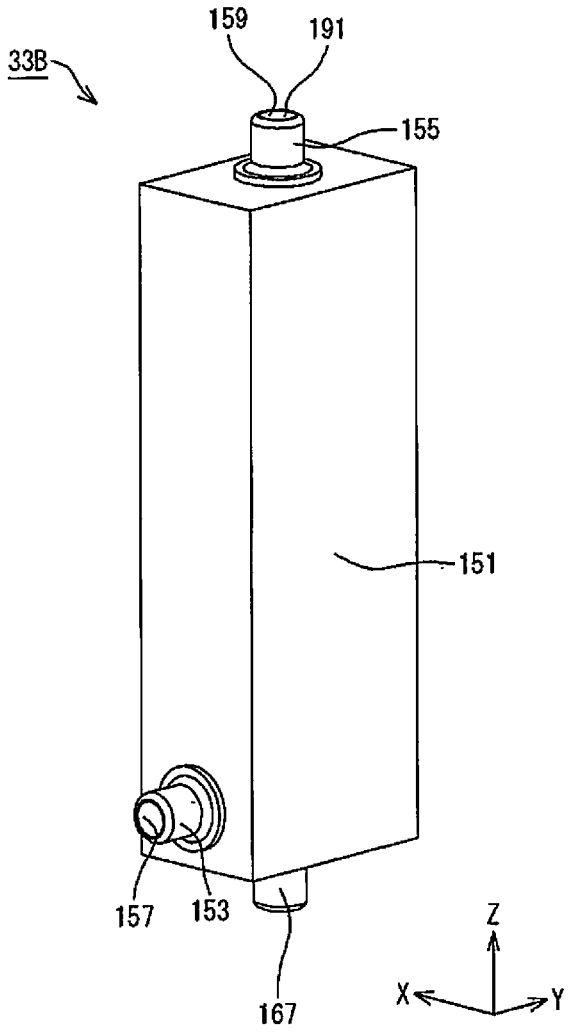
FIG. 31 is a perspective diagram illustrating an indicator in applied example 8.

In applied example 8, a method is adopted for introducing ink from the air exposing opening 159 of the air hole portion 155 in the indicator 33B (FIG. 23) when new ink is introduced into the tank set 57C. For this reason, the air exposing opening 159 also serves as a liquid injection port when ink is introduced into the tank set 57C in applied example 8. The ink which is introduced from the air exposing opening 159 flows from the receiving opening 157 of the connecting portion 153 to the tube 58 through the container section 151 of the indicator 33B. The ink which flows from the container section 151 into the tube 58 is led into the inside of the containing section 65 (FIG. 11) via the connecting portion 116 (FIG. 22) of the tank 9C. That is, the air exposing opening 159 also serves as an liquid injection port 191 which receives ink which is led from an outer section of the containing section 65 (FIG. 11) into an inner section of the containing section 65 in applied example 8 as shown in FIG. 31. Due to the above, it is possible for ink to be filled into the tank set 57 by ink from the liquid injection port 191 (the air exposing opening 159) being introduced into the indicator 33B.

Figure 32:
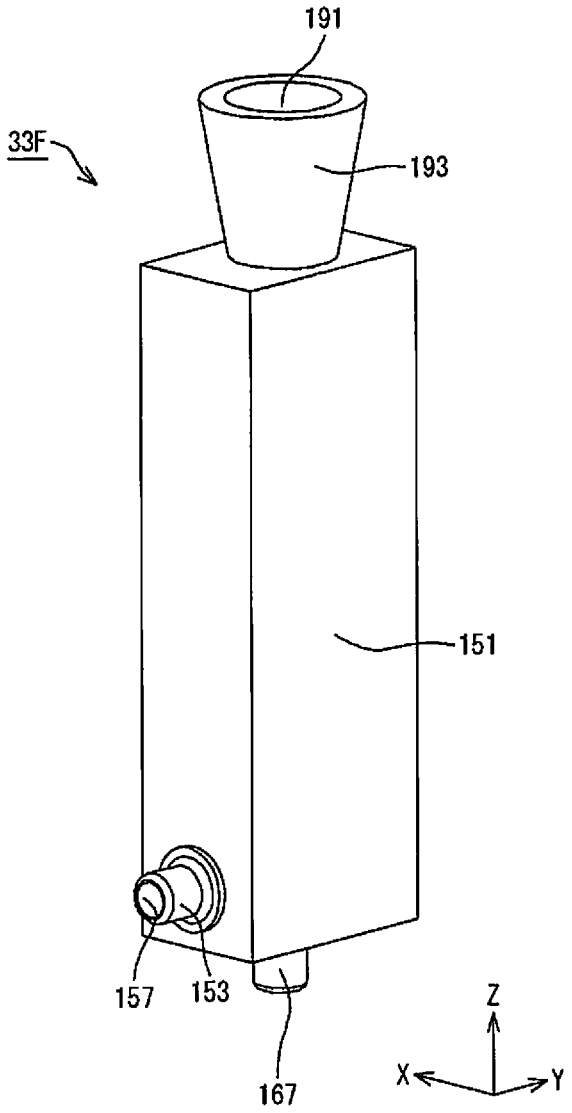
FIG. 32 is a perspective diagram illustrating another example of an indicator in applied example 8.

Here, it is possible to also adopt a configuration in applied example 8 where the liquid injection port 191 (the air exposing opening 159) is formed in a funnel shape as shown in FIG. 32. The indicator 33 which has the liquid injection port 191 with a funnel shape is given the notation of an indicator 33F. The liquid injection port 191 with the funnel shape in the indicator 33F has the funnel section 193. The funnel section 193 protrudes from the container section 151 in the Z axis direction and surrounds the liquid injection port 191. The inner diameter of the funnel section 193 becomes wider from the container section 151 toward the Z axis direction. In the configuration described above, it is possible for it to be difficult for the ink to spill out from the liquid injection port 191 when the ink is poured into the liquid injection port 191 since the liquid injection port 191 is formed in a funnel shape due to the funnel section 193.

Applied Example 9

Figure 33:
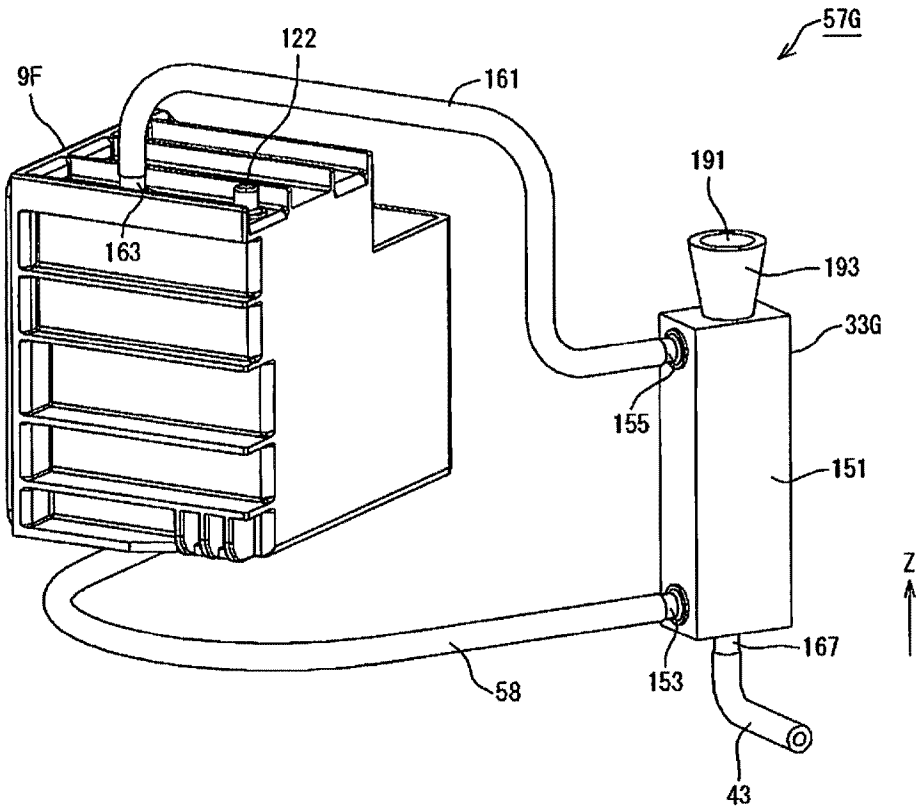
FIG. 33 is a perspective diagram illustrating a tank set in applied example 9.

As shown in FIG. 33, a tank set 57G in applied example 9 has a tank 9F, an indicator 33G, the tube 58, the tube 161, and the supply tube 43. The connecting portion 163 in the tank set 57G in applied example 9 is added to the tank 9C of the tank set 57C in applied example 8. In addition, the indicator 33F (FIG. 32) in the tank set 57C in applied example 8 is substituted in applied example 9 with the indicator 33G in the tank set 57G. Furthermore, the tube 161 is added in the tank set 57G in applied example 9 to the tank set 57C in applied example 8. Except for these points, the tank set 57G in applied example 9 has a configuration which is the same as the tank set 57C in applied example 8. For this reason, the same reference numerals as in applied example 8 are given and detailed description is omitted for configurations in applied example 9 which are the same as in applied example 8.

The connecting portion 163 is added to the tank 9F. Except for this point, the tank 9F has the same configuration as the tank 9C in applied example 8. For this reason, the same reference numerals as in the tank 9C are given and detailed description is omitted for configurations in the tank 9F which are the same as in the tank 9C. The connection portion 163 has the same configuration as the connection portion 163 of the tank 9B. For this reason, detailed description of the connection portion 163 is omitted.

In the indicator 33G, the air hole portion 155 is added to the indicator 33F (FIG. 32) in applied example 8. The indicator 33G has the same configuration as the indicator 33F except for the air exposing opening 159 being formed independently from the liquid injection port 191 in the indicator 33F. For this reason, the same reference numerals as in the indicator 33F are given and detailed description is omitted for configurations in the indicator 33G which are the same as the indicator 33F.

In the indicator 33G The air hole portion 155 and the liquid injection port 191 are formed in the container section 151 at positions which are different to each other. The liquid injection port 191 in the indicator 33G is formed on an end section of the container section 151 in the Z axis direction in the same manner as the indicator 33F (FIG. 32). In addition, the liquid injection port 191 has the funnel section 193 in the same manner as the indicator 33F (FIG. 32). The air hole portion 155 is provided at the side surface of the container section 151 in the indicator 33G. The air hole portion 155 protrudes from the side surface of the container section 151 in a direction which intersects with the Z axis in the indicator 33G. The air exposing opening 159 which is open toward a direction which intersects with the Z axis is formed in the air hole portion 155.

The connecting portion 163 runs through to the air chamber 68 of the tank 9F via the linking opening 165 (FIG. 15). One end of the tube 161 is connected to the connecting portion 163 of the tank 9F in the tank set 57G. The other end, which is on the opposite side to the tank 9F side, of the tube 161 is connected to the air hole portion 155 of the indicator 33G. In addition, the tube 58 is connected to the connecting portion 153 of the indicator 33G. Due to this, the tank 9F and the indicator 33G are connected to each other via the tube 58 and the tube 161 in the tank set 57G. The inside of the container section 151 of the indicator 33G is exposed to air via the tube 161 and the air chamber 68 and the air communication port 122 of the tank 9F in the tank set 57G. Due to this, it is possible to obtain the same effects in applied example 9 as in applied example 1 and applied example 2.

Applied Example 10

Figure 34:
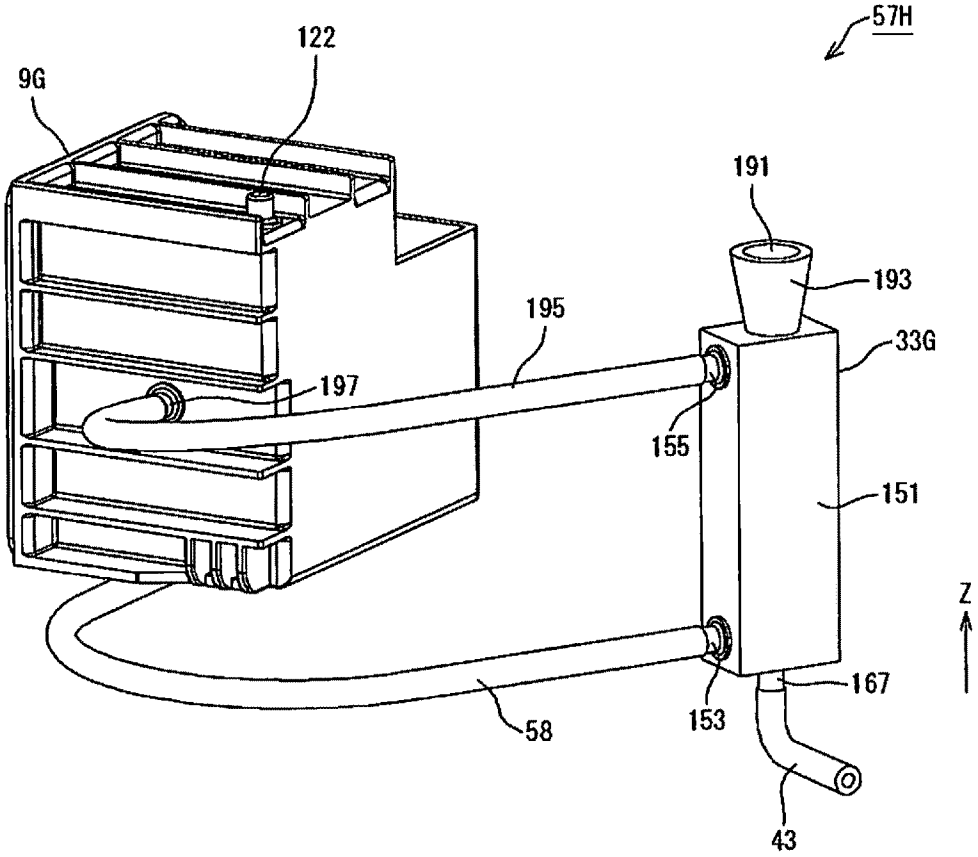
FIG. 34 is a perspective diagram illustrating a tank set in applied example 10.

As shown in FIG. 34, a tank set 57H in applied example 10 has a tank 9G, the indicator 33G, the tube 58, the tube 195, and the supply tube 43. The tank 9F in the tank set 57G in applied example 9 is substituted in applied example 10 with the tank 9G in the tank set 57H. In addition, the tube 161 in the tank set 57G in applied example 9 is substituted in applied example 10 with the tube 195 in the tank set 57H. Except for these points, the tank set 57H in applied example 10 has a configuration which is the same as the tank set 57G in applied example 9. For this reason, the same reference numerals as in applied example 9 are given and detailed description is omitted for configurations in applied example 10 which are the same as in applied example 9.

The connecting portion 197 is provided in the tank 9G. Except for this, the tank 9G has a configuration which is the same as the tank 9C. For this reason, the same reference numerals as in the tank 9C are given and detailed description is omitted for configurations in the tank 9G which are the same as in the tank 9C. An opening section (which is not shown in the drawings) is formed in the connecting portion 197. The connecting portion 197 runs through to the inside of the containing section 65 via the opening section. One end of the tube 195 is connected to the connecting portion 197 of the tank 9G. The other end, which is on the opposite side to the tank 9G side, of the tube 195 is connected to the air hole portion 155 of the indicator 33G. Due to this, it is possible to obtain the same effects in applied example 10 as in applied example 1 and applied example 2.

In addition, the air hole portion 155 of the indicator 33G functions as a connecting portion between the containing section 65 of the tank 9G and the container section 151 in applied example 10. In addition, the inside of the container section 151 is exposed to air via the liquid injection port 191 of the indicator 33D in applied example 10. Due to this, it is possible to obtain the same effects in applied example 10 as in applied example 1 and applied example 2. The air hole portion 155 is positioned on the Z axis direction side of the connecting portion 153. That is, the air hole portion 155 is positioned vertically above the connecting portion 153. In addition, the air hole portion 155 is positioned more to the −Z axis direction side than the liquid injection port 191, that is, vertically below the liquid injection port 191. As such, the air hole portion 155 is positioned between the connecting portion 153 and the liquid injection port 191.

For this reason, when the ink from the liquid injection port 191 is introduced into the inside of the container section 151, the ink inside the container section 151 flows from the air hole portion 155 into the inside of the containing section 65 of the tank 9G via the tube 195 and the connecting portion 197 when the liquid level of the ink inside the container section 151 reaches the air hole portion 155. That is, when the ink from the liquid injection port 191 is introduced into an inner section of the container section 151, the ink inside the container section 151 flows from the air hole portion 155 into the inside of the containing section 65 of the tank 9G via the tube 195 and the connecting portion 197 before the liquid level of the ink inside the container section 151 reaches the liquid injection port 191. Due to this, it is easy to avoid the ink overflowing from the liquid injection port 191.

In this manner, a flow path, which is from the air hole portion 155 of the indicator 33G to the connecting portion 197 via the tube 195, functions as a bypass path where the ink, which is excessively introduced into the inside of the connecting portion 151, bypasses through to the tank 9G in applied example 10. In applied example 10, the flow path, which is from the air hole portion 155 to the connecting portion 197 via the tube 195, is an example of a second linking path. In addition, a flow path, which is from the connecting portion 116 (FIG. 13) of the tank 9 to the connecting portion 153 of the indicator 33 via the tube 58, is an example of a first linking path. Then, the connecting portion 153 is an example of a first connecting portion and the air hole portion 155 is an example of a second connecting portion.

Applied Example 11

Figure 35:
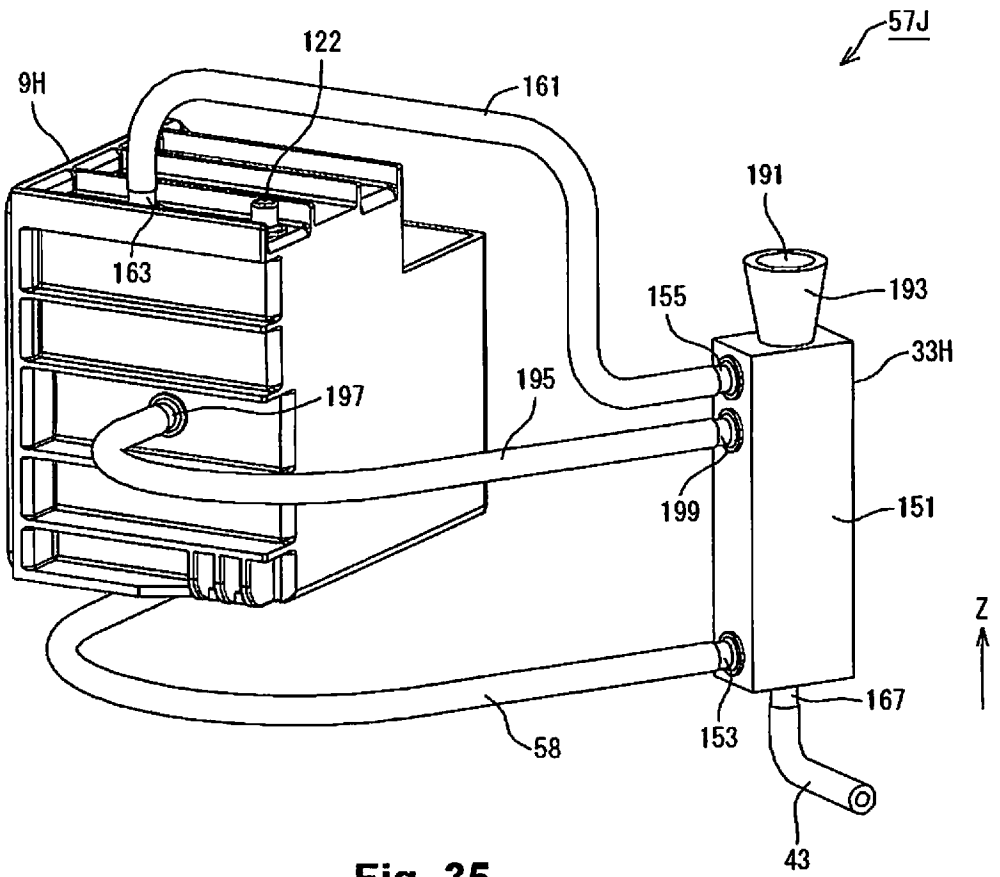
FIG. 35 is a perspective diagram illustrating a tank set in applied example 11.

As shown in FIG. 35, a tank set 57J in applied example 11 has a tank 9H, an indicator 33H, the tube 58, the tube 161, the tube 195, and the supply tube 43. The tank 9G in the tank set 57H in applied example 10 is substituted in applied example 11 with the tank 9H in the tank set 57J. In addition, the indicator 33G in the tank set 57H in applied example 10 is substituted in applied example 11 with the indicator 33H in the tank set 57J. Except for these points, the tank set 57J in applied example 11 has the same configuration as the tank set 57H in applied example 10. For this reason, the same reference numerals as in applied example 10 are given and detailed description is omitted for configurations in applied example 11 which are the same as in applied example 10.

The connecting portion 163 is added to the tank 9H. Except for this point, the tank 9H has the same configuration as the tank 9G in applied example 10. For this reason, the same reference numerals as in the tank 9G are given and detailed description is omitted for configurations in the tank 9H which are the same as in the tank 9G. In addition, the connection portion 163 has the same configuration as the connection portion 163 of the tank 9B. For this reason, detailed description of the connection portion 163 is omitted.

The indicator 33H has the connecting portion 199. Except for this point, the indicator 33H has the same configuration as the indicator 33G. For this reason, the same reference numerals as in the indicator 33G are given and detailed description is omitted for configurations in the indicator 33H which are the same as in the indicator 33G. In addition, the connection portion 199 has the same configuration as the connection portion 199 of the indicator 33E. For this reason, detailed description of the connection portion 199 is omitted.

One end of the tube 161 is connected to the connecting portion 163 of the tank 9H in the tank set 57J. The other end, which is on the opposite side to the tank 9H side, of the tube 161 is connected to the air hole portion 155 of the indicator 33H. In addition, one end of the tube 195 is connected to the connecting portion 197 of the tank 9H. The other end, which is on the opposite side to the tank 9H side, of the tube 195 is connected to the connecting portion 199 of the indicator 33H. In applied example 11, the inside of the container section 151 of the indicator 33H is exposed to air via the tube 161 and the air chamber 68 and the air communication port 122 of the tank 9H. Due to this, it is possible to obtain the same effects in applied example 11 as in applied example 1 and applied example 2.

In addition, the connecting portion 199 is positioned vertically above the connecting portion 153 in applied example 11. In addition, the connecting portion 199 is positioned more to the −Z axis direction side than the air hole portion 155, that is, vertically below the air hole portion 155. As such, the connecting portion 199 is positioned between the connecting portion 153 and the air hole portion 155. For this reason, when the ink from the liquid injection port 191 is introduced into the inside of the container section 151, the ink inside the container section 151 flows from the connecting portion 199 into the inside of the containing section 65 of the tank 9H via the tube 195 and the connecting portion 197 when the liquid level of the ink inside the container section 151 reaches the connecting portion 199. That is, when the ink from the liquid injection port 191 flows into an inner section of the container section 151, the ink inside the container section 151 flows from the connecting portion 199 into the inside of the containing section 65 of the tank 9H via the tube 195 and the connecting portion 197 before the liquid level of the ink inside the container section 151 reaches the liquid injection port 191. Due to this, it is easy to avoid the ink overflowing from the liquid injection port 191.

In addition, in applied example 11, when the ink from the liquid injection port 191 is introduced into an inner section of the container section 151, the ink inside the container section 151 flows from the connecting portion 199 into the inside of the containing section 65 of the tank 9H via the tube 195 and the connecting portion 197 before the liquid level of the ink inside the container section 151 reaches the air exposing opening 155. Due to this, it is easy to avoid the ink flowing from the air hole portion 155 into the air chamber 68 of the tank 9E.

In each of applied example 5, applied example 7, applied example 9, and applied example 11 described above, it is possible to adopt a configuration where capping (stoppering) is carried out on the liquid injection port 191. In this configuration, ink is introduced into the liquid injection port 191 once an operator removes a cap from the liquid injection port 191 when ink is to be introduced from the liquid injection port 191. Due to this configuration, it is easy to suppress evaporation of liquid components in the ink inside the container section 151 of the indicator 33 from the liquid injection port 191 since capping is carried out on the liquid injection port 191.

Figure 36:
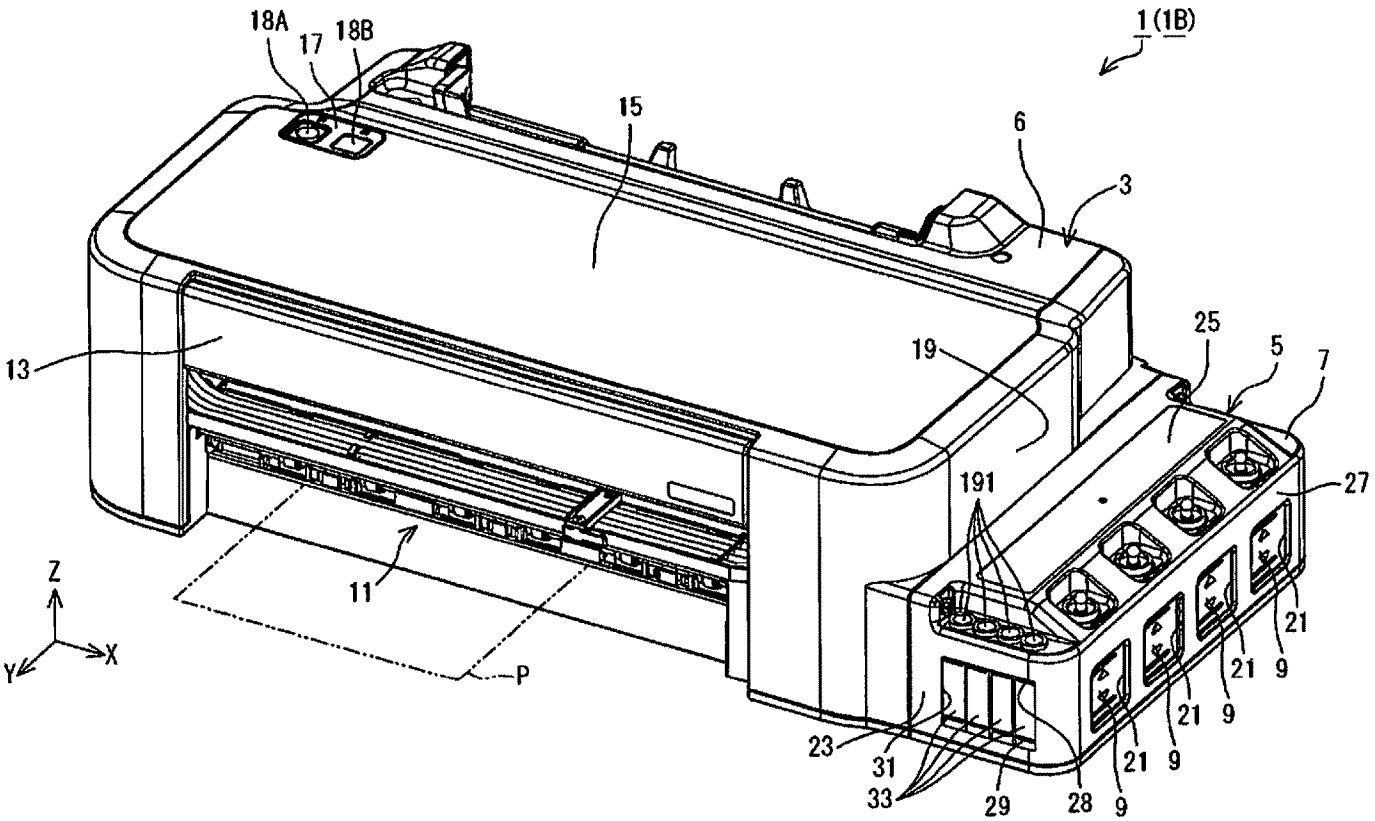
FIG. 36 is a perspective diagram illustrating another example of a liquid ejecting system in an embodiment.

It is possible to adopt an aspect shown in FIG. 36 as an example of the liquid ejecting system 1 when any of applied example 4 to applied example 11 described above are applied to the liquid ejecting system 1. The liquid ejecting system 1 where any of applied example 4 to applied example 11 is applied is given the notation of a liquid ejecting system 1B. In the liquid ejecting system 1B, the liquid injection port 191 is positioned on the front surface 13 side of the printer 3 when ink is being introduced into the tank 9. Due to this, it is easy to introduce ink into the liquid injection port 191 from the front surface 13 side of the printer 3 when an operator introduces the ink into the tank 9. That is, using the liquid ejecting system 1B, it is possible to reduce the complexity when introducing the ink into the tank 9. In addition, since the liquid injection port 191 is provided in the indictor 33 in each of applied example 4 to applied example 11, it is possible to also adopt a configuration where the ink liquid injection port 101 (FIG. 6) in the tank 9 is omitted.

In addition, a region which overlaps with the liquid injection port 191 in the indictor 33 is an opening in the second casing 7 in the liquid ejecting system 1B. Then, the liquid injection port 191 in each of the indicators 33 is exposed to the outside of the second casing 7 via an opening in the second casing 7. Due to this, it is possible for an operator to access the liquid injection port 191 of the indicator 33 without the second casing 7 being removed when ink is introduced into the liquid injection port 191 of the indicator 33. Here, it is possible to also adopt a configuration where capping (stoppering) of each of the liquid injection ports 191 is carried out in the liquid ejecting system 1B.

It is possible to also adopt a configuration where the upper limit mark 28 and the lower limit mark 29 are added to the indicator 33 in each of applied example 1 to applied example 11 described above. Due to this configuration, it is possible for an operator to ascertain the amount of ink in each of the tanks 9 with the upper limit mark 28 and the lower limit mark 29 which are provided in the indicators 33 as markings.

In the embodiments described above, a configuration is adopted where the tanks 9 are provided independently to the indicators 33 from the point of view that it is easy to ascertain the amount of ink inside the tanks 9 from the front surface side of the liquid ejecting system 1. However, the configuration where it is easy to ascertain the amount of ink inside the tanks 9 from the front surface 13 side of the liquid ejecting system 1 is not limited to the embodiments described above. As a configuration where it is easy to ascertain the amount of ink inside the tanks 9 from the front surface 13 side of the liquid ejecting system 1, it is possible to adopt an aspect of, for example, a liquid ejecting system 1C shown in FIG. 37.

Figure 37:
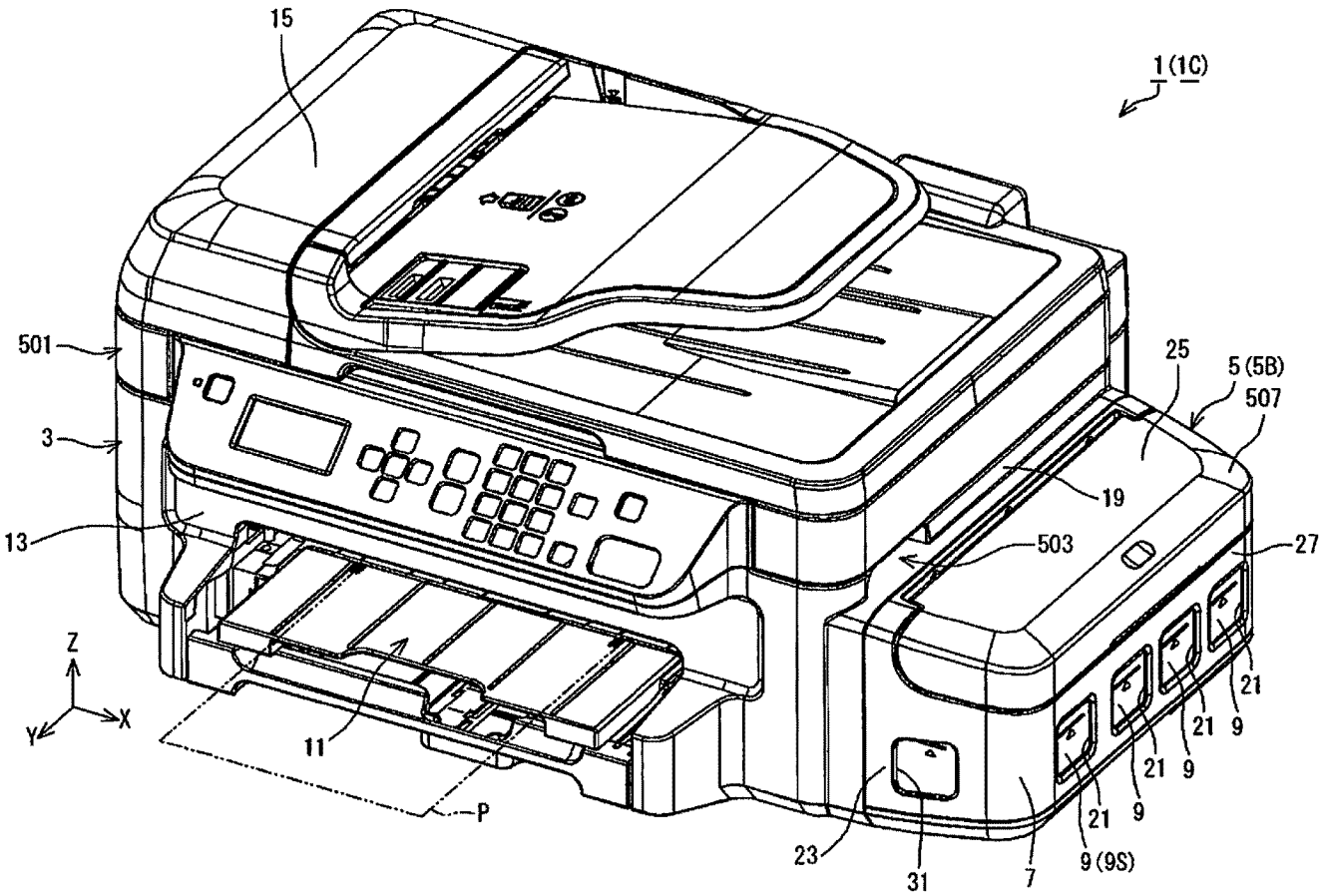
FIG. 37 is a perspective diagram illustrating another example of a liquid ejecting system in an embodiment.

The liquid ejecting system 1C has the printer 3, a tank unit 5B, and a scanner unit 501 as shown in FIG. 37. The same reference numerals as in the liquid ejecting system 1 are given and detailed description is omitted for configurations in the liquid ejecting system 1C which are the same as in the liquid ejecting system 1 (FIG. 1). In addition, the same reference numerals as in the tank unit 5 are given and detailed description is omitted for configurations in the tank unit 5B which are the same as in the tank unit 5 (FIG. 1). Here, the tank unit 5B in the liquid ejecting system 1C is an example of a liquid supplying apparatus. In addition, the tank unit 5B in the liquid ejecting system 1C is an example of a liquid container unit.

Figure 38:
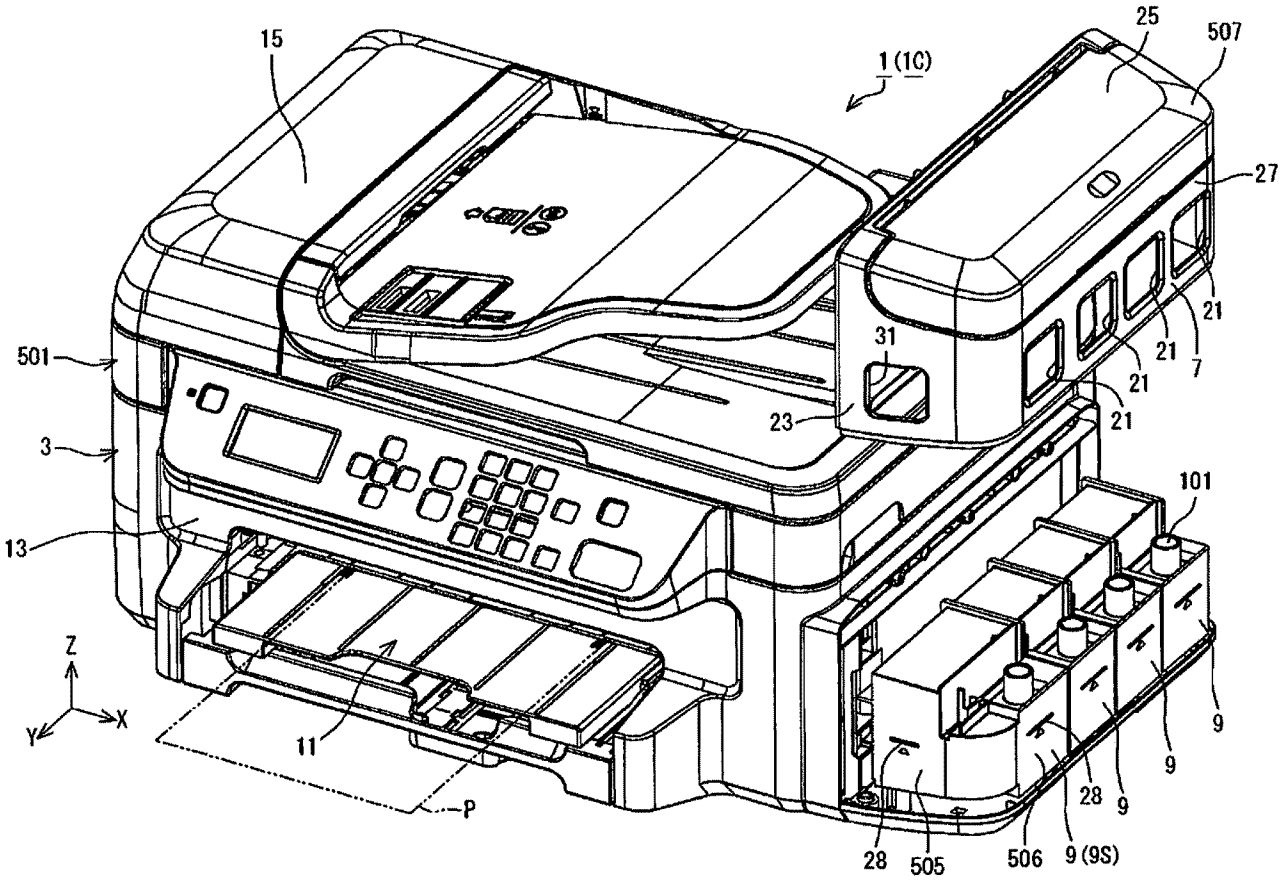
FIG. 38 is an exploded perspective diagram illustrating another example of a liquid ejecting system in an embodiment.

The printer 3 and the scanner unit 501 overlap with each other in the liquid ejecting system 1C. The scanner unit 501 is positioned vertically upward from the printer 3 in a state where the printer 3 is being used. Here, X, Y, and Z axes, which are coordinate axes which are orthogonal to each other, are applied in FIG. 37. The X, Y, and Z axes are also applied as required in the drawings shown hereafter. The X, Y, and Z axes in FIG. 37 and the X, Y, and Z axes from FIG. 38 are based on the X, Y, and Z axes in FIG. 1.

The scanner unit 501 is a flat head type of scanner unit and has an imaging element (which is not shown in the diagrams) such as an image sensor. It is possible for the scanner unit 501 to read an image or the like, which is to be recorded on a medium such as paper sheets, as image data via the imaging element. For this reason, the scanner unit 501 functions as an apparatus for reading images and the like. The scanner unit 501 is configured so as to be able to rotate with regard to the printer 3. The scanner unit 501 also functions as a lid for the printer 3. It is possible for an operator to rotate the scanner unit 501 with regard to the printer 3 by lifting up the scanner unit 501 in the Z axis direction due a finger being inserted into a handle section 503. Due to this, it is possible to open the scanner unit 501, which functions as the lid for the printer 3, with regard to the printer 3.

Here, the handle section 503 is provided as a recessed section which is formed at the side section 19 of the printer 3. The handle section 503 is formed with an orientation so to be recessed from the side section 19 in the −X axis direction. The surface on the −Z axis direction side of the handle section 503 which is formed as the recessed section is the same as the upper surface 25 of the tank unit 5B. That is, the upper surface 25 of the tank unit 5*b* configures a portion of the inner surface of the handle section 503.

The indicator 33 is not adopted in the liquid ejecting system 1C. In the liquid ejecting system 1C, the plurality of tanks 9 in the tank unit 5B line up from the front surface 13 side toward the back surface side of the printer 3, that is, from the front surface 13 in the −Y axis direction as shown in FIG. 38. Here, the plurality of tanks 9 may be configured independently from each other or may be configured integrally with each other. Furthermore, as a method for the plurality of tanks 9 to be configured integrally with each other, it is possible to adopt a method where the plurality of tanks 9 which are configured independently are bunched together and combined, a method where the plurality of tanks 9 are integrally configured due to being integrally formed, and the like. Here, the tanks 9 in the liquid ejecting system 1C are an example of a liquid containing portion. In addition, the tanks 9 in the liquid ejecting system 1C are an example of a liquid container.

A tank 9S which is positioned farthest to the front surface 13 side out of the plurality of tanks 9 has a first side portion 505 and a second side portion 506. The first side portion 505 and the second side portion 506 extend in directions which intersect with each other. The first side portion 505 and the second side portion 506 are each optically transmissive. For this reason, it is possible for the liquid surface of the ink in the tank 9S to be visually recognizable from each of the first side portion 505 and the second side portion 506. The first side portion 505 is positioned in the tank 9S more to the front surface 13 side of the printer 3 than the second side portion 506.

The window portion 21 which is positioned farthest to the front surface 13 side is formed at a portion which overlaps with the second side portion 506 of the tank 9S when the second casing 7 is viewed in the −X axis direction. In addition, the window portion 31 is formed at a portion which overlaps with the first side portion 505 of the tank 9S when the second casing 7 is viewed in the −Y axis direction. In the liquid ejecting system 1C, it is possible for the first side portion 505 of the tank 9S to be visually recognizable via the window portion 31 which is formed in the front surface 23 of the second casing 7. For this reason, it is possible for an operator to visually recognize the amount of ink in the tank 9S which is positioned farthest to the front surface 23 side from the front surface 13 side of the printer 3 by the tank 9S which is positioned farthest to the front surface 23 side being visually recognizable via the window portion 31. In addition, in the liquid ejecting system 1C, it is possible for the second side portion 506 of the tank 9S to be visually recognizable via the window portion 21 which is positioned on the front surface 23 side out of the window portions 21 in the second casing 7. For this reason, it is possible for an operator to visually recognize the amount of ink in the tank 9S by the tank 9S which is positioned farthest to the front surface 23 side being visually recognizable via the window portion 21 which is positioned farthest to the front surface 23 side.

The window portions 21 and the window portion 31 are configured as the opening sections which are formed in the second casing 7. Then, the window portion 31 is an example of a first opening section and the window portions 21 are an example of a second opening section. However, the configuration of the window portions 21 and the window portion 31 are not limited to opening sections. As the configuration of the window portions 21 and the window portion 31, it is possible to adopt a configuration where, for example, opening sections which are formed in the second casing 7 are closed off using transparent film, sheet members, members with a plate shape, or the like. The same effects are obtained even with this configuration.

In addition, in the liquid ejecting system 1C, the ink introduction section 101 is provided in the tank 9. The upper limit mark 28 is provided in each of the first side portion 505 and the second side portion 506 in the tank 9S. For this reason, it is possible for an operator to visually recognize the upper limit for the ink which is introduced into the tank 9S when ink is introduced from the ink introduction section 101 into the tank 9S. The upper limit mark 28 is an example of an upper limit display section. Here, it is sufficient if the upper limit mark 28 is provided in at least one out of the first side portion 505 and the second side portion 506. Furthermore, it is possible to also adopt a configuration where both the upper limit mark 28 and the lower limit mark 29 are provided in at least one out of the first side portion 505 and the second side portion 506.

The liquid ejecting system 1C is effective as, for example, the liquid ejecting system 1 as follows. An application for the liquid ejecting system 1, where black ink is frequently used, is considered even for the liquid ejecting system 1 which is able to perform recording using inks of a plurality of colors. The liquid ejecting system 1C described above is effective as the liquid ejecting system 1 with this application. It is possible to adopt a configuration in the liquid ejecting system 1 where black ink is frequently used where the capacity of the tank 9 which contains black ink is larger than the capacity of the tank 9 which contains inks of other colors. In this configuration, it is desirable for it to be easy to ascertain the remaining amount of black ink since black ink is frequently used.

In this case, the capacity of the tank 9S which is positioned farthest to the front surface 23 side is larger than the capacity of the other tanks 9. Then, black ink is contained in the tank 9S which is positioned farthest to the front surface 23 side. Due to this configuration, it is possible for the remaining amount of black ink in the tank 9S which is positioned farthest to the front surface 23 side to be visually recognizable from the front surface 13 side of the printer 3 by the tank 9S which is positioned farthest to the front surface 23 side being visually recognizable via the window portion 31. Here, ink which is contained in the tank 9S which is positioned farthest to the front surface 23 side is not limited to being black ink and may be ink of another color.

Figure 39:
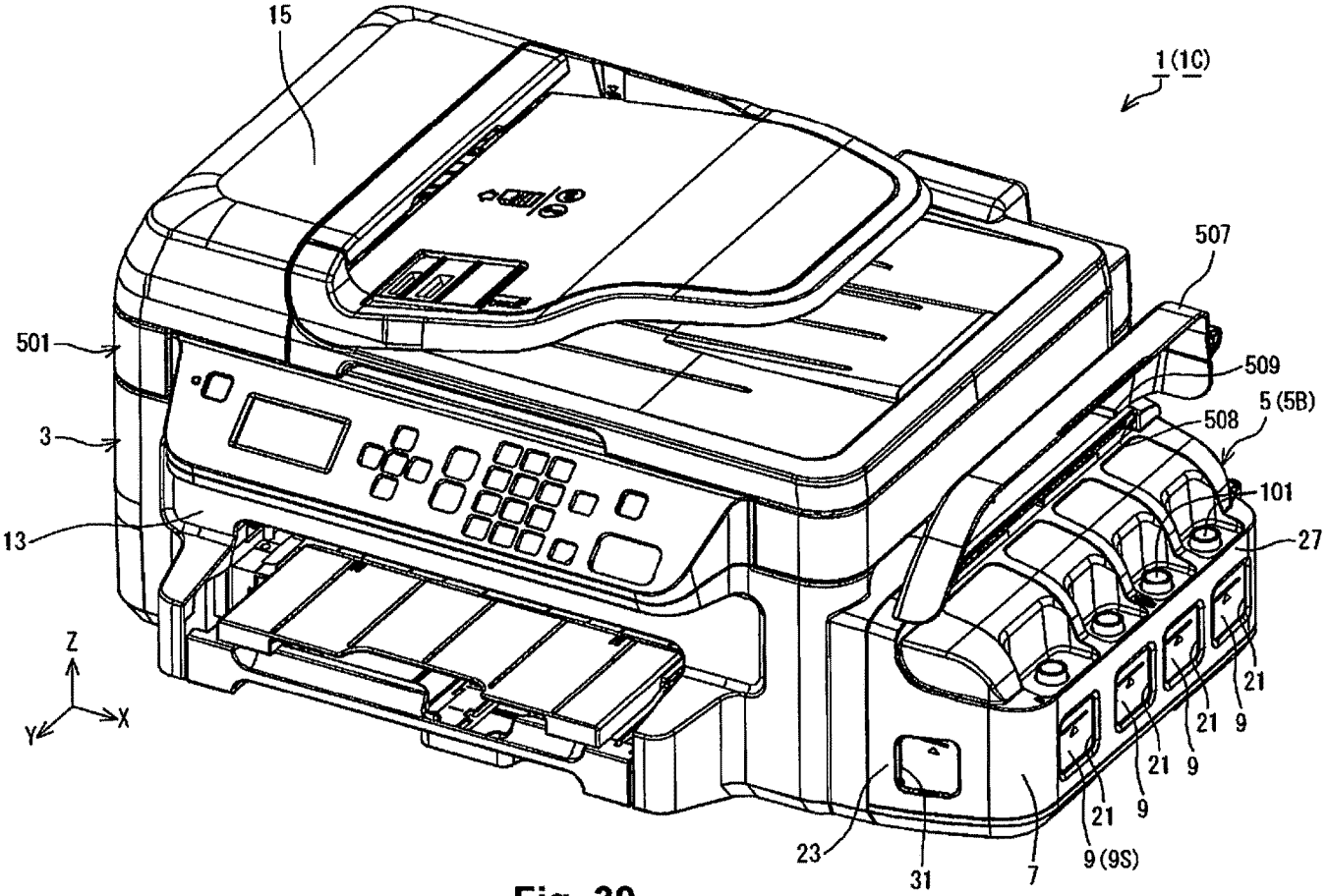
FIG. 39 is a perspective diagram illustrating another example of a liquid ejecting system in an embodiment.

The tank unit 5B in the liquid ejecting system 1C has a cover 507 as shown in FIG. 39. The cover 507 engages with the second casing 7 via a hinge section 508. The cover 507 is configured to be able to rotate with regard to the second casing with the hinge section 508 as a pivot. FIG. 39 shows a state where the cover 507 is open. When the cover 507 is opened, the ink introduction section 101 in the tank 9 is exposed. In this manner, it is possible for an operator to access the ink introduction section 101 in the tank 9 when the cover 507 is opened by the cover 507 being rotated.

Figure 40:
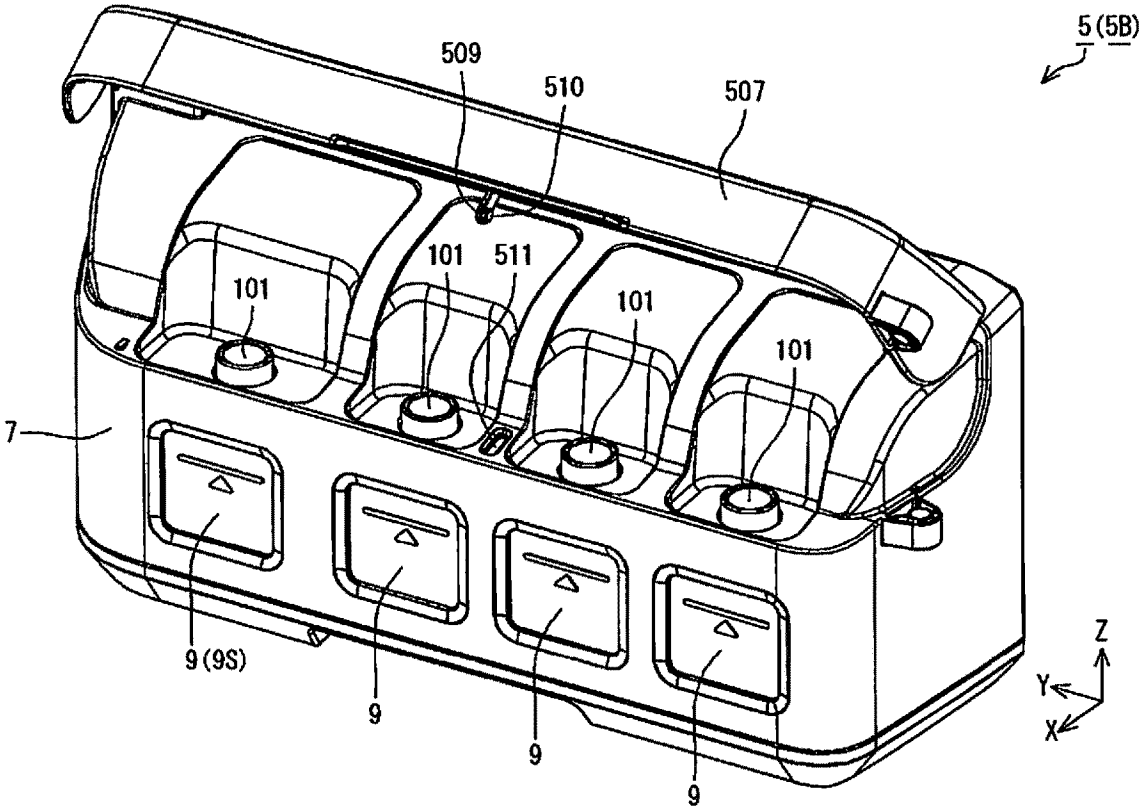
FIG. 40 is a perspective diagram illustrating another example of a tank unit in an embodiment.

Here, a protruding portion 509 is provided in the cover 507. As shown in FIG. 40, the protruding portion 509 is provided on the second casing 7 side of the cover 507. The protruding portion 509 protrudes from the cover 507 to the second casing 7 side. A projection 510 is formed in the protruding portion 509. The projection 510 is formed on the opposite side to the cover 507 side of the protruding portion 509. The projection 510 protrudes from the protruding portion 509 toward the −Y axis direction. An engaging hole 511 is formed at a portion which opposes the protruding portion 509 in the second casing 7. The engaging hole 511 is formed at a portion, which overlaps with the protruding portion 509 when the cover 507 is closed, in the second casing 7.

The protruding portion 509 are inserted into the engaging hole 511 of the second casing 7 in a state where the cover 507 is closed. At this time, the projection 510 of the protruding portion 509 engages with the engaging hole 511. Due to this, a clicking sensation is obtained when the projection 510 engages with the engaging hole 511 due to the cover 507 being closed. In addition, it is possible to buffer the force of the cover 507 by the projection 510 engaging with the engaging hole 511 as such, for example, when the cover 507 is closed with a strong force. Due to this, it is possible to reduce shocks when the cover 507 abuts with the second casing 7 when the cover 507 is closed.

Figure 41:
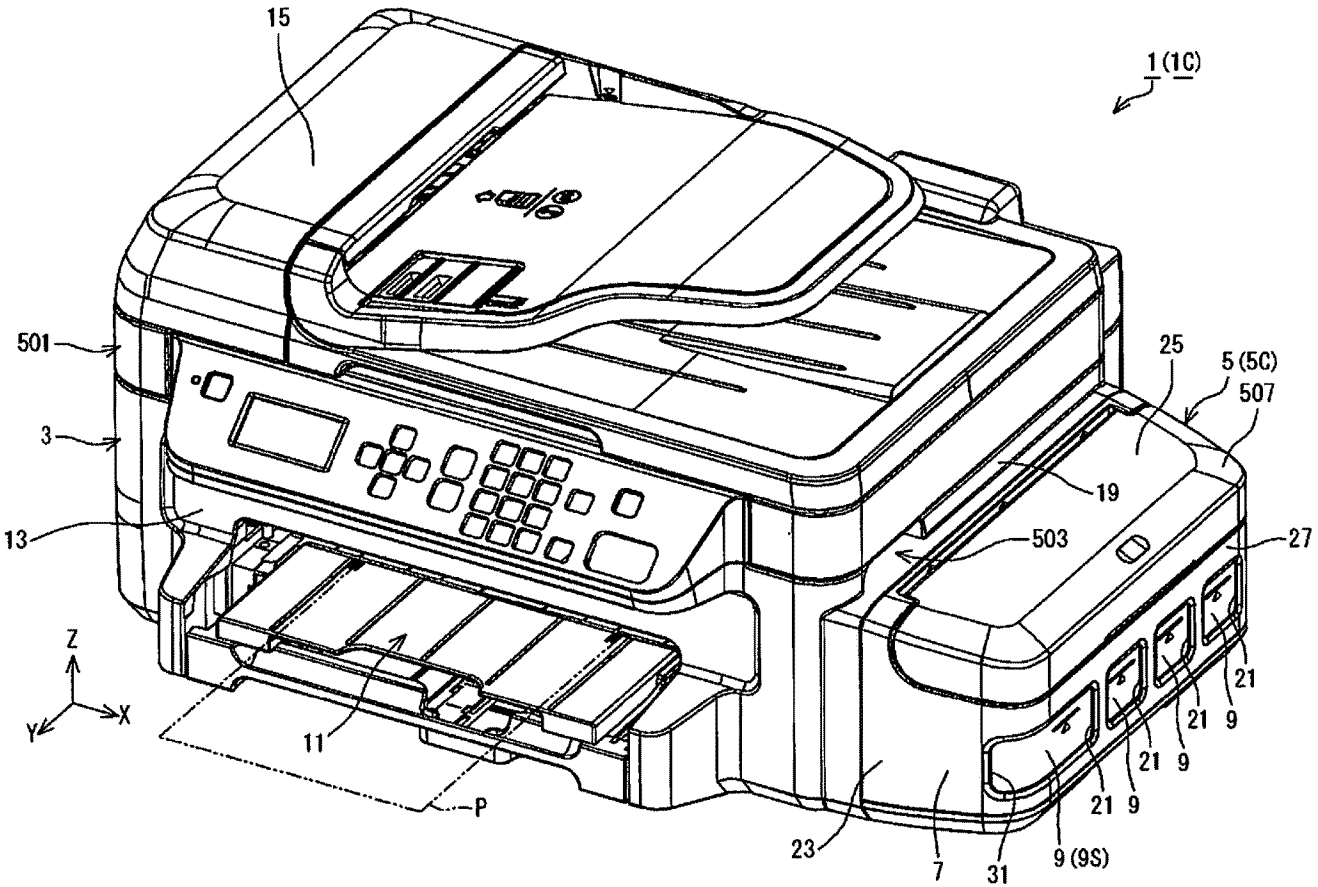
FIG. 41 is a perspective diagram illustrating another example of a liquid ejecting system in an embodiment.

A configuration is adopted in the tank unit 5B described above where the window portion 31 is provided independently to the window portions 21. However, the configuration where it is easy to ascertain the amount of ink inside the tank 9 from the front surface 13 side of the liquid ejecting system 1 is not limited to this. As the configuration where it is easy to ascertain the amount of ink inside the tank 9 from the front surface 13 side of the liquid ejecting system 1, it is possible to adopt, for example, an aspect which is a tank unit 5C shown in FIG. 41. The window portion 21, which is positioned farthest to the front surface 23 side, extends to the front surface 23 side in the tank unit 5C. In other words, the window portion 21, which is positioned farthest to the front surface 23 side, and the window portion 31 are continuous in the tank unit 5C. From another point of view, the window portion 31 is provided from the front surface side of the tank 9S, which is positioned farthest to the front surface 13 side of the liquid ejecting system 1, along the side section 27 which extends in a direction which intersects with the front surface 23 of the second casing 7. With this configuration, it is possible for an operator to visually recognize the amount of ink in the tank 9 which is positioned farthest to the front surface 23 side by the tank 9 which is positioned farthest to the front surface 23 side being visually recognizable from the front surface 13 side of the printer 3 via the window portion 21 which extends to the front surface 23 side. In addition, with this configuration, it is easy for the opening sections to be widened and it is easy for the tank 9S to be visually recognizable since the window portions 21 and the window portion 31 are continuous. In addition, since the opening sections become one opening section, manufacturing and positioning are easy compared to a case where there are a plurality of the opening sections.

Figure 42:
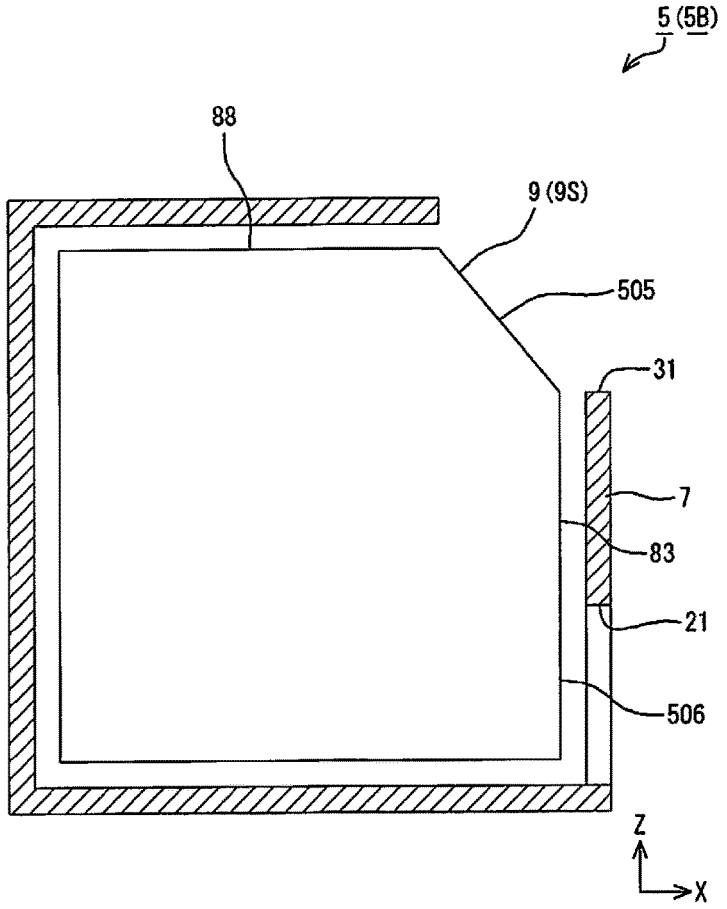
FIG. 42 is a cross sectional diagram schematically illustrating a tank unit in an embodiment.

Here, a configuration is adopted in the tank 9S where a side section on the front surface 13 side of the printer 3 is the first side portion 505 as shown in FIG. 38. However, the configuration of the tank 9S is not limited to this. As the configuration of the tank 9S, it is possible to also adopt a configuration where, for example, the first side portion 505 is arranged at a section where the third wall 83 and the eight wall 88 of the tank 9 intersect as shown in FIG. 42 which is a cross sectional diagram schematically illustrating the tank unit 5B. In this case, the window portion 31 is formed at a portion which opposes the first side portion 505. In this configuration, the first side portion 505 is positioned vertically above the second side portion 506. Due to this configuration, it is easy for the ink in the tank 9S to be visually recognized via the first side portion 505 which is positioned above the second side portion 506. Here, FIG. 42 schematically illustrates a cross section where the tank 9S is cut away at the XZ plane.

Figure 43:
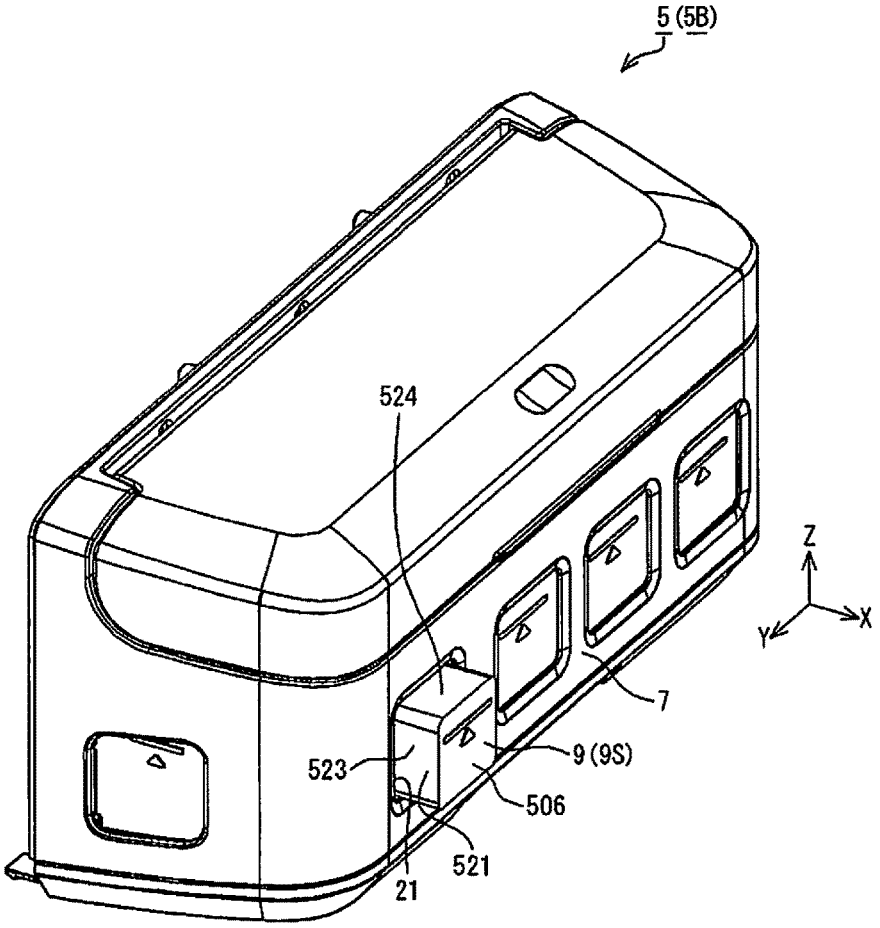
FIG. 43 is a perspective diagram illustrating another example of a tank unit in an embodiment.

In addition, it is possible to also adopt a configuration in the tank 9S where at least a portion of the second side portion 506 protrudes more than second casing 7 as shown in FIG. 43. In this configuration, the tank 9S has a protruding portion. A protruding portion 521 protrudes from the second side portion 506 (FIG. 38) of the tank 9S in the X axis direction. Then, an end section on the X axis direction side of the protruding portion 521 is configured as the second side portion 506. The second side portion 506 protrudes from the window portion 21 in the second casing 7 in the X axis direction in a configuration where there is the protruding portion 521. In the configuration where there is the protruding portion 521, it is possible for the ink in the tank 9S to be visually recognizable via a third side section 523 in the protruding portion 521. The third side section 523 is a side section which is toward the front surface 13 (FIG. 38) side of the printer 3 out of the side sections which intersect with the second side portion 506. For this reason, it is possible for an operator to visually recognize the amount of ink in the tank 9S by the tank 9S being visually recognizable from the front surface 13 side of the printer 3 via the third side section 523.

In addition, it is possible for the ink in the tank 9S to be visually recognizable via a fourth side section 524 of the protruding portion 521 in the configuration where there is the protruding portion 521. The fourth side section 524 is a side section which is toward the upper surface 15 (FIG. 38) side of the printer 3 out of the side sections which intersect with the second side portion 506. For this reason, it is possible for an operator to visually recognize the amount of ink in the tank 9S by the tank 9S being visually recognizable from the upper surface 15 side of the printer 3 via the fourth side section 524. In this manner, it is possible to increase convenience since it is possible for the ink in the tank 9S to be visually recognizable from many directions due to the tank 9S which has the protruding portion 521. Here, it is possible to also adopt a configuration where the protruding portion 521 is provided in the first side portion 505. In this case, it is possible to adopt various configurations such as a configuration where the protruding portion 521 is provided in the first side portion 505 or a configuration where the protruding portion 521 is provided in both the first side portion 505 and the second side portion 506.

Figure 44:
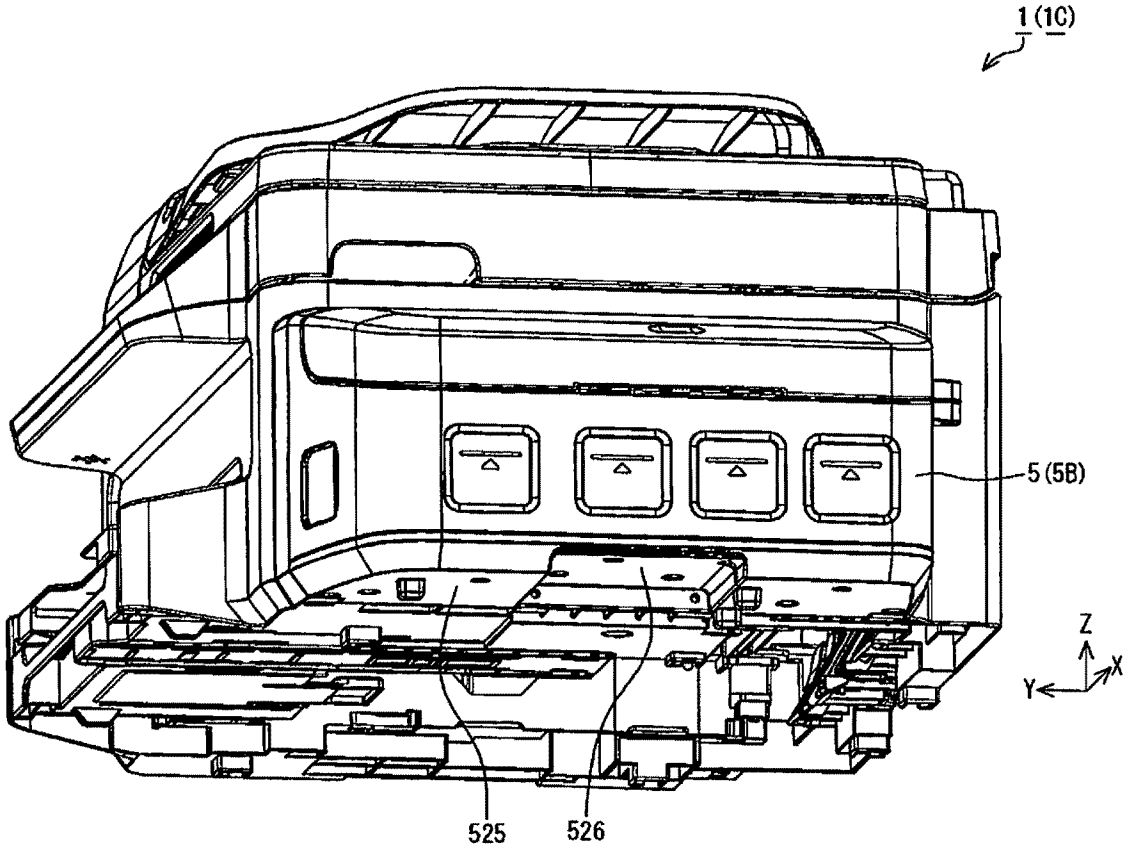
FIG. 44 is a perspective diagram illustrating another example of a liquid ejecting system in an embodiment.

Here, a handle section 526 is formed in a bottom surface 525 of the tank unit 5B and the tank unit 5C in the liquid ejecting system 1C as shown in FIG. 44. The handle section 526 is provided as a recessed section which is formed in the bottom surface 525 of the tank unit 5B and the tank unit 5C. The handle section 526 is formed with an orientation so to be recessed from the bottom surface 525 in the Z axis direction. It is possible for an operator to lift up the liquid ejecting system 1C in the Z axis direction by inserting a finger into the handle section 526. At this time, it is easy for the liquid ejecting system 1C to be supported by the operator inserting a finger in the handle section 526 since the handle section 526 is formed with an orientation so to be recessed from the handle section 526 in the Z axis direction.

GENERAL INTERPRETATION OF TERMS

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A liquid supplying apparatus configured to supply a liquid to a liquid ejecting section of a liquid ejecting system that is configured to eject the liquid, the liquid ejecting system including a scanner unit, the liquid supplying apparatus comprising:

a plurality of tanks configured to contain the liquid, each of the plurality of tanks including a containing section; and a plurality of optically transmissive container sections, each of the plurality of container sections being connected to a corresponding one of the plurality of tanks, each of the plurality of container sections being connected to the containing section of the corresponding one of the plurality of tanks and being in communication with the atmosphere through the corresponding one of the plurality of tanks, the plurality of tanks being arranged along a first direction;

the plurality of container sections being arranged along a second direction perpendicular to the first direction, the plurality of container sections and the plurality of tanks being arranged such that a position of the plurality of container sections in the second direction overlays a position of the plurality of tanks in the second direction, with a positional relation between the position of the plurality of container sections and the position of the plurality of tanks being fixed, and the plurality of container sections and the plurality of tanks being located below the scanner unit.

2. The liquid supplying apparatus according to claim 1, wherein each of the plurality of tanks includes a liquid inlet section configured to receive a liquid filled into the containing section.

3. The liquid supplying apparatus according to claim 1, wherein each of the plurality of tanks includes an optically transmissive wall, through which the liquid inside the containing section is visually recognizable from outside thereof.

4. The liquid supplying apparatus according to claim 3, wherein the optically transmissive wall has an upper limit mark that is visually recognizable as an upper limit level of the liquid filled into the containing section.

5. The liquid supplying apparatus according to claim 1, wherein a liquid level of each of the plurality of container sections is the same as a liquid level in the containing section.

6. The liquid supplying apparatus according to claim 1, wherein each of the plurality of container sections is optically transmissive such that the liquid inside each of the plurality of container sections is visually recognizable from outside thereof.

7. A liquid ejecting apparatus comprising:

the liquid supplying apparatus according to claim 1; and a liquid ejecting section configured to eject the liquid supplied from the liquid supplying apparatus.

* * * * *